US008921290B2

(12) United States Patent
Lee et al.

(10) Patent No.: US 8,921,290 B2
(45) **Date of Patent: *Dec. 30, 2014**

(54) GEAR OIL COMPOSITIONS

(71) Applicant: ExxonMobil Research and Engineering Company, Annandale, NJ (US)

(72) Inventors: Gordon H. Lee, Newtown, PA (US); Willie A. Givens, Jr., Williamstown, NJ (US); Angela S. Galiano-Roth, Mullica Hill, NJ (US); Margaret M. Wu, Skillman, NJ (US); James T. Carey, Medford, NJ (US)

(73) Assignee: ExxonMobil Research and Engineering Company, Annandale, NJ (US)

( * ) Notice: Subject to any disclaimer, the term of this patent is extended or adjusted under 35 U.S.C. 154(b) by 46 days.

This patent is subject to a terminal disclaimer.

(21) Appl. No.: 13/792,379

(22) Filed: Mar. 11, 2013

(65) Prior Publication Data

US 2013/0184191 A1 Jul. 18, 2013

Related U.S. Application Data

(63) Continuation-in-part of application No. 13/523,224, filed on Jun. 14, 2012, now Pat. No. 8,834,705, and a continuation-in-part of application No. 11/810,019, filed on Jun. 4, 2007, now Pat. No. 8,535,514.

(60) Provisional application No. 60/811,207, filed on Jun. 6, 2006.

(51) Int. Cl.

| | |
|---|---|
| ***C10M 143/00*** | (2006.01) |
| ***C10M 105/10*** | (2006.01) |
| ***C10M 171/02*** | (2006.01) |
| ***C10M 107/02*** | (2006.01) |
| ***C10M 111/04*** | (2006.01) |
| ***C10M 171/04*** | (2006.01) |

(52) U.S. Cl.
CPC ..... *C10M 171/02* (2013.01); *C10M 107/02* (2013.01); *C10M 111/04* (2013.01);

(Continued)

(58) Field of Classification Search
USPC ..... 508/591, 583; 208/18, 19; 585/1, 10, 12
See application file for complete search history.

(56) References Cited

U.S. PATENT DOCUMENTS

| | | | |
|---|---|---|---|
| 2,978,442 | A | 4/1961 | Brightbill et al. |
| 3,149,178 | A | 9/1964 | Hamilton et al. |

(Continued)

FOREIGN PATENT DOCUMENTS

| | | |
|---|---|---|
| DE | 19827323 | 6/1998 |
| EP | 0088453 B1 | 5/1987 |

(Continued)

OTHER PUBLICATIONS

J. Brennan, "Wide-Temperature Range Synthetic Hydrocarbon Fluids", Ind. Eng. Chem. Prod. Res. Dev., 1980, vol. 19, pp. 2-6.

(Continued)

*Primary Examiner* — Pamela H Weiss
(74) *Attorney, Agent, or Firm* — Derek M. Kato; Robert A. Migliorini

(57) ABSTRACT

A novel lubricant composition is disclosed. In one embodiment the lubricant composition comprises in admixture: a first base stock component comprising one or more base stocks each having a viscosity of at least 40 cSt, Kv100° C. and a molecular weight distribution (MWD) as a function of viscosity at least 10 percent less than algorithm: MWD=0.2223+1.0232*log (Kv at 100° C. in cSt); and a second base stock component comprising at least one Poly-Alpha-Olefin (PAO) base stock and at least one Group III base stock, each having a viscosity less than 10 cSt, Kv100° C.

25 Claims, 6 Drawing Sheets

(52) U.S. Cl.
CPC ..... *C10M 171/04* (2013.01); *C10M 2203/1025* (2013.01); *C10M 2205/0285* (2013.01); *C10N 2220/021* (2013.01); *C10N 2220/022* (2013.01); *C10N 2220/023* (2013.01); *C10N 2230/02* (2013.01); *C10N 2230/06* (2013.01); *C10N 2230/08* (2013.01); *C10N 2230/18* (2013.01); *C10N 2230/68* (2013.01); *C10N 2240/04* (2013.01); *C10N 2270/00* (2013.01); *C10M 2205/026* (2013.01); *C10M 2207/28* (2013.01); *C10N 2230/74* (2013.01)
USPC ..... 508/583; 508/591

(56) References Cited

U.S. PATENT DOCUMENTS 3,164,578 A 1/1965 Baker et al.
3,382,291 A 5/1968 Brennan
3,576,923 A 4/1971 Randell et al.
3,742,082 A 6/1973 Brennan
3,769,363 A 10/1973 Brennan
3,780,128 A 12/1973 Shubkin
3,876,720 A 4/1975 Heilman et al.
3,883,417 A 5/1975 Woo et al.
4,016,349 A 4/1977 McKenna
4,132,663 A 1/1979 Heilman et al.
4,172,855 A 10/1979 Shubkin et al.
4,234,435 A 11/1980 Meinhardt et al.
4,239,930 A 12/1980 Allphin et al.
4,263,150 A 4/1981 Clason et al.
4,263,465 A 4/1981 Sheng et al.
4,289,635 A 9/1981 Schroeck
4,308,154 A 12/1981 Clason et al.
4,367,352 A 1/1983 Watts, Jr. et al.
4,413,156 A 11/1983 Watts, Jr. et al.
4,417,990 A 11/1983 Clason et al.
4,434,308 A 2/1984 Larkin et al.
4,451,684 A 5/1984 Pasky
4,469,912 A 9/1984 Blewett et al.
4,587,368 A 5/1986 Pratt
4,652,416 A 3/1987 Millot
4,701,489 A 10/1987 Hughes et al.
4,704,491 A 11/1987 Tsutsui et al.
4,776,967 A 10/1988 Ichihashi et al.
4,892,851 A 1/1990 Ewen et al.
4,906,799 A 3/1990 Forbus, Jr. et al.
4,910,355 A 3/1990 Shubkin et al.
4,914,254 A 4/1990 Pelrine
4,922,046 A 5/1990 Kinoshita et al.
4,926,004 A 5/1990 Pelrine et al.
4,943,383 A 7/1990 Avery et al.
4,950,822 A 8/1990 Dileo et al.
4,962,249 A 10/1990 Chen et al.
4,962,262 A 10/1990 Winter et al.
4,967,032 A 10/1990 Ho et al.
4,990,709 A 2/1991 Wu
5,012,020 A 4/1991 Jackson et al.
5,017,299 A 5/1991 Gutierrez et al.
5,017,714 A 5/1991 Welborn, Jr.
5,057,235 A 10/1991 Farng et al.
5,068,487 A 11/1991 Theriot
5,087,788 A 2/1992 Wu
5,104,579 A 4/1992 Benjamin et al.
5,113,030 A 5/1992 Chen et al.
5,132,478 A 7/1992 Ho et al.
5,146,021 A 9/1992 Jackson et al.
5,157,177 A 10/1992 Pelrine et al.
5,177,276 A 1/1993 Beach et al.
5,186,851 A 2/1993 Gutierrez et al.
5,187,250 A 2/1993 Asanuma et al.
5,188,724 A 2/1993 Heilman et al.
5,208,403 A 5/1993 Buchanan et al.
5,220,100 A 6/1993 Massie et al.
5,243,114 A 9/1993 Johnson et al.
5,254,274 A 10/1993 Ho et al.
5,264,642 A 11/1993 Wu
5,276,227 A 1/1994 Wu et al.
5,276,277 A 1/1994 Hightower et al.
5,369,196 A 11/1994 Matsumoto et al.
5,382,739 A 1/1995 Atkins et al.
5,462,995 A 10/1995 Hosaka et al.
5,498,815 A 3/1996 Schaerfl, Jr. et al.
5,602,086 A 2/1997 Le et al.
5,679,812 A 10/1997 Winter et al.
5,688,887 A 11/1997 Bagheri et al.
5,705,577 A 1/1998 Rossi et al.
5,731,254 A 3/1998 Winter et al.
5,807,949 A 9/1998 Rossi et al.
5,811,379 A 9/1998 Rossi et al.
5,846,896 A 12/1998 Ewen
5,852,143 A 12/1998 Sishta et al.
5,859,159 A 1/1999 Rossi et al.
6,043,401 A 3/2000 Bagheri et al.
6,080,301 A 6/2000 Berlowitz et al.
6,087,307 A 7/2000 Kaminski et al.
6,090,989 A 7/2000 Trewella et al.
6,124,513 A 9/2000 Heilman et al.
6,133,209 A 10/2000 Rath et al.
6,147,271 A 11/2000 Strebel et al.
6,165,949 A 12/2000 Berlowitz et al.
6,180,575 B1 1/2001 Nipe
6,388,032 B1 5/2002 Yamaura et al.
6,395,948 B1 5/2002 Hope et al.
6,414,090 B2 7/2002 Minami et al.
6,479,722 B1 11/2002 De Wet et al.
6,548,723 B2 4/2003 Bagheri et al.
6,548,724 B2 4/2003 Bagheri et al.
6,642,169 B2 11/2003 Weatherhead
6,646,174 B2 11/2003 Clarembeau
6,706,828 B2 3/2004 DiMaio
6,824,671 B2 11/2004 Goze et al.
6,848,767 B2 2/2005 West et al.
6,858,767 B1 2/2005 DiMaio et al.
6,869,917 B2 3/2005 Deckman et al.
7,022,784 B2 4/2006 Wu et al.
7,060,768 B2 6/2006 Brookhart et al.
7,129,197 B2 10/2006 Song et al.
7,312,185 B2 12/2007 Willey et al.
7,544,850 B2 6/2009 Goze et al.
7,547,811 B2 6/2009 Kramer et al.
7,585,823 B2 9/2009 Sullivan et al.
7,592,411 B2 9/2009 Wu et al.
7,592,497 B2 9/2009 Yang et al.
7,683,013 B2 3/2010 Carey et al.
7,795,194 B2 9/2010 Iimura et al.
8,247,358 B2 * 8/2012 Lee et al. ..... 508/499
8,501,675 B2 * 8/2013 Haigh et al. ..... 508/583
8,535,514 B2 * 9/2013 Carey et al. ..... 208/19
8,598,103 B2 * 12/2013 Carey et al. ..... 508/591
8,642,523 B2 * 2/2014 Crouthamel et al. ..... 508/591
2001/0041817 A1 11/2001 Bagheri et al.
2001/0041818 A1 11/2001 Bagheri et al.
2003/0055184 A1 3/2003 Song et al.
2003/0236177 A1 * 12/2003 Wu et al. ..... 508/465
2004/0033908 A1 2/2004 Deckman et al.
2004/0087746 A1 5/2004 Razavi
2004/0092408 A1 5/2004 Willey et al.
2004/0097772 A1 5/2004 Deckers et al.
2004/0147693 A1 7/2004 DiMaio
2004/0157752 A1 * 8/2004 DiMaio et al. ..... 508/241
2004/0220359 A1 11/2004 Abhari et al.
2004/0225088 A1 11/2004 Vaughan et al.
2004/0230016 A1 11/2004 Blackborrow et al.
2005/0059563 A1 3/2005 Sullivan et al.
2005/0101761 A1 5/2005 Lambert et al.
2005/0183988 A1 8/2005 Freerks et al.
2005/0250657 A1 * 11/2005 Wu et al. ..... 508/591
2006/0116303 A1 6/2006 Iimura et al.
2006/0157383 A1 * 7/2006 Wu et al. ..... 208/18
2007/0000807 A1 1/2007 Wu et al.
2007/0043248 A1 2/2007 Wu et al.
2007/0208151 A1 9/2007 Okada et al.
2007/0289897 A1 12/2007 Carey et al.
2008/0020954 A1 1/2008 Haigh et al.

(56) References Cited

U.S. PATENT DOCUMENTS

| | | | |
|---|---|---|---|
| 2008/0177121 | A1 | 7/2008 | Wu et al. |
| 2009/0005279 | A1 | 1/2009 | Wu et al. |
| 2009/0036725 | A1 | 2/2009 | Wu et al. |
| 2009/0093657 | A1 | 4/2009 | Buchanan et al. |
| 2009/0156874 | A1 | 6/2009 | Patil et al. |
| 2009/0181872 | A1 | 7/2009 | Yamada |
| 2009/0240012 | A1 | 9/2009 | Patil et al. |
| 2009/0298990 | A1 | 12/2009 | Kim et al. |
| 2010/0006259 | A1 | 1/2010 | Mori et al. |
| 2010/0048438 | A1 | 2/2010 | Carey et al. |
| 2010/0105585 | A1 | 4/2010 | Carey et al. |
| 2010/0105589 | A1 | 4/2010 | Lee et al. |
| 2010/0256026 | A1 | 10/2010 | Wu et al. |
| 2010/0292424 | A1 | 11/2010 | Wu et al. |
| 2011/0082063 | A1 | 4/2011 | Carey et al. |
| 2011/0136714 | A1 | 6/2011 | Haigh et al. |

FOREIGN PATENT DOCUMENTS

| | | | |
|---|---|---|---|
| EP | 0276320 | B1 | 8/1988 |
| EP | 0277004 | A1 | 8/1988 |
| EP | 0277007 | B1 | 8/1988 |
| EP | 0284708 | B1 | 10/1988 |
| EP | 0291006 | B1 | 11/1988 |
| EP | 0321852 | B1 | 6/1989 |
| EP | 0349276 | B1 | 1/1990 |
| EP | 0377306 | B1 | 7/1990 |
| EP | 0403866 | A1 | 12/1990 |
| EP | 0513380 | B1 | 11/1992 |
| EP | 0680942 | A1 | 5/1994 |
| EP | 0613873 | A2 | 9/1994 |
| EP | 0930320 | A1 | 7/1997 |
| EP | 1028128 | A1 | 10/1997 |
| EP | 0992517 | A2 | 9/1998 |
| EP | 1309633 | B1 | 8/2000 |
| EP | 1342707 | A2 | 9/2003 |
| EP | 1607415 | A1 | 12/2005 |
| EP | 1661921 | | 5/2006 |
| GB | 938069 | | 9/1963 |
| IN | 191553 | | 12/2003 |
| JP | 6336590 | A | 12/1994 |
| JP | 200500446 | A | 7/2005 |
| WO | 9623751 | | 8/1996 |
| WO | 9967347 | | 6/1999 |
| WO | 0214384 | A2 | 2/2002 |
| WO | 03009136 | A1 | 1/2003 |
| WO | 03020856 | A1 | 3/2003 |
| WO | 03051943 | A1 | 6/2003 |
| WO | 03071369 | A1 | 8/2003 |
| WO | 03104292 | A1 | 12/2003 |
| WO | 2004046214 | A2 | 6/2004 |
| WO | 2004053030 | A2 | 6/2004 |
| WO | 2007005094 | A1 | 1/2007 |
| WO | 2007011462 | A1 | 1/2007 |
| WO | 2007011832 | A1 | 1/2007 |
| WO | 2007073135 | A1 | 6/2007 |
| WO | 2007145924 | A1 | 12/2007 |
| WO | 2007146081 | A1 | 12/2007 |
| WO | 2008010865 | A2 | 1/2008 |
| WO | 2009017953 | A2 | 2/2009 |
| WO | 2009094192 | A1 | 7/2009 |
| WO | 2009123800 | A1 | 10/2009 |
| WO | 2009137264 | A1 | 11/2009 |
| WO | 2010039266 | A1 | 4/2010 |

OTHER PUBLICATIONS

K. Denbigh, "The Kinetics of Continuous Reaction Processes: Application to Polymerization", J. Applied Chem, 1951, vol. 1, pp. 227-236.

K. Denbigh, "Continuous Reactions: Part II. The Kinetics of Steady State Polymerisation", Trans Faraday Soc., 1947, vol. 43, pp. 648-660.

A. Munoz-Escalona, et al., "Single-Site Supported Catalysts for Ethylene Polymerization", Metallocene Tech., 1999, pp. 2242-2246.

Z. Fan, et al., "Effect of Ethoxy- and Methoxysilane Donors in Propene/1-Hexene Copolymerization with High-Yield Supported Ziegler-Natta Catalysts", Macromolecular Chemistry and Physics, 1994, vol. 195, pp. 3889-3899.

G. Gokel, ed., "Dean's Handbook of Organic Chemistry", 2nd Edition, McGraw-Hill, 2004, available on-line at hhtp://knovel.com.

M. LeVan, et al., "Adsorption and Ion Exchange", Perry's Chemical Engineer's Handbook, 7th ed., 1997, pp. 16-1-16-66.

O. Levenspiel, "Ch. 7: Design for Multiple Reactions", Chemical Reaction Engineering, 2nd ed., 1972, pp. 196-209.

N. Naga, et al., "Effect of Co-Catalyst System on a-Olefin Polymerization with Rac- and Meso-[Dimethylsilylenebis (2,3,5-Trimethyl-Cyclopentadienyl)] Zirconium Dichloride", Macromol. Rapid Commun., 1997, vol. 18, pp. 581-589.

N. Naga, et al., "Polymerization Behavior of a-Olefins with Rac- and Meso-Type Ansa-Metallocene Catalyst: Effects of Cocatalyst and Metallocene Ligand", Macromolecular Chemistry Physics, 1999, vol. 200, pp. 1587-1594.

F. Rodriguez, "The Molecular Weight of Polymers", Principles of Polymer Systems, 1970, Chapter 6, pp. 115-144.

M. Sacchi, et al., "Use of Different Alkoxysilanes as External Donors in MgCl2-Supported Ziegler-Natta Catalysts to Obtain Propene/1-Butene Copolymers with Different Microstructure", Macromolecular Chemistry and Physics, 1994, vol. 195, pp. 2805-2816.

T. Seraidaris, et al., "High-Molar-Mass Polypropene with Tunable Elastic Properties by Hafnocene/Borate Catalysts", Journal of Polymer Science: Part A: Polymer Chemistry, 2006, vol. 44, pp. 4743-4751.

J. Wills, "Synthetic Lubricants", Lubrication Fundamentals, Marcel Dekker Inc., New York, 1980, pp. 75-80.

"Mobil Releases SuperSyn PAO's", Lubrication Engineers, 1999, vol. 55, Part 8, pp. 45.

TIBA data, "TIBA datasheet" available on-line at www.albermarle.com on Aug. 26, 2010.

ASTM D3427-03, "Standard Test Method for Air Release Properties of Petroleum Oils".

http://www.mobil.com/USA, Mobilgear®SHC XMP Series.

http://www.famm11c.com/famm/lubricant_product.asp?gearoils&&wPinnacleMarineGear220, Pinnacle® Marine Gear 220.

* cited by examiner

GEAR OIL COMPOSITIONS

CROSS-REFERENCE TO RELATED APPLICATION

This application is a continuation-in-part of U.S. Ser. No. 13/523,224, filed on Jun. 14, 2012, which is a continuation-in-part of U.S. Ser. No. 11/810,019, filed on Jun. 4, 2007, which claims benefit of U.S. Ser. No. 60/811,207, filed Jun. 6, 2006.

BACKGROUND

Due to increasingly stringent environmental regulations that limit vehicle emissions, increased fuel efficiency has become a critical requirement for vehicle manufacturers. In recent years, lubricants have been formulated to help deliver a portion of the fuel efficiency mandated by governments, required by equipment builders, and desired by end customers. A proven approach to enhancing lubricant-derived fuel efficiency is to lower the viscosity of the lubricant. This, however, generally means that there are thinner oil films between moving parts. Since equipment durability cannot be compromised, the same or lower viscosity lubricants must deliver improved efficiency while retaining the same level of protection against various types of hardware damage (wear, micropitting, macropitting, scuffing, etc).

In automobile axles and transmissions, the fuel economy benefit is determined by the sum of viscous and traction effects. Fixed losses, which respond to speed, include losses due to lubricant churning, shaft bearings and seals. Generally, these fixed losses are impacted by the lubricant viscosity, such that higher speeds and lower loads favor use of lower viscosity lubricants. Contact losses, which respond to load and speed, include gear meshing. Generally, these contact losses are reduced by using a lubricant with lower traction coefficient, which can be viewed as lower internal friction between molecules of the lubricant under high load conditions.

Accordingly, there is a need for a lubricant that delivers lower traction and friction coefficients than conventional base oil/VM technology in a typical gear oil formulation, while maintaining or improving wear and load-carrying performance. The present invention satisfies this need by providing novel combinations of base stocks that give the desired performance. Additionally, the lubricants of the present inventions provide improved low temperature flow properties, which contribute to potential efficiency gains, and improved shear stability, which contributes to increased oil life and oil film durability. The present invention also provides methods for improving shear stability, wear and load characteristics in a lubricating composition.

Air entrainment is another issue in lubricating oils. All lubricating oil systems contain some air. It can be found in four phases: free air, dissolved air, entrained air and foam. Free air is trapped in a system, such as an air pocket in a hydraulic line. Dissolved air is in solution with the oil and is not visible to the naked eye. Foam is a collection of closely packed bubbles surrounded by thin films of oil that collect on the surface of the oil.

Air entrainment is a small amount of air in the form of extremely small bubbles (generally less than 1 mm in diameter) dispersed throughout the bulk oil. Agitation of lubricating oil with air in equipment, such as bearings, couplings, gears, pumps, and oil return lines, may produce a dispersion of finely divided air bubbles in the oil. If the residence time in the reservoir is too short to allow the air bubbles to rise to the oil surface, a mixture of air and oil will circulate through the lubricating oil system. This may result in an inability to maintain oil pressure (particularly with centrifugal pumps), incomplete oil films in bearings and gears, and poor hydraulic system performance or failure. A partial list of potential effects of air entrainment include: pump cavitation, spongy, erratic operation of hydraulics, loss of precision control, vibrations, oil oxidation and component wear due to reduced lubricant viscosity.

One widely used method to test air release properties of petroleum oils is ASTM D3427. This test method measures the time for the entrained air content to fall to the relatively low value of 0.2% under a standardized set of test conditions and hence permits the comparison of the ability of oils to separate entrained air under conditions where a separation time is available.

in the ASTM D3427 method, compressed air is blown through the test oil, which has been heated to a temperature of 50° C. After the air flow is stopped, the time required for the air entrained in the oil to reduce in volume to 0.2% is usually recorded as the air release time.

Accordingly, there is also a need for a lubricant that provides favorable air release and foam properties. The present inventions satisfy this need by providing novel combinations of base stocks that give the desired performance. The present inventions also provide methods for improving air release and foam collapse rate in a lubricating composition.

SUMMARY

A novel lubricant composition is disclosed. In one embodiment the novel lubricant composition comprises in admixture: a first base stock component comprising one or more base stocks each having a viscosity of at least 40 cSt, Kv100° C. and a molecular weight distribution (MWD) as a function of viscosity at least 10 percent less than algorithm: MWD=0.2223+1.0232*log (Kv at 100° C. in cSt); and a second base stock component comprising one or more base stocks each having a viscosity less than 10 cSt, Kv100° C.

In another embodiment, the novel lubricant composition comprises in admixture: a first base stock component comprising one or more metallocene catalyzed PAOs each having a viscosity greater than 40 cSt, Kv100° C.; and a second base stock comprising one or more base stocks each having a viscosity less than 10 cSt, Kv100° C.

In another embodiment, the novel lubricant composition comprises in admixture: a first base stock component comprising one or more base stocks each having a viscosity of at least 40 cSt, Kv100° C. and a molecular weight distribution (MWD) as a function of viscosity at least 10 percent less than algorithm: MWD=0.2223+1.0232*log (Kv at 100° C. in cSt); and a second base stock component comprising at least one Poly-Alpha-Olefin (PAO) base stock and at least one Group III base stock, each having a viscosity less than 10 cSt, Kv100° C.

In another embodiment, the novel lubricant composition comprises in admixture: a first base stock component comprising one or more metallocene catalyzed PAOs each having a viscosity greater than 40 cSt, Kv100° C.; and a second base stock comprising at least one Poly-Alpha-Olefin (PAO) base stock and at least one Group 11.1 base stock, each having a viscosity less than 10 cSt, Kv100° C.

In further embodiments, methods of improving air release, foam collapse rate, shear stability, wear and load characteristics in a lubricating composition are also disclosed.

DETAILED DESCRIPTION

Figure 1:
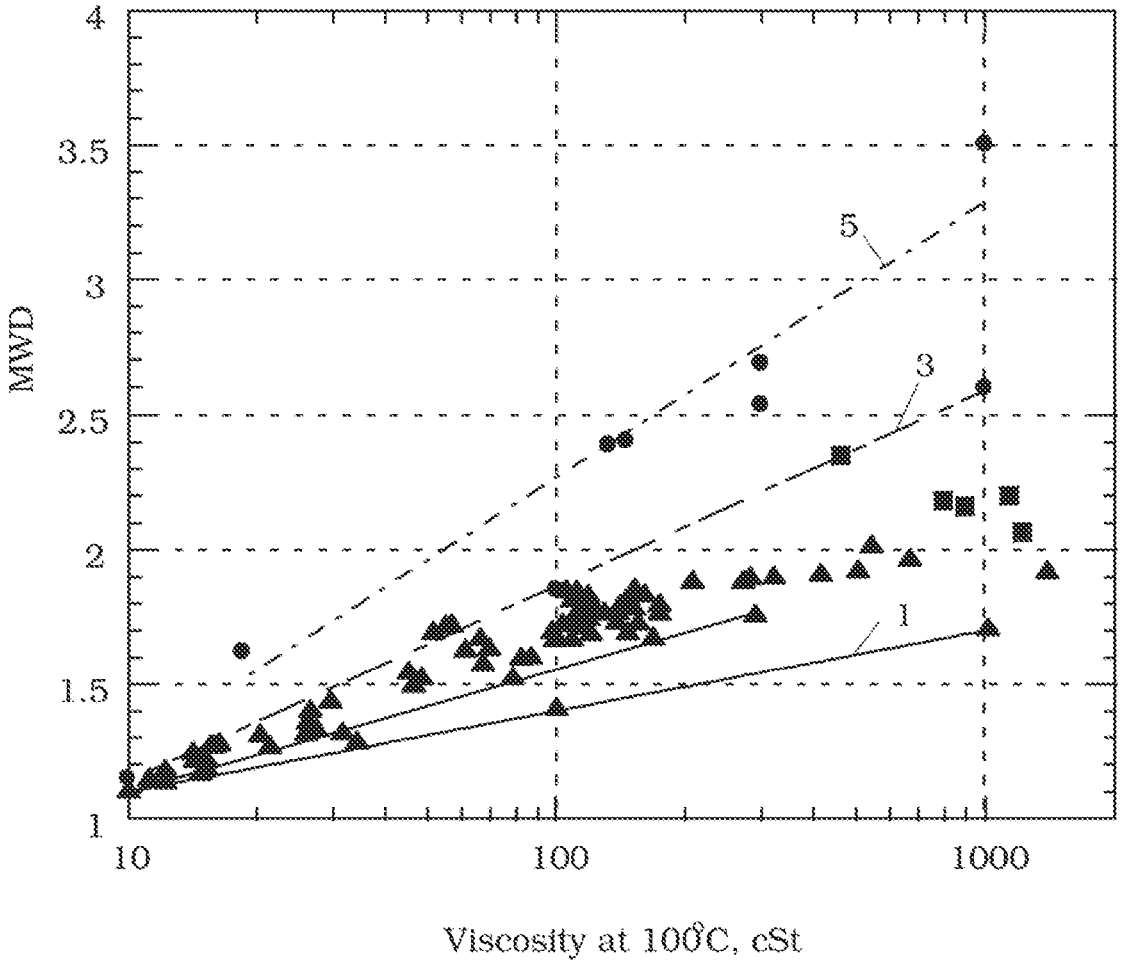
FIG. 1 is a graph illustrating the molecular weight distribution of high viscosity PAOs.

We have discovered novel combinations of base stocks that provide unexpected favorable improvements in lubricating properties. In various embodiments these properties include friction and traction coefficients, VI, low temperature flow, shear stability, air release, foam collapse rate, load and wear. In U.S. Pat. No. 7,683,013, we have discovered a novel combination of base stocks that provides an unexpected increase in micropitting protection.

In one embodiment, this novel discovery is based on "bimodal" blends of oil viscosities which are base stock viscosity differences of at least 30 cSt, Kv100° C. Kinematic viscosity is determined by ASTM D445 method by measuring the time for a volume of liquid to flow under gravity through a calibrated glass capillary viscometer. Viscosity is typically measured in centistokes (cSt, or $mm^2/s$) units. Base stock oils used to blend finished oils, are generally described using viscosities observed at 100° C. This "bi-modal" blend of viscosities also provides a temperature benefit by lowering the lubricant temperature in gear testing by approximately 10° C. This temperature drop would provide increased efficiency boosts.

In the past high viscosity base stocks have not been practical for most applications due to shear stability problems in using higher viscosity base stocks. We have discovered that new base stocks with narrow molecular weight distributions provide excellent shear stability. This discovery provided the ability to utilize high viscosity base stocks in "dumbbell" and "bi-modal" blends.

In a preferred embodiment, the new base stocks are produced according to the is method described in U.S. Provisional Application No. 60/650,206 and U.S. application Ser. Nos. 11/036,904, 11/172,161, and 11/388,825. All known methods for producing PAO including metallocene PAO are intended to be within the scope of the invention. These base stocks are known as metallocene catalyzed base stocks and are described in detail below.

Metallocene Base Stocks

In one embodiment, the metallocene catalyzed PAO (or mPAO) used for this invention can be a co-polymer made from at least two alpha-olefins or more, or a homo-polymer made from a single alpha-olefin feed by a metallocene catalyst system.

This copolymer mPAO composition is made from at least two alpha-olefins of C3 to C30 range and having monomers randomly distributed in the polymers. It is preferred that the average carbon number is at least 4.1. Advantageously, ethylene and propylene, if present in the feed, are present in the amount of less than 50 wt % individually or preferably less than 50 wt % combined. In an embodiment, essentially no ethylene or propylene monomers are present in the copolymer mPAO composition. The copolymers of the invention can be isotactic, atactic, syndiotactic polymers or any other form of appropriate tacticity. These copolymers have useful lubricant properties including excellent VI, pour point, low temperature viscometrics by themselves or as blend fluid with other lubricants or other polymers. Furthermore, these copolymers have narrow molecular weight distributions and excellent lubricating properties.

In an embodiment, mPAO is made from the mixed feed LAOs comprising at least two and up to 26 different linear alpha-olefins selected from C3 to C30 linear alpha-olefins. In a preferred embodiment, the mixed feed LAO is obtained from an ethylene growth process using an aluminum catalyst or a metallocene catalyst. The growth olefins comprise mostly C6 to C18-LAO. LAOs from other process, such as the SHOP process, can also be used.

This homo-polymer mPAO composition is made from single alpha-olefin choosing from C3 to C30 range, preferably C3 to C16, most preferably C3 to C14 or C3 to C12. The homo-polymers of the invention can be isotactic, atactic, syndiotactic polymers or any other form of appropriate tacticity. Often the tacticity can be carefully tailored by the polymerization catalyst and polymerization reaction condition chosen or by the hydrogenation condition chosen. These homo-polymers have useful lubricant properties including excellent VI, pour point, low temperature viscometrics by themselves or as blend fluid with other lubricants or other polymers. Furthermore, these homo-polymers have narrow molecular weight distributions and excellent lubricating properties.

In another embodiment, the alpha-olefin(s) can be chosen from any component from a conventional LAO production facility or from refinery. It can be used alone to make homo-polymer or together with another LAO available from refinery or chemical plant, including propylene, 1-butene, 1-pentene, and the like, or with 1-hexene or 1-octene made from dedicated production facility. In another embodiment, the alpha-olefins can be chosen from the alpha-olefins produced from Fischer-Trosch synthesis (as reported in U.S. Pat. No. 5,382,739). For example, C3 to C16-alpha-olefins, more preferably linear alpha-olefins, are suitable to make homo-polymers. Other combinations, such as C4 and C14-LAO; C6 and C16-LAO; C8, C10, C12-LAO; or C8 and C14-LAO; C6, C10, C14-LAO; C4 and C12-LAO, etc. are suitable to make co-polymers.

The activated metallocene catalyst can be simple metallocenes, substituted metallocenes or bridged metallocene catalysts activated or promoted by, for instance, methylaluminoxane (MAO) or a non-coordinating anion, such as N,N-dimethylanilinium tetrakis(perfluorophenyl)borate or other equivalent non-coordinating anion.

According to the invention, a feed comprising a mixture of LAOs selected from C3 to C30 LAOs or a single LAO selected from C3 to C16 LAO, is contacted with an activated metallocene catalyst under oligomerization conditions to provide a liquid product suitable for use in lubricant components or as functional fluids. This invention is also directed to a copolymer composition made from at least two alpha-olefins of C3 to C30 range and having monomers randomly distributed in the polymers. The phrase "at least two alpha-olefins" will be understood to mean "at least two different alpha-olefins" (and similarly "at least three alpha-olefins" means "at least three different alpha-olefins", and so forth).

In preferred embodiments, the average carbon number (defined hereinbelow) of said at least two alpha-olefins in said feed is at least 4.1. In another preferred embodiment, the amount of ethylene and propylene in said feed is less than 50 wt % individually or preferably less than 50 wt % combined. A still more preferred embodiment comprises a feed having both of the aforementioned preferred embodiments, i.e., a feed having an average carbon number of at least 4.1 and wherein the amount of ethylene and propylene is less than 50 wt % individually.

In embodiments, the product obtained is an essentially random liquid copolymer comprising the at least two alpha-olefins. By "essentially random" is meant that one of ordinary skill in the art would consider the products to be random copolymer. Other characterizations of randomness, some of which are preferred or more preferred, are provided herein. Likewise the term "liquid" will be understood by one of ordinary skill in the art, but more preferred characterizations of the term are provided herein. In describing the products as "comprising" a certain number of alpha-olefins (at least two different alpha-olefins), one of ordinary skill in the art in possession of the present disclosure would understand that what is being described in the polymerization (or oligomerization) product incorporating said certain number of alpha-olefin monomers. In other words, it is the product obtained by polymerizing or oligomerizing said certain number of alpha-olefin monomers.

This improved process employs a catalyst system comprising a metallocene compound (Formula 1, below) together with an activator such as a non-coordinating anion (NCA) (Formula 2, below) or methylaluminoxane (MAO) 1111 (Formula 3, below).

Formula 1

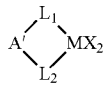

Formula 2

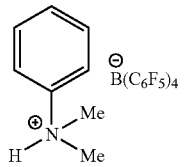

NCA

Formula 3

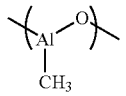

MAO

The term "catalyst system" is defined herein to mean a catalyst precursor/activator pair, such as a metallocene/activator pair. When "catalyst system" is used to describe such a pair before activation, it means the unactivated catalyst (pre-catalyst) together with an activator and, optionally, a co-activator (such as a trialkyl aluminum compound). When it is used to describe such a pair after activation, it means the activated catalyst and the activator or other charge-balancing moiety. Furthermore, this activated "catalyst system" may optionally comprise the co-activator and/or other charge-balancing moiety. Optionally and often, the co-activator, such as trialkylaluminum compound, is also used as impurity scavenger.

The metallocene is selected from one or more compounds according to Formula 1, above. In Formula 1, M is selected from Group 4 transition metals, preferably zirconium (Zr), hafnium (Hf) and titanium (Ti), L1 and L2 are independently selected from cyclopentadienyl ("Cp"), indenyl, and fluorenyl, which may be substituted or unsubstituted, and which may be partially hydrogenated, A is an optional bridging group which if present, in preferred embodiments is selected from dialkylsilyl, dialkylmethyl, diphenylsilyl or diphenylmethyl, ethylenyl (—CH2-CH2-), alkylethylenyl (—CR2-CR2-), where alkyl can be independently C1 to C16 alkyl radical or phenyl, tolyl, xylyl radical and the like, and wherein each of the two X groups, Xa and Xb, are independently selected from halides, OR (R is an alkyl group, preferably selected from C1 to C5 straight or branched chain alkyl groups), hydrogen, C1 to C16 alkyl or aryl groups, haloalkyl, and the like. Usually relatively more highly substituted metallocenes give higher catalyst productivity and wider product viscosity ranges and are thus often more preferred.

In another embodiment, any of the polyalpha-olefins produced herein preferably have a Bromine number of 1.8 or less as measured by ASTMD 1159, preferably 1.7 or less, preferably 1.6 or less, preferably 1.5 or less, preferably 1.4 or less, preferably 1.3 or less, preferably 1.2 or less, preferably 1.1 or less, preferably 1.0 or less, preferably 0.5 or less, preferably 0.1 or less.

In another embodiment, any of the polyalpha-olefins produced herein are hydrogenated and have a Bromine number of 1.8 or less as measured by ASTM D 1159, preferably 1.7 or less, preferably 1.6 or less, preferably 1.5 or less, preferably 1.4 or less, is preferably 1.3 or less, preferably 1.2 or less, preferably 1.1 or less, preferably 1.0 or less, preferably 0.5 or less, preferably 0.1 or less.

In another embodiment, any of the polyalpha-olefins described herein may have monomer units represented by the formula, in addition to the all regular 1,2-connection.

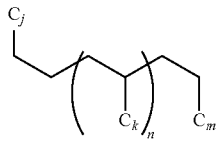

where j, k and in are each, independently, 3, 4, 5, 6, 7, 8, 9, 10, 11, 12, 13, 14, 15, 16, 17, 18, 19, 20, 21, or 22, n is an integer from 1 to 350 (preferably 1 to 300, preferably 5 to 50) as measured by proton NMR.

In another embodiment, any of the polyalpha-olefins described herein preferably have an Mw (weight average molecular weight) of 100,000 or less, preferably between 100 and 80,000, preferably between 250 and 60,000, preferably between 280 and 50,000, preferably between 336 and 40,000 g/mol.

In another embodiment, any of the polyalpha-olefins described herein preferably have an Mn (number average molecular weight) of 50,000 or less, preferably between 200 and 40,000, preferably between 250 and 30,000, preferably between 500 and 20,000 g/mol.

IN another embodiment, any of the polyalpha-olefins described herein preferably have a molecular weight distribution (MWD=Mw/Mn) of greater than 1 and less than 5, preferably less than 4, preferably less than 3, preferably less than 2.5. The MWD of mPAO is always a function of fluid viscosity. Alternately any of the polyalpha-olefins described herein preferably have an Mw/Mn of between 1 and 2.5, alternately between 1 and 3.5, depending on fluid viscosity.

The Mw, Mn and Mz are measured by GPC method using a column for medium to low molecular weight polymers, tetrahydrofuran as solvent and polystyrene as calibration standard, correlated with the fluid viscosity according to a power equation.

In a preferred embodiment of this invention, any PAO described herein may have a pour point of less than 0° C. (as measured by ASTM D 97), preferably less than −10° C., preferably less than −20° C., preferably less than −25° C., preferably less than −30° C., preferably less than −35° C., preferably less than −50°, preferably between −10 and −80° C., preferably between −15° C. and −70° C.

In a preferred embodiment of this invention, any PAO described herein may have a kinematic viscosity (at 40° C. as measured by ASTM D 445) from about 4 to about 50,000 cSt, preferably from about 5 cSt to about 30,000 cSt at 40° C., alternately from about 4 to about 100,000 cSt, preferably from about 6 cSt to about 50,000 cSt, preferably from about 10 cSt to about 30,000 cSt at 40° C.

In another embodiment, any polyalpha-olefin described herein may have a kinematic viscosity at 100° C. from about 1.5 to about 5,000 cSt, preferably from about 2 to about 3,000 cSt, preferably from about 3 cSt to about 1,000 cSt, more preferably from about 4 cSt to about 1,000 cSt, and yet more preferably from about 8 cSt to about 500 cSt as measured by ASTM D445. The PAOs preferably have viscosities in the range of 2 to 500 cSt at 100° C. in one embodiment, and from 2 to 3000 cSt at 100° C. in another embodiment, and from 3.2 to 300 cSt in another embodiment. Alternately, the polyalpha-olefin has a KV100 of less than 150 cSt.

In another embodiment, any polyalpha olefin described herein may have a kinematic viscosity at 100° C. from 3 to 10 cSt and a flash point of 150° C. or more, preferably 200° C. or more (as measured by ASTM D 56).

In another embodiment, any polyalpha olefin described herein may have a dielectric constant of 2.5 or less (1 kHz at 23° C. as determined by ASTM D 924).

In another embodiment, any polyalpha olefin described herein may have a specific gravity of 0.75 to 0.96 g/cm$^3$, preferably 0.80 to 0.94 g/cm$^3$.

In another embodiment, any polyalpha olefin described herein may have a viscosity index (VI) of 100 or more, preferably 120 or more, preferably 130 or more, alternately, form 120 to 450, alternately from 100 to 400, alternately from 120 to 380, alternately from 100 to 300, alternately from 140 to 380, alternately from 180 to 306, alternately from 252 to 306, alternately the viscosity index is at least about 165, alternately at least about 187, alternately at least about 200, alternately at least about 252. For many lower viscosity fluids made from 1-decene or 1-decene equivalent feeds (KV100° C. of 3 to 10 cSt), the preferred VI range is from 100 to 180. Viscosity index is determined according to ASTM Method D 2270-93 [1998].

All kinematic viscosity values reported for fluids herein are measured at 100° C. unless otherwise noted. Dynamic viscosity can then be obtained by multiplying the measured kinematic viscosity by the density of the liquid. The units for kinematic viscosity are in m$^2$/s, commonly converted to cSt or centistokes (1 cSt=10-6 m$^2$/s or 1 cSt=1 mm$^2$/sec).

One embodiment is a new class of poly-alpha-olefins, which have a unique chemical composition characterized by a high degree of linear branches and very regular structures with some unique head-to-head connections at the end position of the polymer chain. The polyalpha-olefins, whether homo-polymers or co-polymers, can be isotactic, syndiotactic or atactic polymers, or have combination of the tacticity. The new poly-alpha-olefins when used by themselves or blended with other fluids have unique lubrication properties.

Another embodiment is a new class of hydrogenated poly-alpha-olefins having a unique composition which is characterized by a high percentage of unique head-to-head connection at the end position of the polymer and by a reduced degree tacticity compared to the product before hydrogenation. The new poly-alpha-olefins when used by itself or blended with another fluid have unique lubrication properties.

This improved process to produce these polymers employs metallocene catalysts together with one or more activators (such as an alumoxane or a non-coordinating anion). The metallocene catalyst can be a bridged or unbridged, substituted or unsubstituted cyclopentadienyl, indenyl or fluorenyl compound. One preferred class of catalysts are highly substituted metallocenes that give high catalyst productivity and higher product viscosity. Another preferred class of metallocenes are bridged and substituted cyclopentadienes. Another preferred class of metallocenes are bridged and substituted indenes or fluorenes. One aspect of the processes described herein also includes treatment of the feed olefins to remove catalyst poisons, such as peroxides, oxygen, sulfur, nitrogen-containing organic compounds, and or acetylenic compounds. This treatment is believed to increase catalyst productivity, typically more than 5 fold, preferably more than 10 fold.

A preferred embodiment is a process to produce a polyalpha-olefin comprising:

1) contacting at least one alpha-olefin monomer having 5 to 24 carbon atoms with a metallocene compound and an activator under polymerization conditions wherein hydrogen, if present, is present at a partial pressure of 200 psi (1379 kPa) or less, based upon the total pressure of the reactor (preferably 150 psi (1034 kPa) or less, preferably 100 psi (690 kPa) or less, preferably 50 psi (345 kPa) or less, preferably 25 psi (173 kPa) or less, preferably 10 psi (69 kPa) or less (alternately the hydrogen, if present in the reactor at 1000 ppm or less by weight, preferably 750 ppm or less, preferably 500 ppm or less, preferably 250 ppm or less, preferably 100 ppm or less, preferably 50 ppm or less, preferably 2.5 ppm or less, preferably 10 ppm or less, preferably 5 ppm or less), and wherein the alpha-olefin monomer having 3 to 24 carbon atoms is present at 10 volume % or more based upon the total volume of the catalyst/activator/co-activator solutions, monomers, and any diluents or solvents present in the reaction; and 2) obtaining a polyalpha-olefin, optionally hydrogenating the PAO, and obtaining a PAO, comprising at least 50 mole % of a C5 to C24 alpha-olefin monomer, wherein the polyalpha-olefin has a kinematic viscosity at 100° C. of 5000 cSt or less, and the polyalpha-olefin comprises Z mole % or more of units represented by the formula:

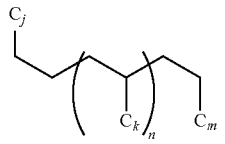

where j, k and m are each, independently, 3, 4, 5, 6, 7, 8, 9, 10, 11, 12, 13, 14, 15, 16, 17, 18, 19, 20, 21, or 22, n is an integer from 1 to 350.

An alternate embodiment is a process to produce a polyalpha-olefin comprising:

contacting a feed stream comprising one or at least one alpha-olefin monomer having 5 to 24 carbon atoms with a metallocene catalyst compound and a non-coordinating anion activator or alkylalumoxane activator, and optionally an alkyl-aluminum compound, under polymerization conditions wherein the alpha-olefin monomer having 5 to 24 carbon atoms is present at 10 volume % or more based upon the total volume of the catalyst/activator/co-activator solution, monomers, and any diluents or solvents present in the reactor and where the feed alpha-olefin, diluent or solvent stream comprises less than 300 ppm of heteroatom containing compounds; and obtaining a polyalpha-olefin comprising at least 50 mole % of a C5 to C24 alpha-olefin monomer where the polyalpha-olefin has a kinematic viscosity at 100° C. of 5000 cSt or less. Preferably, hydrogen, if present is present in the reactor at 1000 ppm or less by weight, preferably 750 ppm or less, preferably 500 ppm or less, preferably 250 ppm or less, preferably 100 ppm or less, preferably 50 ppm or less, preferably 25 ppm or less, preferably 10 ppm or less, preferably 5 ppm or less.

An alternate embodiment is a process to produce a polyalpha-olefin comprising:

1) contacting a feed stream comprising at least one alpha-olefin monomer having 5 to 24 carbon atoms with a metallocene catalyst compound and a non-coordinating anion activator or alkylalumoxane activator, and optionally an alkyl-aluminum compound, under polymerization conditions wherein the alpha-olefin monomer having 5 to 24 carbon atoms is present at 10 volume % or more based upon the total volume of the catalyst/activator/co-activator solution, monomers, and any diluents or solvents present in the reactor and where the feed alpha-olefin, diluent or solvent stream comprises less than 300 ppm of heteroatom containing compounds which; and obtaining a polyalpha-olefin comprising at least 50 mole % of a C5 to C24 alpha-olefin monomer where the polyalpha-olefin has a kinematic viscosity at 100° C. of 5000 cSt or less;

2) isolating the lube fraction polymers and then contacting this lube fraction with hydrogen under typical hydrogenation conditions with hydrogenation catalyst to give fluid with bromine number below 1.8, or alternatively, isolating the lube fraction polymers and then contacting this lube fraction with hydrogen under more severe conditions with hydrogenation catalyst to give fluid with bromine number below 1.8 and with reduce mole % of mm components than the unhydrogenated polymers.

Alternately, in any process described herein hydrogen, if present, is present in the reactor at 1000 ppm or less by weight, preferably 750 ppm or less, preferably 500 ppm or less, preferably 250 ppm or less, preferably 100 ppm or less, preferably 50 ppm or less, preferably 25 ppm or less, preferably 10 ppm or less, preferably 5 ppm or less.

Alternately, in any process described herein hydrogen, if present, is present in the feed at 1000 ppm or less by weight, preferably 750 ppm or less, preferably 500 ppm or less, preferably 250 ppm or less, preferably 100 ppm or less, preferably 50 ppm or less, preferably 25 ppm or less, preferably 10 ppm or less, preferably 5 ppm or less.

Molecular Weight Distribution (MWD)

Molecular weight distribution is a function of viscosity. The higher the viscosity the higher the molecular weight distribution. FIG. 1 is a graph showing the molecular weight distribution as a function of viscosity at Kv100° C. The circles represent the prior art chromium catalyzed PAO. The squares represent the new metallocene catalyzed PAO. Line 1 represents the preferred lower range of molecular weight distribution for the high viscosity metallocene catalyzed PAO. Line 3 represents preferred upper range of the molecular weight distribution for the high viscosity metallocene catalyzed PAO. Therefore, the region bounded by lines 1 and 3 represents the preferred molecular weight distribution region of the new metallocene catalyzed PAO. Line 5 represents molecular weight distribution of the prior art chromium catalyzed PAO.

Equation 1 represents the algorithm for line 5 or the average molecular weight distribution of the chromium catalyzed PAO. Whereas equations 2, 3, and 4 represent lines 3, 1 and 2 respectively.

$$MWD=0.2223+1.0232*\log(Kv \text{ at } 100^\circ \text{ C. in cSt}) \quad \text{Eq. 1}$$

$$MWD=0.41667+0.725*\log(Kv \text{ at } 100^\circ \text{ C. in cSt}) \quad \text{Eq. 2}$$

$$MWD=0.8+0.3*\log(Kv \text{ at } 100^\circ \text{ C. in cSt}) \quad \text{Eq. 3}$$

$$MWD=0.66017+0.44922*\log(Kv \text{ at } 100^\circ \text{ C. in cSt}) \quad \text{Eq. 4}$$

In at least one embodiment, the molecular weight distribution is at least 10 percent less than equation 1. In a preferred embodiment the molecular weight distribution is less than equation 2 and in a most preferred embodiment molecular weight distribution is less than equation 2 and more than equation 4.

Table 1 is a table demonstrating the differences between metallocene catalyzed PAO ("mPAO") and current High viscosity chromium catalyzed PAO (cHVI-PAO). Examples 1 to 8 in the Table 1 were prepared from different feed olefins using metallocene catalysts. The metallocene catalyst system, products, process and feeds were described in U.S. patent application Ser. Nos. 11/995,297 and 11/995,118. The mPAOs samples in Table were made from C10, C6,12, C6 to C18, C6,10,14-LAOs. Examples 1 to 7 samples all have very narrow molecular weight distribution (MWD). The MWD of mPAO depends on fluid to viscosity as shown in FIG. 1.

TABLE 1

| | Example No. | | | | | | | | | | |
|---|---|---|---|---|---|---|---|---|---|---|---|
| | 1 | 2 | 3 | 4 | 5 | 6 | 7 | 8 | 9 | 10 | 11 |
| sample type | mPAO | mPAO | mPAO | mPAO | mPAO | mPAO | mPAO | mPAO | cHVI-PAO | cHVI-PAO | cHVI-PAO |
| Feed LAO | C6/C12 | C6-C18 | C6-C18 | C10 | C6, 10, 14 (25/60/15%) | C6, 10, 14 (25/60/15%) | C10 | C10 | C10 | C10 | C10 |
| 100° C. Kv, cS | 150 | 151 | 540 | 671 | 460 | 794.35 | 1386.83 | 678.1 | 150 | 300 | 1,000 |
| 40° C. Kv, cS | 1701 | 1600 | 6642 | 6900 | 5640 | 10318 | 16362 | 6743 | 1500 | 3100 | 10,000 |
| VI | 199 | 207 | 257 | | 248 | 275 | 321 | 303 | 218 | 241 | 307 |

TABLE 1-continued

| | Example No. | | | | | | | | | | |
|---|---|---|---|---|---|---|---|---|---|---|---|
| | 1 | 2 | 3 | 4 | 5 | 6 | 7 | 8 | 9 | 10 | 11 |
| Pour, ° C. | −33 | −36 | −21 | −18 | nd | nd | | −12 | −33 | −27 | −18 |
| MWD by GPC | | | | | | | | | | | |
| Mw | 7,409 | 8,089 | 17,227 | 19772 | 16149 | 20273 | 31769 | 29333 | 8,974 | 12,511 | 32,200 |
| MWD | 1.79 | 2.01 | 1.90 | 1.98 | 2.35 | 2.18 | 1.914 | 5.50 | 2.39 | 2.54 | 4.79 |
| | % Visc Change by TRB Test (a) | | | | | | | | | | |
| 20 hrs | −0.33 | −0.65 | −2.66 | −3.64 | −4.03 | −8.05 | −19.32 | −29.11 | −7.42 | −18.70 | −46.76 |
| 100 hrs | −0.83 | −0.70 | −1.07 | 1.79 | nd | nd | nd | nd | nd | −21.83 | −51.09 |

(a) CEC L-45-A-99 Taper Roller Bearing/C (20 hours) (KRL test 20 hours) at SouthWest Research Institute When Example 1 to 7 samples were subjected to tapered roller bearing ("TRB") test, they show very low viscosity loss after 20 hours shearing or after extended 100 hours shearing (TRB). Generally, shear stability is a function of fluid viscosity. Lower viscosity fluids have minimal viscosity losses of less than 10%. When fluid viscosity is above 1000 cS, Kv100° C. as in Example 7, the fluid loss is approximately 19% viscosity. Example 8 is a metallocene PAO with MWD of 5.5. This mPAO shows significant amount of viscosity loss 29%.

Examples 9, 10 and 11 are comparative examples. The high viscosity PAO are made by catalysts other than metallocene catalysts. These samples were made according to methods described in U.S. Pat. No. 4,827,064. U.S. Pat. No. 4,827,073 and other patents as further described below. They have broad MWD and therefore poor shear stability in TRB test.

Figure 2:
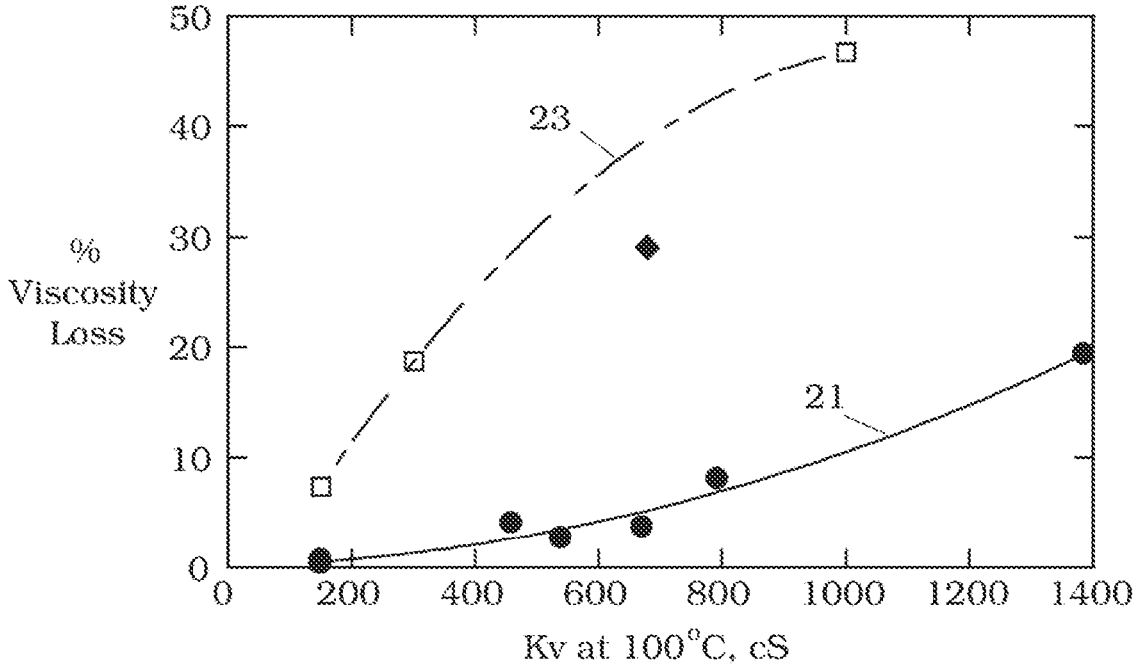
FIG. 2 is a graph illustrating the improved viscosity losses or improved shear stability as a function of the viscosity of the high viscosity metallocene catalyzed PAO base stocks.

The comparison of shear stability as a function of fluid viscosity for mPAO with narrow MWD vs. cHVI-PAO is summarized in FIG. 2. This graph demonstrates that the mPAO profile shown as line 21 has much improved shear stability over wide viscosity range when compared to the cHVI-PAO profile shown as line 23.

These examples demonstrated the importance of MWD effect on shear stability. Accordingly, the higher viscosity base stocks with tighter molecular weight distributions provide favorable shear stability even at high viscosities.

Lubricant Formulation

In one embodiment, the lubricant oil comprises at least two base stock components. The first base stock component comprises one or more base stocks, each with a viscosity of over 40 cSt, Kv100° C. The base stocks in the first base stock component each have a molecular weight distribution less than 10 percent of equation 1. In a preferred embodiment the first base stock component is comprised of metallocene catalyzed PAOs with a viscosity of at least 40, cSt, Kv100° C.

The second base stock component comprises one or more base stocks each with a viscosity of less than 10 cSt, Kv100° C. and preferably less than 6 cSt, Kv100° C. Preferably, the viscosity of the second base stock component should be at least 1.5 cSt, Kv100° C. Even more preferable is a viscosity of between 1.5 and 5 cSt, Kv100° C. In an embodiment, the second base stock component comprises at least one Poly-Alpha-Olefin (PAO) base stock and at least one Group III base stock, each having a viscosity less than 10 cSt, Kv100° C.

Groups I, II, III, IV and V are broad categories of base oil stocks developed and defined by the American Petroleum Institute (API Publication 1509; www.API.org) to create guidelines for lubricant base oils. Group I base stocks generally have a viscosity index of between about 80 to 120 and contain greater than about 0.03% sulfur and/or less than about 90% saturates. Group II base stocks generally have a viscosity index of between about 80 to 120, and contain less than or equal to about 0.03% sulfur and greater than or equal to about 90% saturates. Group III stock generally has a viscosity index greater than about 12.0 and contains less than or equal to about 0.03% sulfur and greater than about 90% saturates. Group IV includes polyalphaoiefins (PAO). Group V base stocks include base stocks not to included in Groups I-IV. Table 4 summarizes properties of each of these five groups.

TABLE 2

| Base Stock Properties | | | |
|---|---|---|---|
| | Saturates | Sulfur | Viscosity Index |
| Group I | <90% and/or | >0.03% and | ≥80 and <120 |
| Group II | ≥90% and | ≤0.03% and | ≥80 and <120 |
| Group III | ≥90% and | ≤0.03% and | ≥120 |
| Group IV | Polyalphaolefins (PAO) | | |
| Group V | All other base oil stocks not included in Groups I, II, III, or IV | | |

In a preferred embodiment, the base stocks include at least one base stock of synthetic oils and most preferably include at least one base stock of API group IV Poly Alpha Olefins. Synthetic oil for purposes of this application shall include all oils that are not naturally occurring mineral oils. Naturally occurring mineral oils are often referred to as API Group I oils.

A new type of PAO lubricant was introduced by U.S. Pat. Nos. 4,827,064 and 4,827,073 (Wu). These PAO materials, which are produced by the use of a reduced valence state chromium catalyst, are olefin oligomers or polymers which are characterized by very high viscosity indices which give them very desirable properties to be useful as lubricant basestocks and, with higher viscosity grades; as VI improvers. They are referred to as High Viscosity Index PAOs or HVI-PAOs. The relatively low molecular weight high viscosity PAO materials were found to be useful as lubricant basestocks whereas the higher viscosity PAOs, typically with viscosities of 100 cSt or more, e.g. in the range of 100 to 1,000 cSt, were found to be very effective as viscosity index improvers for conventional PAOs and other synthetic and mineral oil derived basestocks.

Various modifications and variations of these high viscosity PAO materials are also described in the following U.S. patents to which reference is made: U.S. Pat. Nos. 4,990,709; 5,254,274; 5,132,478; 4,912,272; 5,264,642; 5,243,114; 5,208,403; 5,057,235; 5,104,579; 4,943,383; 4,906,799. These oligomers can be briefly summarized as being produced by the oligomerization of 1-olefins in the presence of a metal oligomerization catalyst which is a supported metal in a reduced valence state. The preferred catalyst comprises a reduced valence state chromium on a silica support, prepared by the reduction of chromium using carbon monoxide as the reducing agent. The oligomerization is carried out at a temperature selected according to the viscosity desired for the resulting oligomer, as described in U.S. Pat. Nos. 4,827,064 and 4,827,073. Higher viscosity materials may be produced as described in U.S. Pat. Nos. 5,012,020 and 5,146,021 where oligomerization temperatures below about 90° C. are used to produce the higher molecular weight oligomers. In all cases, the oligomers, after hydrogenation when necessary to reduce residual unsaturation, have a branching index (as defined in U.S. Pat. Nos. 4,827,064 and 4,827,073) of less than 0.19. Overall, the HVI-PAO normally have a viscosity in the range of about 12 to 5,000 cSt.

Furthermore, the HVI-PAOs generally can be characterized by one or more of the following: C30-C1300 hydrocarbons having a branch ratio of less than 0.19, a weight average molecular weight of between 300 and 45,000, a number average molecular weight of between 300 and 18,000, a molecular weight distribution of between 1 and 5. Particularly preferred HVI-PAOs are fluids with 100° C. viscosity ranging from 5 to 5000 cSt. In another embodiment, viscosities of the HVI-PAO oligomers measured at 100° C. range from 3 centistokes ("cSt") to 15,000 cSt. Furthermore, the fluids with viscosity at 100° C. of 3 cSt to 5000 cSt have VI calculated by ASTM method D2270 greater than 130. Usually they range from 130 to 350. The fluids all have low pour points, below −15° C.

The HVI-PAOs can further be characterized as hydrocarbon compositions comprising the polymers or oligomers made from 1-alkenes, either by itself or in a mixture form, taken from the group consisting of C6-C20 1-alkenes. Examples of the feeds can be 1-hexene, 1-octene, 1-decene, 1-dodecene, 1-tetradecene, etc. or mixture of C6 to C14 1-alkenes or mixture of C6 to C20 1-alkenes, C6 and C12 1-alkenes, C6 and C14 1-alkenes, C6 and C16 1-alkenes, C6 and C18 1-alkenes, C8 and C10 1-alkenes, C8 and C12 1-alkenes, C8, C10 and C 12 1-alkenes, and other appropriate combinations.

The lube products usually are distilled to remove any low molecular weight compositions such as these boiling below 600° F., or with carbon number less than C20, if they are produced from the polymerization reaction or are carried over from the starting material. This distillation step usually improves the volatility of the finished fluids. In certain special applications, or when no low boiling fraction is present in the reaction mixture, this distillation is not necessary. Thus the whole reaction product after removing any solvent or starting material can be used as lube base stock or for the further treatments.

The lube fluids made directly from the polymerization or oligomerization process usually have unsaturated double bonds or have olefinic molecular structure. The amount of double bonds or unsaturation or olefinic components can be measured by several methods, such as bromine number (ASTM 1159), bromine index (ASTM D271.0) or other suitable analytical methods, such as NMR, IR, etc. The amount of the double bond or the amount of olefinic compositions depends on several factors—the degree of polymerization, the amount of hydrogen present during the polymerization process and the amount of other promoters which participate in the termination steps of the polymerization process, or other agents present in the process. Usually, the amount of double bonds or the amount of olefinic components is decreased by the higher degree of polymerization, the higher amount of hydrogen gas present in the polymerization process, or the higher amount of promoters participating in the termination steps.

It was known that, usually, the oxidative stability and light or UV stability of fluids improves when the amount of unsaturation double bonds or olefinic contents is reduced. Therefore it is necessary to further hydrotreat the polymer if they have high degree of unsaturation. Usually, the fluids with bromine number of less than 5, as measured by ASTM D1159, is suitable for high quality base stock application. Of course, the lower the bromine number, the better the lube quality. Fluids with bromine number of less than 3 or 2 are common. The most preferred range is less than 1 or less than 0.1. The method to hydrotreat to reduce the degree of unsaturation is well known in literature [U.S. Pat. No. 4,827,073, example 16). In some HVI-PAO products, the fluids made directly from the polymerization already have very low degree of unsaturation, such as those with viscosities greater than 150 cSt at 100° C. They have bromine numbers less than 5 or even below 2. In these cases, we can chose to use as is without hydrotreating, or we can choose to hydrotreating to further improve the base stock properties.

Base stocks having a high paraffinic/naphthenic and saturation nature of greater than 90 weight percent can often be used advantageously in certain embodiments. Such base stocks include Group II and/or Group III hydroprocessed or hydrocracked base stocks, or their synthetic counterparts such as polyalphaolefin oils, GTL or similar base oils or mixtures of is similar base oils.

A more specific example embodiment, is the combination of high viscosity metallocene catalyzed PAO having a molecular weight distribution (MWD) as a function of viscosity at least 10 percent less than the algorithm: MWD=0.2223+1.0232*log (Kv at 100° C. in cSt) with a low viscosity Poly Alpha Olefin ("PAO") including PAOs with a viscosity of less than 6 cSt, Kv100° C. and more preferably with a viscosity between 2 and 4 (2 cSt or 4 cSt, Kv100° C.) and even more preferably with a small amount of esters or alkylated aromatics. The esters including esters or alkylated aromatics can be used as an additional base stock or as a co-base stock with either the first and second base stocks for additive solubility. The preferred ester is an alkyl adipate.

Gas to liquid (GTL) base stocks can also be preferentially used with the components of this invention as a portion or all of the base stocks used to formulate the finished lubricant. We have discovered, favorable improvement when the components of this invention are added to lubricating systems comprising primarily Group II, Group III and/or GTL base stocks compared to lesser quantities of alternate fluids.

GTL materials are materials that are derived via one or more synthesis, combination, transformation, rearrangement, and/or degradation/deconstructive processes from gaseous carbon-containing compounds, hydrogen-containing compounds, and/or elements as feedstocks such as hydrogen, carbon dioxide, carbon monoxide, water, methane, ethane, ethylene, acetylene, propane, propylene, propyne, butane, butylenes, and butynes. GTL base stocks and base oils are GTL materials of lubricating viscosity that are generally derived from hydrocarbons, for example waxy synthesized hydrocarbons, that are themselves derived from simpler gaseous carbon-containing compounds, hydrogen-containing compounds and/or elements as feedstocks. GTL base stock(s) include oils boiling in the lube oil boiling range separated/fractionated from GTL materials such as by, for example, distillation or thermal diffusion, and subsequently subjected to web-known catalytic or solvent dewaxing processes to produce lube oils of reduced/low pour point; wax isomerates, comprising, for example, hydroisomerized or isodewaxed synthesized hydrocarbons; hydro-isomerized or isodewaxed Fischer-Tropsch ("F-T") material (i.e., hydrocarbons, waxy hydrocarbons, waxes and possible analogous oxygenates); preferably hydroisomerized or isodewaxed F-T hydrocarbons or hydroisomerized or isodewaxed F-T waxes, hydroisomerized or isodewaxed synthesized waxes, or mixtures thereof.

GTL base stock(s) derived from GTL materials, especially, hydroisomerized/isodewaxed F-T material derived base stock(s), and other hydroisomerized/isodewaxed wax derived base stock(s) are characterized typically as having kinematic viscosities at 100° C. of from about 2 $mm^2/s$ to about 50 $mm^2/s$, preferably from about 3 $mm^2/s$ to about 50 $mm^2/s$, more preferably from about 3.5 $mm^2/s$ to about 30 $mm^2/s$, as exemplified by a GTL base stock derived by the isodewaxing of F-T wax, which has a kinematic viscosity of about 4 $mm^2/s$ at 100° C. and a viscosity index of about 130 or greater. The term GTL base oil/base stock and/or wax isomerate base oil/base stock as used herein and in the claims is to be understood as embracing individual fractions of GTL base stock/base oil or wax isomerate base stock/base oil as recovered in the production process, mixtures of two or more GTL base stocks/base oil fractions and/or wax isomerate base stocks/base oil fractions, as well as mixtures of one or two or more low viscosity GTL base stock(s)/base oil fraction(s) and/or wax isomerate base stock(s)/base oil fraction(s) with one, two or more high viscosity GTL base stock(s)/base oil fraction(s) and/or wax isomerate base stock(s)/base oil fraction(s) to produce a bi-modal blend wherein the blend exhibits a viscosity within the aforesaid recited range. Reference herein to Kinematic Viscosity refers to a measurement made by ASTM method D445.

GTL base stocks and base oils derived from GTL materials, especially hydroisomerized/isodewaxed F-T material derived base stock(s), and other hydroisomerized/isodewaxed wax-derived base stock(s), such as wax hydroisomerates/isodewaxates, which can be used as base stock components of this invention to are further characterized typically as having pour points of about −5° C. or lower, preferably about −10° C. or lower, more preferably about −15° C. or lower, still more preferably about −20° C. or lower, and under some conditions may have advantageous pour points of about −25° C. or lower, with useful pour points of about −30° C. to about −40° C. or lower, if necessary, a separate dewaxing step may be practiced to achieve the desired pour point. References herein to pour point refer to measurement made by ASTM D97 and similar automated versions.

The GTL base stock(s) derived from GTL materials, especially hydroisomerized/isodewaxed F-T material derived base stock(s), and other hydroisomerized/isodewaxed wax-derived base stock(s) which are base stock components which can be used in this invention are also characterized typically as having viscosity indices of 80 or greater, preferably 100 or greater, and more preferably 120 or greater. Additionally, in certain particular instances, viscosity index of these base stocks may be preferably 130 or greater, more preferably 135 or greater, and even more preferably 140 or greater. For example, GTL base stock(s) that derive from GTL materials preferably F-T materials especially F-T wax generally have a viscosity index of 130 or greater. References herein to viscosity index refer to ASTM method D2270.

in addition, the GTL base stock(s) are typically highly paraffinic of greater than 90 percent saturates) and may contain mixtures of monocycloparaffins and multicycloparaffins in combination with non-cyclic isoparaffins. The ratio of the naphthenic (i.e., cycloparaffin) content in such combinations varies with the catalyst and temperature used. Further, GTL base stocks and base oils typically have very low sulfur and nitrogen content, generally containing less than about 10 ppm, and more typically less than about 5 ppm of each of these elements. The sulfur and nitrogen content of GTL base stock and base oil obtained by the hydroisomerization/isodewaxing of F-T material, especially F-T wax is essentially nil.

In a preferred embodiment, the GTL base stock(s) comprises paraffinic materials that consist predominantly of non-cyclic isoparaffins and only minor amounts of cycloparaffins. These GTL base stock(s) typically comprise paraffinic materials that consist of greater than 60 wt % non-cyclic isoparaffins, preferably greater than 80 wt % non-cyclic isoparaffins, more preferably greater than 85 wt % non-cyclic isoparaffins, and most to preferably greater than 90 wt % non-cyclic isoparaffins.

Useful compositions of GTL base stock(s), hydroisomerized or isodewaxed F-T material derived base stock(s), and wax-derived hydroisomerized/isodewaxed base stock(s), such as wax isomerates/isodewaxates, are recited in U.S. Pat. Nos. 6,080,301; 6,090,989, and 6,165,949 for example.

The final lubricant should comprise a first base stock component having a viscosity of greater than 40 cSt, Kv100° C. The final lubricant should comprise at least 5 wt % and no more than 75 wt % of the first base stock component. Preferred range is 10 wt % to 65 wt %, or 20 wt % to 60 wt %. The final lubricant should comprise a second base stock component having a viscosity of less than 10 cSt. The final lubricant should comprise at least 10 wt % and no more than 90 wt % of the second base stock component.

In various embodiments, it will be understood that additives well known as functional fluid additives in the art, can also be incorporated in the functional fluid composition of the invention, in relatively small amounts, if desired; frequently, less than about 0.001% up to about 10-20% or more. Commercially available automobile gear oil additive packages may contain a high performance series of additive components, including extreme pressure (EP) additives, antiwear additives, dispersants, detergents, antioxidants, corrosion inhibitors and friction reducers. In addition, defoamants and/or demulsifiers may be used Persons skilled in the art will recognize various additives that can be chosen to achieve favorable properties including favorable properties for automotive gear oils.

In one embodiment, at least one oil additive is added from the group consisting of extreme pressure (EP) additives, antiwear additives, dispersants, detergents, antioxidants, corrosion inhibitors and friction reducers. The additives listed below are non-limiting examples and are not intended to limit the claims.

Dispersants should contain the alkenyl or alkyl group R has an Mn value of about 500 to about 5000 and an Mw/Mn ratio of about 1 to about 5. The preferred Mn intervals depend on the chemical nature of the agent improving filterability. Polyolefinic polymers suitable for the reaction with maleic anhydride or other acid materials or acid forming materials, include polymers containing a predominant quantity of C.sub.2 to C.sub.5 monoolefins, for example, ethylene, propylene, butylene, isobutylene and pentene. A highly suitable polyolefinic polymer is polyisobutene. The succinic anhydride preferred as a reaction substance is PIBSA, that is, polyisobutenyl succinic anhydride.

If the dispersant contains a succinimide comprising the reaction product of a succinic anhydride with a polyamine, the alkenyl or alkyl substituent of the succinic anhydride serving as the reaction substance consists preferably of polymerised isobutene having an Mn value of about 1200 to about 2500. More advantageously, the alkenyl or alkyl substituent of the succinic anhydride serving as the reaction substance consists in a polymerised isobutene having an Mn value of about 2100 to about 2400. If the agent improving filterability contains an ester of succinic acid comprising the reaction product of a succinic anhydride and an aliphatic polyhydric alcohol, the alkenyl or alkyl substituent of the succinic anhydride serving as the reaction substance consists advantageously of a polymerised isobutene having an Mn value of 500 to 1500. In preference, a polymerised isobutene having an Mn value of 850 to 1200 is used.

Amides are suitable for use in antiwear agents, extreme pressure additives, friction modifiers or Dispersants. The amides which are utilized in the compositions of the present invention may be amides of mono- or polycarboxylic acids or reactive derivatives thereof. The amides may be characterized by a hydrocarbyl group containing from about 6 to about 90 carbon atoms; each is independently hydrogen or a hydrocarbyl, aminohydrocarbyl, hydroxyhydrocarbyl or a heterocyclic-substituted hydrocarbyl group, provided that both are not hydrogen; each is, independently, a hydrocarbylene group containing up to about 10 carbon atoms; Alk is an alkylene group containing up to about 10 carbon atoms.

The amide can be derived from a monocarboxylic acid, a hydrocarbyl group containing from 6 to about 30 or 38 carbon atoms and more often will be a hydrocarbyl group derived from a fatty acid containing from 12 to about 24 carbon atoms.

The amide is derived from a di- or tricarboxylic acid, will contain from 6 to about 90 or more carbon atoms depending on the type of polycarboxylic acid. For example, when the amide is derived from a dimer acid, will contain from about 18 to about 44 carbon atoms or more, and amides derived from trimer acids generally will contain an average of from about 44 to about 90 carbon atoms. Each is independently hydrogen or a hydrocarbyl, aminohydrocarbyl, hydroxyhydrocarbyl or a heterocyclic-substituted hydrocarbon group containing up to about 10 carbon atoms. It may be independently heterocyclic substituted hydrocarbyl groups wherein the heterocyclic substituent is derived from pyrrole, pyrroline, pyrrolidine, morpholine, piperazine, piperidine, pyridine, pipecoline, etc. Specific examples include methyl, ethyl, n-propyl, n-butyl, n-hexyl, hydroxymethyl, hydroxyethyl, hydroxypropyl, amino-methyl, aminoethyl, aminopropyl, 2-ethylpyridine, 1-ethylpyrrolidine, 1-ethylpiperidine, etc.

The alkyl group can be an alkylene group containing from 1 to about 10 carbon atoms. Examples of such alkylene groups include, methylene, ethylene, propylene, etc. Also are hydrocarbylene groups, and in particular, alkylene group containing up to about 10 carbon atoms. Examples of such hydrocarbylene groups include, methylene, ethylene, propylene, etc. The amide contains at least one morpholinyl group. In one embodiment, the morpholine structure is formed as a result of the condensation of two hydroxy groups which are attached to the hydrocarbylene groups. Typically, the amides are prepared by reacting a carboxylic acid or reactive derivative thereof with an amine which contains at least one >NH group.

Aliphatic monoamines include mono-aliphatic and di-aliphatic-substituted amines wherein the aliphatic groups may be saturated or unsaturated and straight chain or branched chain. Such amines include, for example, mono- and di-alkyl-substituted amines, mono- and dialkenyl-substituted amines, etc. Specific examples of such monoamines include ethyl amine, diethyl amine, n-butyl amine, di-n-butyl amine, isobutyl amine, coco amine, stearyl amine, oleyl amine, etc. An example of a cycloaliphatic-substituted aliphatic amine is 2-(cyclohexyl)-ethyl amine. Examples of heterocyclic-substituted aliphatic amities include 2-(2-aminoethyl)-pyrrole, 2-(2-aminoethyl)-1-methyl pyrrole, 2-(2-aminoethyl)-1-methylpyrrolidine and 4-(2-aminoethyl)morpholine, 1-(2-aminoethyl)piperazine, 1-(2-aminoethyl)piperidine, 2-(2-aminoethyl)pyridine, 1-(2-aminoethyl)pyrrolidine, 1-(3-aminopropyl)imidazole, 3-(2-aminopropyl)indole, 4-(3-aminopropyl)morpholine, 1-(3-aminopropyl)-2-pipecoline, 1-(3-aminopropyl)-2-pyrrolidinone, etc.

Cycloaliphatic monoamines are those monoamines wherein there is one cycloaliphatic substituent attached directly to the amino nitrogen through a carbon atom in the cyclic ring structure. Examples of cycloaliphatic monoamines include cyclohexylamines, cyclopentylamines, cyclohexenylamines, cyclopentenylamines, N-ethyl-cyclohexylamine, dicyclohexylamines, and the like. Examples of aliphatic-substituted, aromatic-substituted, and heterocyclic-substituted cycloaliphatic monoamines include propyl-substituted cyclohexyl-amines, phenyl-substituted cyclopentylamines, and pyranyl-substituted cyclohexylamine.

Aromatic amines include those monoamines wherein a carbon atom of the aromatic ring structure is attached directly to the amino nitrogen. The aromatic ring will usually be a mononuclear aromatic ring (i.e., one derived from benzene) but can include fused aromatic rings, especially those derived from naphthalene. Examples of aromatic monoamines include aniline, di-(para-methylphenyl)amine, naphthylamine, N-(n-butyl)-aniline, and the like. Examples of aliphatic-substituted, cycloaliphatic-substituted, and heterocyclic-substituted aromatic monoamines are para-ethoxyaniline, para-dodecylaniline, cyclohexyl-substituted naphthylamine, variously substituted phenathiazines, and thienyl-substituted aniline.

Polyamines are aliphatic, cycloaliphatic and aromatic polyamines analogous to the above-described monoamines except for the presence within their structure of additional amino nitrogens. The additional amino nitrogens can be primary, secondary or tertiary amino nitrogens. Examples of such polyamines include N-amino-propyl-cyclohexylamines, N,N'-di-n-butyl-paraphenylene diamine, bis-(para-aminophenyl)methane, 1,4-diaminocyclohexane, and the like.

The hydroxy-substituted amines contemplated are those having hydroxy substituents bonded directly to a carbon atom other than a carbonyl carbon atom; that is, they have hydroxy groups capable of functioning as alcohols. Examples of such hydroxy substituted amines include ethanolamine, di-(3-hydroxypropyl)-amine, 3-hydroxybutyl-amine, 4-hydroxybutyl-amine, diethanolamine, di-(2-hydroxyamine, N-(hydroxypropyl)-propylamine, N-(2-methyl)-cyclohexylamine, 3-hydroxycyclopentyl parahydroxyaniline, N-hydroxyethal piperazine and the like.

In one embodiment, the amines useful in the present invention are alkylene polyamines including hydrogen, or a hydrocarbyl, amino hydrocarbyl, hydroxyhydrocarbyl or heterocyclic-substituted hydrocarbyl group containing up to about 10 carbon atoms, Alk is an alkylene group containing up to about 10 carbon atoms, and is 2 to about 10. Preferably, Alk is ethylene or propylene. Usually, a will have an average value of from 2 to about 7. Examples of such alkylene polyamines include methylene polyamines, ethylene polyamines, butylene polyamines, propylene polyamines, pentylene polyamines, hexylene polyamines, heptylene polyamines, etc.

Alkylene polyamines include ethylene diamine, triethylene tetramine, propylene diamine, trimethylene diamine, hexamethylene diamine, decamethylene diamine, hexamethylene diamine, decamethylene diamine, octamethylene diamine, di(heptamethylene)triamine, tripropylene tetramine, tetraethylene pentamine, trimethylene diamine, pentaethylene hexamine, di(trimethylene)triamine, and the like. Higher homologs as are obtained by condensing two or more of the above-illustrated alkylene amines are useful, as are mixtures of two or more of any of the afore-described polyamines.

Ethylene polyamines, such as those mentioned above, are especially useful for reasons of cost and effectiveness. Such polyamines are described in detail under the heading "Diamines and Higher Amines" in The Encyclopedia of Chemical Technology, Second Edition, Kirk and Othmer, Volume 7, pages 27-39, Interscience Publishers, Division of John Wiley and Sons, 1965, which is hereby incorporated by reference for the disclosure of useful polyamines. Such compounds are prepared most conveniently by the reaction of an alkylene chloride with ammonia or by reaction of an ethylene imine with a ring-opening reagent such as ammonia, etc. These reactions result in the production of the somewhat complex mixtures of alkylene polyamines, including cyclic condensation products such as piperazines.

Other useful types of polyamine mixtures are those resulting from stripping of the above-described polyamine mixtures. In this instance, lower molecular weight polyamines and volatile contaminants are removed from an alkylene polyamine mixture to leave as residue what is often termed "polyamine bottoms". In general, alkylene polyamine bottoms can be characterized as having less than 2, usually less than 1% (by weight) material boiling below about 200.degree. C. In the instance of ethylene polyamine bottoms, which are readily available and found to be quite useful, the bottoms contain less than about 2% (by weight) total diethylene triamine (DETA) or triethylene tetramine (TETA). A typical sample of such ethylene polyamine bottoms obtained from the Dow Chemical Company of Freeport, Tex. designated "E-100". Gas chromatography analysis of such a sample showed it to contain about 0.93% "Light Ends" (most probably DETA), 0.72% TETA, 21.74% tetraethylene pentamine and 76.61% pentaethylene hexamine and higher (by weight). These alkylene polyamine bottoms include cyclic condensation products such as piperazine and higher analogs of diethylene triamine, triethylene tetramine and the like.

The dispersants are selected from:

Mannich bases that are condensation reaction products of a high molecular weight phenol, an alkylene polyamine and an aldehyde such as formaldehyde, Succinic-based dispersants that are reaction products of a olefin polymer and succinic acylating agent (acid, anhydride, ester or halide) further reacted with an organic hydroxy compound and/or an amine. High molecular weight amides and esters such as reaction products of a hydrocarbyl acylating agent and a polyhydric aliphatic alcohol (such as glycerol, pentaerythritol or sorbitol). Ashless (metal-free) polymeric materials that usually contain an oil soluble high molecular weight backbone linked to a polar functional group that associates with particles to be dispersed are typically used as dispersants. Zinc acetate capped, also any treated dispersant, which include borated, cyclic carbonate, end-capped, polyalkylene maleic anhydride and the like; mixtures of some of the above, in treat rates that range from about 0.1% up to 10-20% or more. Commonly used hydrocarbon backbone materials are Olefin polymers and copolymers, i.e.—ethylene, propylene, butylene, isobutylene, styrene; there may or may not be further functional groups incorporated into the backbone of the polymer, whose molecular weight ranges from 300 tp to 5000. Polar materials such as amines, alcohols, amides or esters are attached to the backbone via a bridge. Antioxidants include sterically hindered alkyl phenols such as 2,6-di-tert-butylphenol, 2,6-di-tert-butyl-p-cresol and 2,6-di-tert-butyl-4-(2-octyl-3-propanoic) phenol; N,N-di(alkylphenyl)amines; and alkylated phenylene-diamines.

The antioxidant component may be a hindered phenolic antioxidant such as butylated hydroxytoluene, suitably present in an amount of 0.01 to 5%, preferably 0.4 to 0.8%, by weight of the lubricant composition. Alternatively, or in addition, component b) may comprise an aromatic amine antioxidant such as mono-octylphenylalphanapthylamine or p,p-dioctyldiphenylamine, used singly or in admixture. The amine anti-oxidant component is suitably present in a range of from 0.01 to 5% by weight of the lubricant composition, more preferably 0.5 to 1.5%.

A sulfur-containing antioxidant may be any and every antioxidant containing sulfur, for example, including dialkyl thiodipropionates such as dilauryl thiodipropionate and distearyl thiodipropionate, dialkyldithiocarbamic acid derivatives (excluding metal salts), bis(3,5-di-t-butyl-4-hydroxybenzyl)sulfide, mercaptobenzothiazole, reaction products of phosphorus pentoxide and olefins, and dicetyl sulfide. Of these, preferred are dialkyl thiodipropionates such as dilauryl thiodipropionate and distearyl thiodipropionate. The amine-type antioxidant includes, for example, monoalkyldiphenylamines such as monooctyldiphenylamine and monononyldiphenylamine; dialkyldiphenylamines such as 4,4'-dibutyldiphenylamine, 4,4'-dipentyldiphenylamine, 4,4'-dihexyldiphenylamine, 4,4'-diheptyldiphenylamine, 4,4'-dioctyldiphenylamine and 4,4'-dinonyldiphenylamine; polyalkyldiphenylamines such as tetrabutyldiphenylamine, tetrahexyldiphenylamine, tetraoctyldiphenylamine and tetranonyldiphenylamine; and naphthylamines such as .alpha.-naphthylamine, phenyl-.alpha.-naphthylamine, butylphenyl-.alpha.-naphthylamine, pentylphenyl-.alpha.-naphthylamine, hexylphenyl-.alpha.-naphthylamine, heptylphenyl-.alpha.-naphthylamine, octylphenyl-.alpha.-naphthylamine and nonylphenyl-.alpha.-naphthylamine. Of these, preferred are dialkyldiphenylamines. The sulfur-containing antioxidant and the amine-type antioxidant are added to the base oil in an amount of from 0.01 to 5% by weight, preferably from 0.03 to 3% by weight, relative to the total weight of the composition.

The oxidation inhibitors that are particularly useful in lube compositions of the invention are the hindered phenols (e.g., 2,6-di-(t-butyl)phenol); aromatic amines (e.g., alkylated diphenyl amines); alkyl polysulfides; selenides; borates (e.g., epoxide/boric acid reaction products); phosphorodithioic acids, esters and/or salts; and the dithiocarbamate (e.g., zinc dithiocarbamates). These oxidation inhibitors as well as the oxidation inhibitors discussed above the preferably of the invention at levels of about 0.05% to about 5%, more preferably about 0.25 to about 2% by weight based on the total weight of such compositions; with ratios of amine/phenolic to be from 1:10 to 10:1 of the mixtures preferred.

The oxidation inhibitors that are also useful in lube compositions of the invention are chlorinated aliphatic hydrocarbons such as chlorinated wax; organic sulfides and polysulfides such as benzyl disulfide, bis(chlorobenzyl)disulfide, dibutyl tetrasulfide, sulfurized methyl ester of oleic acid, sulfurized alkylphenol, sulfurized dipentene, and sulfurized terpene; phosphosulfurized hydrocarbons such as the reaction product of a phosphorus sulfide with turpentine or methyl oleate, phosphorus esters including principally dihydrocarbon and trihydrocarbon phosphites such as dibutyl phosphite, diheptyl phosphite, dicyclohexyl phosphite, pentylphenyl phosphite, dipentylphenyl phosphite, tridecyl phosphite, distearyl phosphite, dimethyl naphthyl phosphite, oleyl 4-pentylphenyl phosphite, polypropylene (molecular weight 500)-substituted phenyl phosphite, diisobutyl-substituted phenyl phosphite; metal thiocarbamates, such as zinc dioctyldithiocarbamate, and barium heptylphenyl dithiocarbamate; Group II metal phosphorodithioates such as zinc dicyclohexylphosphorodithioate, zinc dioctylphosphorodithioate, barium di(heptylphenyl)(phosphorodithioate, cadmium dinonylphosphorodithioate, and the reaction of phosphorus pentasulfide with an equimolar mixture of isopropyl alcohol, 4-methyl-2-pentanol, and n-hexyl alcohol.

Oxidation inhibitors, organic compounds containing sulfur, nitrogen, phosphorus and some alkylphenols are also employed. Two general types of oxidation inhibitors are those that react with the initiators, peroxy radicals, and hydroperoxides to form inactive compounds, and those that decompose these materials to form less active compounds. Examples are hindered (alkylated) phenols, e.g. 6-di(tert-butyl)-4-methylphenol[2,6-di(tert-butyl)-p-cresol, DBPC], and aromatic amines, e.g. N-phenyl-.alpha.-naphthalamine. These are used in turbine, circulation, and hydraulic oils that are intended for extended service.

Examples of amine-based antioxidants include dialkyldiphenylamines such as p,p'-dioctyldiphenylamine (manufactured by the Seiko Kagaku Co. under the trade designation "Nonflex OD-3"), p,p'-di-.alpha.-methylbenzyl-diphenylamine and N-p-butylphenyl-N-p'-octylphenylamine; monoalkyldiphenylamines such as mono-t-butyldiphenylamine, and monooctyldiphenylamine; bis(dialkylphenyl) amines such as di(2,4-diethylphenypamine and di(2-ethyl-4-nonylphenyl)amine; alkylphenyl-1-naphthyl amines such as octylphenyl-1-naphthylamine and N-t-dodecylphenyl-1-naphthylamine; arylnaphthylamines such as 1-naphthylamine, phenyl-1-naphthylamine, phenyl-2-naphthylamine, N-hexylphenyl-2-naphthylamine and N-octylphenyl-2-naphthylamine, phenylenediamines such as N,N-diisopropyl-p-phenylenediamine and N,N'-diphenyl-p-phenylenediamine, and phenothiazines such as phenothiazine (manufactured by the Hodogaya Kagaku Co.: Phenothiazine) and 3,7-dioctylphenothiazine.

Examples of sulphur-based antioxidants include dialkylsulphides such as didodecylsulphide and dioctadecylsulphide; thiodipropionic acid esters such as didodecyl thiodipropionate, dioctadecyl thiodipropionate, dimyristyl thiodipropionate and dodecyloctadecyl thiodipropionate, and 2-mercaptobenzimidazole.

Examples of phenol-based antioxidants include 2-t-butylphenol, 2-t-butyl-4-methylphenol, 2-t-butyl-5-methylphenol, 2,4-di-t-butylphenol, 2,4-dimethyl-6-t-butylphenol, 2-t-butyl-4-methoxyphenol, 3-t-butyl-4-methoxyphenol, 2,5-di-t-butylhydroquinone (manufactured by the Kawaguchi Kagaku Co. under trade designation "Antage DBH"), 2,6-di-t-butylphenol and 2,6-di-t-butyl-4-alkylphenols such as 2,6-di-t-butyl-4-methylphenol and 2,6-di-t-butyl-4-ethylphenol; 2,6-di-t-butyl-4-alkoxyphenols such as 2,6-di-t-butyl-4-methoxyphenol and 2,6-di-t-butyl-4-ethoxyphenol, 3,5-di-t-butyl-4-hydroxybenzylmercaptoocty-1 acetate, alkyl-3-(3,5-di-t-butyl-4-hydroxyphenyl)propionates such as n-octyl-3-(3,5-di-t-butyl-4-hydroxyphenyl)propionate (manufactured by the Yoshitomi Seiyaku Co. under the trade designation "Yonox SS"), n-dodecyl-3-(3,5-di-t-butyl-4-hydroxyphenyl) propionate and 2'-ethylhexyl-3-(3,5-di-t-butyl-4-hydroxyphenyl)propionate; 2,6-di-t-butyl-.alpha.-dimethylamino-p-cresol, 2,2'-methylenebis(4-alkyl-6-t-butylphenol) compounds such as 2,2'-methylenebis(4-methyl-6-t-butylphe-nol) (manufactured by the Kawaguchi Kagaku Co. under the trade designation "Antage W-400") and 2,2'-methylenebis(4-ethyl-6-t-butylphenol) (manufactured by the Kawaguchi Kagaku Co. under the trade designation "Antage W-500"); bisphenols such as 4,4'-butylidenebis(3-methyl-6-t-butyl-phenol) (manufactured by the Kawaguchi Kagaku Co. under the trade designation "Antage W-300"), 4,4'-methylenebis(2,6-di-t-butylphenol) (manufactured by Laporte Performance Chemicals under the trade designation "Ionox 220AH"), butylphenol), 2,2-(di-p-hydroxyphenyl)propane (Bisphenol A), 2,2-bis(3,5-di-t-butyl-4-hydroxyphenyl)propane, 4,4'-cyclohexylidenebis(2,6-di-t-butylphenol), hexamethylene glycol bis[3, (3,5-di-t-butyl-4-hydroxyphenyl)propionate] (manufactured by the Ciba Speciality Chemicals Co. under the trade designation "Irganox L109"), triethylene glycol bis[3-(3-t-butyl-4-hydroxy-y-5-methylphenyl)propionate] (manufactured by the Yoshitomi Seiyaku Co. under the trade designation "Tominox 917"), 2,2'-thio[diethyl-3-(3,5-di-t-butyl-4-hydroxyphenyl)propionate] (manufactured by the Ciba Speciality Chemicals Co. under the trade designation "Irganox L115"), 3,9-his {1,1-dimethyl-2-[3-(3-t-butyl-4-hydroxy-5-methylphenyl)-propionylo-xy]ethyl}2,4,8,10-tetraoxaspiro[5,5]undecane (manufactured by the Sumitomo Kagaku Co. under the trade designation "Sumilizer GA80") and 4,4'-thiobis(3-methyl-6-t-butylphenol) (manufactured by the Kawaguchi Kagaku Co, under the trade designation "Antage RC"), 2,2'-thiobis(4,6-di-t-butylresorcinol); polyphenols such as tetrakis[methylene-3-(3,5-di-t-butyl-4-hydroxyphenyl)propionato]methane (manufactured by the Ciba Speciality Chemicals Co. under the trade designation "Irganox L101"), 1,1,3-tris(2-methyl-4-hydroxy-5-t-butylpheny-1)butane (manufactured by the Yoshitomi Seiyaku Co. under the trade designation "Yoshinox 930"), 1,3,5-trimethyl-2,4,6-tris(3,5-di-t-butyl-4-hydroxybenzyl)benzene (manufactured by Ciba Speciality Chemicals under the trade designation "Irganox 330"), bis[3,3'-bis(4'-hydroxy-3'-t-butylpheny-1)butyric acid]glycol ester, 2-(3',5'-di-t-butyl-4-hydroxyphenyl)-methyl-4-(2",4"-di-t-butyl-3"-hydroxyphenyl)methyl-6-t-butylphenol and 2,6-bis(2'-hydroxy-3'-t-butyl-5'-methylbenzyl)-4-methylphenol; and phenol/aldehyde condensates such as the condensates of p-t-butylphenol and formaldehyde and the condensates of p-t-butylphenol and acetaldehyde.

Detergents include calcium alkylsalicylates, calcium alkylphenates and to calcium alkarylsulfonates with alternate metal ions used such as magnesium, barium, or sodium. Examples of the cleaning and dispersing agents which can be used include metal-based detergents such as the neutral and basic alkaline earth metal sulphonates, alkaline earth metal phenates and alkaline earth metal salicylates alkenylsuccinimide and alkenylsuccinimide esters and their borohydrides, phenates, salienius complex detergents and ashless dispersing agents which have been modified with sulphur compounds. These agents can be added and used individually or in the form of mixtures, conveniently in an amount within the range of from 0.01 to 1 part by weight per 100 parts by weight of base oil; these can also be high TBN, low TBN, or mixtures of high/low TBN.

Anti-rust additives include (short-chain) alkenyl succinic acids, partial esters thereof and nitrogen-containing derivatives thereof; and synthetic alkarylsulfonates, such as metal dinonylnaphthalene sulfonates. Anti-rust agents include, for example, monocarboxylic acids which have from 8 to 30 carbon atoms, alkyl or alkenyl succinates or partial esters thereof, hydroxy-fatty acids which have from 12 to 30 carbon atoms and derivatives thereof, sarcosines which have from 8 to 24 carbon atoms and derivatives thereof, amino acids and derivatives thereof, naphthenic acid and derivatives thereof, lanolin fatty acid, mercapto-fatty acids and paraffin oxides.

Particularly preferred anti-rust agents are indicated below. Examples of Monocarboxylic Acids (C8-C30), Caprylic acid, pelargonic acid, decanoic acid, undecanoic acid, lauric acid, myristic acid, palmitic acid, stearic acid, arachic acid, behenic acid, cerotic acid, montanic acid, melissic acid, oleic acid, docosanic acid, erucic acid, eicosenic acid, beef tallow fatty acid, soy bean fatty acid, coconut oil fatty acid, linolic acid, linoleic acid, tall oil fatty acid, 12-hydroxystearic acid, laurylsarcosinic acid, myritsylsarcosinic acid, palmitylsarcosinic acid, stearylsarcosinic acid, oleylsarcosinic acid, alkylated (C8-C20) phenoxyacetic acids, lanolin fatty acid and C8-C24 mercapto-fatty acids.

Examples of Polybasic Carboxylic Acids: The alkenyl (C10-C100) succinic acids indicated in CAS No. 27859-58-1 and ester derivatives thereof, dimer acid, N-acyl-N-alkyloxyalkyl aspartic acid esters (U.S. Pat. No. 5,275,749). Examples of the alkylamines which function as antirust additives or as reaction products with the above carboxylates to to give amides and the like are represented by primary amines such as laurylamine, coconut-amine, n-tridecylamine, myristylamine, n-pentadecylamine, palmitylamine, n-heptadecylamine, stearylamine, n-nonadecylamine, n-eicosylamine, n-heneicosylamine, n-docosylamine, n-tricosylamine, n-pentacosylamine, oleylamine, beef tallow-amine, hydrogenated beef tallow-amine and soy bean-amine. Examples of the secondary amines include dilaurylamine, di-coconut-amine, di-n-tri decylamine, dimyristylamine, di-n-pentadecylamine, dipalmitylamine, di-n-pentadecylamine, distearylamine, di-n-nonadecylamine, di-n-eicosylamine, di-n-heneicosyl amine, di-n-docosyl amine, di-n-tricosylamine, di-n-pentacosyl-amine, dioleylamine, di-beef tallow-amine, di-hydrogenated beef tallow-amine and di-soy bean-amine. Examples of the aforementioned N-alkylpolyalkyenediamines include: ethylenediamines such as laurylethylenediamine, coconut ethylenediamine, n-tridecylethylenediamine-, myristylethylenediamine, n-pentadecylethylenediamine, palmitylethylenediame, heptadecylethylenediamine, stearylethylenediamine, n-nonadecylethylenediamine, n-eicosylethylenediamine, n-heneicosyl ethylenediamine, n-docosylethylendiamine, n-tricosylethylenediamine, n-pentacosylethylenediamine, oleylethylenediamine, beef tallow-ethylenediamine, hydrogenated beef tallow-ethylenediamine and soy bean-ethylenediamine; propylenediamines such as laurylpropylenediamine, coconut propylenediamine, n-tridecylpropylenediamine, myristylpropylenediamine, n-pentadecylpropylenediamine, palmitylpropylenediamine, n-heptadecylpropylenediamine, stearylpropylenediamine, n-nonadecylpropylenediamine, n-eicosylpropylenediamine, n-heneicosylpropylenediamine, n-docosylpropylendiamine, n-tricosylpropylenediamine, n-pentacosyipropylenediamine, diethylene triamine (DETA) or triethylene tetramine (TETA), oleylpropylenediamine, beef tallow-propylenediamine, hydrogenated beef tallow-propylenediamine and soy bean-propylenediamine; butylenediamines such as laurylbutylenediamine, coconut butylenediamine, n-tridecylbutylenediamine-, myristylbutylenediamine, n-pentadecylbutylenediamine, stearylbutylenediamine, n-eicosylbutylenediamine, n-heneicosylbutylenedia-mine, n-docosylbutylendiamine, n-tricosylbutylenediamine, n-pentacosylbutylenediamine, oleylbutylenediamine, beef tallow-butylenediamine, hydrogenated beef tallow-butylenediamine and soy bean butylenediamine; and pentylenediamines such as laurylpentylenediamine, coconut pentylenediamine, myristylpentylenediamin-e, palmitylpentylenediamine, stearylpentylenediamine, oleylpentylenediamine, beef tallow-pentylenediamine, hydrogenated beef tallow-pentylenediamine and soy bean pentylenediamine.

Demulsifying agents include alkoxylated phenols and phenol-formaldehyde resins and synthetic alkylaryl sulfonates such as metallic dinonylnaphthalene sulfonates. A demulsifing agent is a predominant amount of a water-soluble polyoxyalkylene glycol having a pre-selected molecular weight of any value in the range of between about 450 and 5000 or more. An especially preferred family of water soluble polyoxyalkylene glycol useful in the compositions of the present invention may also be one produced from alkoxylation of n-butanol with a mixture of alkylene oxides to form a random alkoxylated product.

Functional fluids according to the invention possess a pour point of less than about −20 degree C., and exhibit compatibility with a wide range of anti-wear additive and extreme pressure additives. The formulations according to the invention also are devoid of fatigue failure that is normally expected by those of ordinary skill in the art when dealing with polar lubricant base stocks.

Polyoxyalkylene glycols useful in the present invention may be produced by a well-known process for preparing polyalkylene oxide having hydroxyl end-groups by subjecting an alcohol or a glycol ether and one or more alkylene oxide monomers such as ethylene oxide, butylene oxide, or propylene oxide to form block copolymers in addition polymerization while employing a strong base such as potassium hydroxide as a catalyst. In such process, the polymerization is commonly carried out under a catalytic concentration of 0.3 to 1.0% by mole of potassium hydroxide to the monomer(s) and at high temperature, as 100 degrees C. to 160 degrees C. It is well known fact that the potassium hydroxide being a catalyst is for the most part bonded to the chain-end of the produced polyalkylene oxide in a form of alkoxide in the polymer solution so obtained.

An especially preferred family of soluble polyoxyalkylene glycol useful in the compositions of the present invention may also be one produced from alkoxylation of n-butanol with a mixture of alkylene oxides to form a random alkoxylated product.

Foam inhibitors include polymers of alkyl methacrylate especially useful poly alkyl acrylate polymers where alkyl is generally understood to be methyl, ethyl propyl, isopropyl, butyl, or iso butyl and polymers of dimethylsilicone which form materials called dimethylsiloxane polymers in the viscosity range of 100 cSt to 100,000 cSt. Other additives are defoamers, such as silicone polymers which have been post reacted with various carbon containing moieties, are the most widely used defoamers. Organic polymers are sometimes used as defoamers although much higher concentrations are required.

Metal deactivating compounds Corrosion inhibitors include 2,5-dimercapto-1,3,4-thiadiazoles and derivatives thereof, mercaptobenzothiazoles, alkyltriazoles and benzotriazoles. Examples of dibasic acids useful as anti-corrosion agents, other than sebacic acids, which may be used in the present invention, are adipic acid, azelaic acid, dodecanedioic acid, 3-methyladipic acid, 3-nitrophthalic acid, 1,10-decanedicarboxylic acid, and fumaric acid. The anti-corrosion combination is a straight or branch-chained, saturated or unsaturated monocarboxylic acid or ester thereof which may optionally be sulphurised in an amount up to 35% by weight. Preferably the acid is a C sub 4 to C sub 22 straight chain unsaturated monocarboxylic acid. The preferred concentration of this additive is from 0.001% to 0.35% by weight of the total lubricant composition. The preferred monocarboxylic acid is sulphurised oleic acid. However, other suitable materials are oleic acid itself valeric acid and erucic acid. A component of the anti-corrosion combination is a triazole as previously defined. The triazole should be used at a concentration from 0.005% to 0.25% by weight of the total composition. The preferred triazole is tolylotriazole which may be included in the compositions of the invention include triazoles, thiazoles and certain diamine compounds which are useful as metal deactivators or metal passivators. Examples include triazole, benzotriazole and substituted benzotriazoles such as alkyl substituted derivatives. The alkyl substituent generally contains up to 1.5 carbon atoms, preferably up to 8 carbon atoms. The triazoles may contain other substituents on the aromatic ring such as halogens, nitro, amino, mercapto, etc. Examples of suitable compounds are benzotriazole and the tolyltriazoles, ethylbenzotriazoles, hexylhenzotriazoles, octylbenzotriazoles, chlorobenzotriazoles and nitrobenzotriazoles. Benzotriazole and totyltriazole are particularly preferred. A straight or branched chain saturated or unsaturated monocarboxylic acid which is optionally sulphurised in an amount which may be up to 35% by weight; or an ester of such an acid; and a triazole or alkyl derivatives thereof, or short chain alkyl of up to 5 carbon atoms; n is zero or an integer between 1 and 3 inclusive; and is hydrogen, morpholino, alkyl, amido, amino, hydroxy or alkyl or aryl substituted derivatives thereof; or a triazole selected from 1,2,4 triazole, 1,2,3 triazole, 5-anilo-1,2,3,4-thiatriazole, 3-amino-1,2,4 triazole, 1-H-benzotriazole-1-yl-methylisocyanide, methylene-bis-benzotriazole and naphthotriazole.

Alkyl is straight or branched chain and is for example methyl, ethyl, n-propyl, iso-propyl, n-butyl, sec-butyl, n-pentyl, n-hexyl, n-heptyl, n-octyl, 2-ethylhexyl, n-nonyl, n-decyl, n-dodecyl, n-tetradecyl, n-hexadecyl, n-octadecyl or n-eicosyl.

Alkenyl is straight or branched chain and is for example prop-2-enyl, but-2-enyl, 2-methyl-prop-2-enyl, pent-2-enyl, hexa-2,4-dienyl, dec-10-enyl or eicos-2-enyl.

Cylcoalkyl is for example cyclopentyl, cyclohexyl, cyclooctyl, cyclodecyl, adamantyl or cyclododecyl.

Aralkyl is for example benzyl, 2-phenylethyl, benzhydryl or naphthylmethyl. Aryl is for example phenyl or naphthyl.

The heterocyclic group is for example a morpholine, pyrrolidine, piperidine or a perhydroazepine ring.

Alkylene moieties include for example methylene, ethylene, 1:2- or 1:3-propylene, 1:4-butylene, 1:6-hexylene, 1:8-octylene, 1:10-decylene and 1:12-dodecylene.

Arylene moieties include for example phenylene and naphthylene. 1-(or 4)-(dimethylaminomethyl)triazole, 1-(or 4)-(diethylaminomethyl)triazole, 1-(or 4)-(di-isopropylaminomethyl)triazole, 1-(or 4)-(di-n-butylaminomethyl)triazole, 1-(or 4)-(di-n-hexylaminomethyl)triazole, 1-(or 4)-(di-isooetylaminomethyl)triazole, 1-(or 4)-(di-(2-ethylhexyl) aminomethyl)triazole, 1-(or 4)-(di-n-decylaminomethyl) triazole, 1-(or 4)-(di-n-dodecylaminomethyl)triazole, 1-(or 4)-(di-n-octadecylaminomethyl)triazole, 1-(or 4)-(di-n-eicosylaminomethyl)triazole, 1-(or 4)-[di-(prop-2'-enyl)aminomethyl]triazole, 1-(or 4)-[di-(but-2'-enyl)aminomethyl] triazole, 1-(or 4)-[di-(eicos-2'-enyl)aminomethyl]triazole, 1-(or 4)-(di-cyclohexylaminomethyl)triazole, 1-(or 4)-(dibenzylaminomethyl)triazole, 1-(or 4)-(di-phenylaminomethyl)triazole, 1-(or 4)-(4'-morpholinomethyl)triazole, 1-(or 4)-(1'-pyrrolidinomethyl)triazole, 1-(or 4)-(1'-piperidinomethyl)triazole, 1-(or 4)-(1'-perhydroroazepinomethyl)triazole, 1-(or 4)-(2',2"-dihydroxyethyl)aminomethyl]triazole, 1-(or 4)-(dibutoxypropyl-aminomethyl)triazole, 1-(or 4)-(dibutylthiopropyl-aminomethyl)triazole, 1-(or 4)-(di-butylaminopropyl-aminomethyl)triazole, 1-(or -4)-(1-methanomine)-N,N-bis(2-ethylhexyl)-methyl benzotriazole, N,N-bis-(1- or 4-triazolylmethyl)laurylamine, N,N-bis-(1- or 4-triazolylmethyl)oleylamine, N,N-bis-(1- or 4-triazolylmethyl)ethanolamine and N,N,N',N'-tetra(1- or 4-triazolylmethyl)ethylene diamine.

Also, dihydrocarbyl dithiophosphate metal salts where the metal is aluminum, lead, tin, manganese, molybedenum, antimony, cobalt, nickel, zinc or copper, but most often zinc. Sulfur- and/or phosphorus- and/or halogen-containing compounds, such as sulfurized olefins and vegetable oils, tritolyl phosphate, tricresyl phosphate, chlorinated paraffins, alkyl and aryl di- and trisulfides, amine salts of mono- and dialkyl phosphates, amine salts of methylphosphonic acid, diethanolaminomethyltolyltriazole, di(2-ethylhexyl)-aminomethyltolyltriazole, derivatives of 2,5-dimercapto-1,3,4-thiadiazole, ethyl((bisisopropyloxyphosphinothioyl)-thio) propionate, triphenyl thiophosphate (triphenyl phosphorothioate), tris(alkylphenyl) phosphorothioates and mixtures thereof (for example tris(isononylphenyl) phosphorothioate), diphenylmonononylphenyl phosphorothioate, isobutylphenyl diphenyl phosphorothioate, the dodecylamine salt of 3-hydroxy-1,3-thiaphosphetan 3-oxide, trithiophosphoric acid 5,5,5-tris(isooctyl 2-acetate), derivatives of 2-mercaptobenzothiazole, such as 1-(N,N-bis(2-ethylhexyl) aminomethyl)-2-m-ercapto-1H-1,3-benzothiazole or ethoxycarbonyl 5-octyldithiocarbamate. The metal deactivating agents which can be used in the lubricating oil a composition of the present invention include benzotriazole and the 4-alkylbenzotriazoles such as 4-methylbenzotriazole and 4-ethylbenzotriazole; 5-alkylbenzotriazoles such as 5-methylbenzotriazole, 5-ethylbenzotriazole; 1-alkylbenzotriazoles such as dioctylauainomethyl-2,3-benzotriazole; benzotriazole derivatives such as the 1-alkyltolutriazoles, for example, 1-dioctylaminomethyl-2,3-t-olutriazole; benzimidazole and benzimidazole derivatives such as 2-(alkyldithio)-benzimidazoles, for example, such as 2-(octyldithio)-benzimidazole, 2-(decyldithio)benzimidazole and 2-(dodecyldithio)-benzimidazole; 2-(alkyldithio)-toluimidazoles such as 2-(octyldithio)-toluimidazole, 2-(decyldithio)-toluimidazole and 2-(dodecyldithio)-toluimidazole; indazole and indazole derivatives of toluimidazoles such as 4-alkylindazole, 5-alkylindazole; benzothiazole, 2-mercaptobenzothiazole derivatives (manufactured by the Chiyoda Kagaku Co. under the trade designation "Thiolite B-3100") and 2-(alkyldithio)benzothiazoles such as 2-(hexyldithio)benzothiazole and 2-(octyldithio)benzothiazole; 2-(alkyl-dithio)toluthiazoles such as 2-(benzyldithio)toluthiazole and 2-(octyldithio)toluthiazole, 2-(N,N-dialkyldithiocarbamyl)benzothiazoles such as 2-(N,N-diethyldithiocarbamyl)benzothiazole, 2-(N,N-dibutyldithiocarbamyl)-benzotriazole and 2-N,N-dihexyl-dithiocarbamyl)benzotriazole; benzothiazole derivatives of 2-(N,N-dialkyldithiocarbamyl)toluthiazoles such as 2-(N,N-diethyldithiocarbamyl)toluthiazole, 2-(N,N-dibutyldithiocarbamyl)toluthiazole, 2-(N,N-dihexyl-dithiocarbamyl)-toluthiazole; 2-(alkyldithio)benzoxazoles such as 2-(octyldithio)benzoxazo-le, 2-(decyldithio)-benzoxazole and 2-(dodecyldithio)benzoxazole; benzoxazole derivatives of 2-(alkyldithio)toluoxazoles such as 2-(octyldithio)toluoxazole, 2-(decyldithio)toluoxazole, 2-(dodecyldithio)toluoxazole; 2,5-bis(alkyldithio)-1,3,4-thiadiazoles such as 2,5-bis(heptyldithio)-1,3,4-thiadiazole, 3,4-thiadiazole, 2,5-bis(dodecyldithio)-1,3,4-thiadiazole and 2,5-bis-(octadecyldithio)-1,3,4-thiadiazole; 2,5-bis(N,N-dialkyl-dithioca-rbamyl)-1,3,4-thiadiazoles such as 2,5-bis(N,N-diethyldithiocarbamyl)-1,3,-4-thiadiazole, 2,5-bis(N,N-dibutyldithiocarbamyl)-1,3,4-thiadiazole and 2,5-bis(N,N-dioctyldithiocarbamyl)1,3,4-thiadiazole; thiadiazole derivatives of 2-N,N-dialkyldithiocarbamyl-5-mercapto-1,3,4-thiadiazoles such as 2-N,N-dibutyldithiocarbamyl-5-mercapto-1,3,4-thiadiazole and 2-N,N-dioctyl-dithiocarbamyl-5-mercapto-1,3,4-thiadiazole, and triazole derivatives of 1-alkyl-2,4-triazoles such as dioctylaminomethyl-2,4-triazole or concentrates and/or mixtures thereof.

Anti-wear agents/Extreme pressure agent/Friction Reducer: zinc alkyldithiophosphates, aryl phosphates and phosphites, sulfur-containing esters, to phosphosulfur compounds, and metal or ash-free dithiocarbamates.

A phosphate ester or salt may be a monohydrocarbyl, dihydrocarbyl or a trihydrocarbyl phosphate, wherein each hydrocarbyl group is saturated. In one embodiment, each hydrocarbyl group independently contains from about 8 to about 30, or from about 12 up to about 28, or from about 14 up to about 24, or from about 14 up to about 18 carbons atoms. In one embodiment, the hydrocarbyl groups are alkyl groups. Examples of hydrocarbyl groups include tridecyl, tetradecyl, pentadecyl, hexadecyl, heptadecyl, octadecyl groups and mixtures thereof.

A phosphate ester or salt is a phosphorus acid ester prepared by reacting one or more phosphorus acid or anhydride with a saturated alcohol. The phosphorus acid or anhydride is generally an inorganic phosphorus reagent, such as phosphorus pentoxide, phosphorus trioxide, phosphorus tetroxide, phosphorous acid, phosphoric acid, phosphorus halide, lower phosphorus esters, or a phosphorus sulfide, including phosphorus pentasulfide, and the like. Lower phosphorus acid esters generally contain from 1 to about 7 carbon atoms in each ester group. Alcohols used to prepare the phosphorus acid esters or salts. Examples of commercially available alcohols and alcohol mixtures include Alfol 1218 (a mixture of synthetic, primary, straight-chain alcohols containing 12 to 18 carbon atoms); Alfol 20+ alcohols (mixtures of C 18-C 28 primary alcohols having mostly C20 alcohols as determined by GLC (gas-liquid-chromatography)); and Alfol22+ alcohols (C 18-C 28 primary alcohols containing primarily C 22 alcohols). Alfol alcohols are available from Continental Oil Company. Another example of a commercially available alcohol mixture is Adol 60 (about 75% by weight of a straight chain C 22 primary alcohol, about 15% of a C 20 primary alcohol and about 8% of C 18 and C 24 alcohols). The Adol alcohols are marketed by Ashland Chemical.

A variety of mixtures of monohydric fatty alcohols derived from naturally occurring triglycerides and ranging in chain length from C 8 to C 18 are available from Procter & Gamble Company. These mixtures contain various amounts of fatty alcohols containing 12, 14, 16, or 18 carbon atoms. For example, CO-1214 is a fatty alcohol mixture containing 0.5% of C 10 alcohol, 66.0% of C 12 alcohol, 26.0% of C 14 alcohol and 6.5% of to C 16 alcohol.

Another group of commercially available mixtures include the "Neodol" products available from Shell Chemical Co. For example, Neodol 23 is a mixture of C 12 and C 13 alcohols; Neodol 25 is a mixture of C 12 to C 15 alcohols; and Neodol 45 is a mixture of C 14 to C 15 linear alcohols. The phosphate contains from about 14 to about 18 carbon atoms in each hydrocarbyl group. The hydrocarbyl groups of the phosphate are generally derived from a mixture of fatty alcohols having from about 14 up to about 18 carbon atoms. The hydrocarbyl phosphate may also be derived from a fatty vicinal diol. Fatty vicinal diols include those available from Ashland Oil under the general trade designation Adol 114 and Adol 158. The former is derived from a straight chain alpha olefin fraction of C 11-C 14, and the latter is derived from a C 15-C 18 fraction.

The phosphate salts may be prepared by reacting an acidic phosphate ester with an amine compound or a metallic base to form an amine or a metal salt. The amines may be monoamines or polyamines. Useful amines include those amines disclosed in U.S. Pat. No. 4,234,435.

The monoamines generally contain a hydrocarbyl group which contains from 1 to about 30 carbon atoms, or from 1 to about 12, or from 1 to about 6. Examples of primary monoamines useful in the present invention include methylamine, ethylamine, propylamine, butylamine, cyclopentylamine, cyclohexylamine, octylamine, dodecylamine, cocoamine, stearylamine, and laurylamine. Examples of secondary monoamines include dimethylamine, diethylamine, dipropylamine, dibutylamine, dicyclopentylamine, dicyclohexylamine, methylbutylamine, ethylhexylamine, etc.

An amine is a fatty (C.sub.8-30) amine which includes n-octylamine, n-decylamine, n-dodecylamine, n-tetradecylamine, n-hexadecylamine, n-octadecylamine, oleyamine, etc. Also useful fatty amines include commercially available fatty amines such as "Armeen" amines (products available from Akzo Chemicals, Chicago, Ill.), such Armeen C, Armeen O, Armeen OL, Armeen T. Armeen HT, Armeen S and Armeen SD, wherein the letter designation relates to the fatty group, such as coco, oleyl, tallow, or stearyl groups.

Other useful amines include primary ether amines, such as those represented by the formula, R"(OR')xNH 2, wherein R' is a divalent alkylene group having about 2 to about 6 carbon atoms; x is a number from one to about 150, or from about one to about five, or one; and R" is a hydrocarbyl group of about 5 to about 150 carbon atoms. An example of an ether amine is available under the name SURFAM® amines produced and marketed by Mars Chemical Company, Atlanta, Ga. Preferred etheramines are exemplified by those identified as SURFAM P14B (decyloxypropylamine), SURFAM P16A (linear C 16), SURFAM P17B (tridecyloxypropylamine). The carbon chain lengths (i.e., C 14, etc.) of the SURFAMS described above and used hereinafter are approximate and include the oxygen ether linkage.

An amine is a tertiary-aliphatic primary amine. Generally, the aliphatic group, preferably an alkyl group, contains from about 4 to about 30, or from about 6 to about 24, or from about 8 to about 22 carbon atoms. Usually the tertiary alkyl primary amines are monoamines the alkyl group is a hydrocarbyl group containing from one to about 27 carbon atoms and R 6 is a hydrocarbyl group containing from 1 to about 12 carbon atoms. Such amines are illustrated by tert-butylamine, tert-hexyl amine, 1-methyl-1-amino-cyclohexane, tert-octylamine, tert-decylamine, tert-dodecylamine, tert-tetradecylamine, tert-hexadecylamine, tert-octadecylamine, tert-tetracosanylamine, and tert-octacosanylamine. Mixtures of tertiary aliphatic amines may also be used in preparing the phosphate salt. Illustrative of amine mixtures of this type are "Primene 81R" which is a mixture of C 11-C 14 tertiary alkyl primary amines and "Primene JMT" which is a similar mixture of C 18-C 22 tertiary alkyl primary amines (both are available from Rohm and Haas Company). The tertiary aliphatic primary amines and methods for their preparation are known to those of ordinary skill in the art. The tertiary aliphatic primary amine useful for the purposes of this invention and methods for their preparation are described in U.S. pat.

An amine is a heterocyclic polyamine. The heterocyclic polyamines include aziridines, azetidines, azolidines, tetra- and dihydropyridines, pyrroles, indoles, piperidines, imidazoles, di- and tetra-hydroimidazoles, piperazines, isoindoles, purines, morpholines, thiomorpholines, N-aminoalkylmorpholines, N-aminoalkylthiomorpholines, N-aminoalkyl-piperazines, N,N'-diaminoalkylpiperazines, azepines, azocines, azonines, azecines and tetra-, di- and perhydro derivatives of each of the above and mixtures of two or more of these heterocyclic amines. Preferred heterocyclic amines are the saturated 5- and 6-membered heterocyclic amines containing only nitrogen, oxygen and/or sulfur in the hetero ring, especially the piperidines, piperazines, thiomorpholines, morpholines, pyrrolidines, and the like. Piperidine, aminoalkyl substituted piperidines, piperazine, aminoalkyl substituted piperazines, morpholine, aminoalkyl substituted morpholines, pyrrolidine, and aminoalkyl-substituted pyrrolidines, are especially preferred. Usually the aminoalkyl substituents are substituted on a nitrogen atom forming part of the hetero ring. Specific examples of such heterocyclic amines include N-aminopropylmorpholine, N-aminoethylpiperazine, and N,N'-diaminoethylpiperazine. Hydroxy heterocyclic polyamines are also useful. Examples include N-(2-hydroxyethyl)cyclohexylamine, 3-hydroxycyclopentylamine, parahydroxyaniline, N-hydroxyethylpiperazine, and the like.

The metal salts of the phosphorus acid esters are prepared by the reaction of a metal base with the acidic phosphorus ester. The metal base may be any metal compound capable of forming a metal salt. Examples of metal bases include metal oxides, hydroxides, carbonates, sulfates, borates, or the like. The metals of the metal base include Group IA, IIA, IB through VIIB, and VIII metals (CAS version of the Periodic Table of the Elements). These metals include the alkali metals, alkaline earth metals and transition metals. In one embodiment, the metal is a Group IIA metal, such as calcium or magnesium, Group IIB metal, such as zinc, or a Group VIIB metal, such as manganese. Preferably, the metal is magnesium, calcium, manganese or zinc. Examples of metal compounds which may be reacted with the phosphorus acid include zinc hydroxide, zinc oxide, copper hydroxide, copper oxide, etc.

Lubricating compositions also may include a fatty imidazoline or a reaction product of a fatty carboxylic acid and at least one polyamine. The fatty imidazoline has fatty substituents containing from 8 to about 30, or from about 12 to about 24 carbon atoms. The substituent may be saturated or unsaturated for example, heptadeceneyl derived olyel groups, preferably saturated. In one aspect, the fatty imidazoline may be prepared by reacting a fatty carboxylic acid with a polyalkylenepolyamine, such as those discussed above. The fatty carboxylic acids are generally mixtures of straight and branched chain fatty carboxylic acids containing about 8 to about 30 carbon atoms, or from about 12 to about 24, or from about 16 to about 18. Carboxylic acids include the polycarboxylic acids or carboxylic acids or anhydrides having from 2 to about 4 carbonyl groups, preferably 2. The polycarboxylic acids include succinic acids and anhydrides and Diels-Alder reaction products of unsaturated monocarboxylic acids with unsaturated carboxylic acids (such as acrylic, methacrylic, fumaric, crotonic and itaconic acids). Preferably, the fatty carboxylic acids are fatty monocarboxylic acids, having from about 8 to about 30, preferably about 12 to about 24 carbon atoms, such as octanoic, oleic, stearic, linoleic, dodecanoic, and tall oil acids, preferably stearic acid. The fatty carboxylic acid is reacted with at least one polyamine. The polyamines may be aliphatic, cycloaliphatic, heterocyclic or aromatic. Examples of the polyamines include alkylene polyamines and heterocyclic polyamines.

Hydroxyalkyl groups are to be understood as meaning, for example, monoethanolamine, diethanolamine or triethanolamine, and the term amine also includes diamine. The amine used for the neutralization depends on the phosphoric esters used. The EP additive according to the invention has the following advantages: It very high effectiveness when used in low concentrations and it is free of chlorine. For the neutralization of the phosphoric esters, the latter are taken and the corresponding amine slowly added with stirring. The resulting heat of neutralization is removed by cooling. The EP additive according to the invention can be incorporated into the respective base liquid with the aid of fatty substances (e.g. tall oil fatty acid, oleic acid, etc.) as solubilizers. The base liquids used are napthenic or paraffinic base oils, synthetic oils (e.g. polyglycols, mixed polyglycols), polyolefins, carboxylic esters, etc.

The composition comprises at least one phosphorus containing extreme pressure additive. Examples of such additives are amine phosphate extreme pressure additives such as that known under the trade name IRGALUBE 349 and/or triphenyl phosphorothionate extreme pressure/anti-wear additives such as that known under the trade name IRGALUBE TPPT. Such amine phosphates are suitably present in an amount of from 0.01 to 2%, preferably 0.2 to 0.6% by weight of the lubricant composition while such phosphorothionates are suitably present in an amount of from 0.01 to 3%, preferably 0.5 to 1.5% by weight of the lubricant composition. A mixture of an amine phosphate and phosphorothionate is employed.

At least one straight and/or branched chain saturated or unsaturated monoearboxylic acid which is optionally sulphurised in an amount which may be up to 35% by weight; and/or an ester of such an acid. At least one triazole or alkyl derivatives thereof, or short chain alkyl of up to 5 carbon atoms and is hydrogen, morphilino, alkyl, amid°, amino, hydroxy or alkyl or aryl substituted derivatives thereof; or a triazole selected from 1,2,4 triazole, 1,2,3 triazole, 5-anilo-1,2,3,4-thiatriazole, 3-amino-1,2,4 triazole, 1-H-benzotriazole-1-yl-methylisocyanide, methylene-bis-benzotriazole and naphthotriazole; and The neutral organic phosphate which forms a component of the formulation may be present in an amount of 0.01 to 4%, preferably 1.5 to 2.5% by weight of the composition. The above amine phosphates and any of the aforementioned benzo- or tolyltriazoles can be mixed together to form a single component capable of delivering antiwear performance. The neutral organic phosphate is also a conventional ingredient of lubricating compositions and any such neutral organic phosphate falling within the formula as previously defined may be employed.

Phosphates for use in the present invention include phosphates, acid phosphates, phosphites and acid phosphites. The phosphates include triaryl phosphates, trialkyl phosphates, trialkylaryl phosphates, triarylalkyl phosphates and trialkenyl phosphates. As specific examples of these, referred to are triphenyl phosphate, tricresyl phosphate, benzyldiphenyl phosphate, ethyldiphenyl phosphate, tributyl phosphate, ethyldibutyl phosphate, cresyldiphenyl phosphate, dicresylphenyl phosphate, ethylphenyldiphenyl phosphate, diethylphenylphenyl phosphate, propylphenyldiphenyl phosphate, dipropylphenylphenyl phosphate, triethylphenyl phosphate, tripropylphenyl phosphate, butylphenyldiphenyl phosphate, dibutylphenylphenyl phosphate, tributylphenyl phosphate, trihexyl phosphate, tri(2-ethylhexyl)phosphate, tridecyl phosphate, trilauryl phosphate, trimyristyl phosphate, tripalmityl phosphate, tristearyl phosphate, and trioleyl phosphate. The acid phosphates include, for example, 2-ethylhexyl acid phosphate, ethyl acid phosphate, butyl acid phosphate, oleyl acid phosphate, tetracosyl acid phosphate, isodecyl acid phosphate, lauryl acid phosphate, tridecyl acid phosphate, stearyl acid phosphate, and isostearyl acid phosphate.

The phosphites include, for example, triethyl phosphite, tributyl phosphite, triphenyl phosphite, tricresyl phosphite, tri(nonylphenyl)phosphite, tri(2-ethylhexyl)phosphite, tridecyl phosphite, trilauryl phosphite, triisooctyl phosphite, diphenylisodecyl phosphite, tristearyl phosphite, and trioleyl phosphite.

The acid phosphites include, for example, dibutyl hydrogenphosphite, dilauryl hydrogenphosphite, dioleyl hydrogenphosphite, distearyl hydrogenphosphite, and diphenyl hydrogenphosphite.

Amines that form amine salts with such phosphates include, for example, mono-substituted amines, di-substituted amines and tri-substituted amines. Examples of the mono-substituted amines include butylamine, pentylamine, hexylamine, cyclohexylamine, octylamine, laurylamine, stearylamine, oleylamine and benzylamine; and those of the di-substituted amines include dibutylamine, dipentylamine, dihexylamine, dicyclohexylamine, dioctylamine, dilaurylamine, distearylamine, dioleylamine, dibenzylamine, stearyl monoethanolamine, decyl monoethanolamine, hexyl monopropanolamine, benzyl monoethanolamine, phenyl monoethanolamine, and tolyl monopropanolamine. Examples of tri-substituted amines include tributylamine, tripentylamine, trihexylamine, tricyclohexylamine, trioctylamine, trilaurylamine, tristearylamine, trioleylamine, tribenzylamine, dioleyl monoethanolamine, dilauryl monopropanolamine, dioctyl monoethanolamine, dihexyl monopropanolamine, dibutyl monopropanolamine, oleyl diethanolamine, stearyl dipropanolamine, diethanolamine, octyl dipropanolamine, butyl diethanolamine, benzyl diethanolamine, phenyl diethanolamine, tolyl dipropanolamine, xylyl diethanolamine, triethanolamine, and tripropanolamine, Phosphates or their amine salts are added to the base oil in an amount of from 0.03 to 5% by weight, preferably from 0.1 to 4% by weight, relative to the total weight of the composition.

Carboxylic acids to be reacted with amines include, for example, aliphatic carboxylic acids, dicarboxylic acids (dibasic acids), and aromatic carboxylic acids. The aliphatic carboxylic acids have from 8 to 30 carbon atoms, and may be saturated or unsaturated, and linear or branched. Specific examples of the aliphatic carboxylic acids include pelargonic acid, lauric acid, tridecanoic acid, myristic acid, palmitic acid, stearic acid, isostearic acid, eicosanoic acid, behenic acid, triacontanoic acid, caproleic acid, undecylenic acid, oleic acid, linolenic acid, erucic acid, and linoleic acid. Specific examples of the dicarboxylic acids include octadecylsuccinic acid, octadecenylsuccinic acid, adipic acid, azelaic acid, and sebacic acid. One example of the aromatic carboxylic acids is salicylic acid. The amines to be reacted with carboxylic acids include, for example, polyalkylenepolyamines such as diethylenetriamine, triethylenetetramine, tetraethylenepentamine, pentaethylenehexamine, hexaethyleneheptamine, heptaethyleneoctamine, dipropylenetriamine, tetrapropylenepentamine, and hexabutyleneheptamine; and alkanolamines such as monoethanolamine and diethanolamine. Of these, preferred are a combination of isostearic acid and tetraethylenepentamine, and a combination of oleic acid and diethanolamine. The reaction products of carboxylic acids and amines are added to the base oil in an amount of from 0.01 to 5% by weight, preferably from 0.03 to 3% by weight, relative to the total weight of the composition.

Important components are phosphites, thiophosphites phosphates, and thiophosphates, including mixed materials having, for instance, one or two sulfur atoms, i.e., monothio- or dithio compounds. As used herein, the term "hydrocarbyl substituent" or "hydrocarbyl group" is used in its ordinary sense, which is well-known to those skilled in the art. Specifically, it refers to a group having a carbon atom directly attached to the remainder of the molecule and having predominantly hydrocarbon character. Examples of hydrocarbyl groups include:

Hydrocarbon substituents, that is, aliphatic (e.g., alkyl or alkenyl), alicyclic (e.g., cycloalkyl, cycloalkenyl) substituents, and aromatic-, aliphatic-, and alicyclic-substituted aromatic substituents, as well as cyclic substituents wherein the ring is completed through another portion of the molecule (e.g., two substituents together form an alicyclic radical);

the substituted hydrocarbon substituents, that is, substituents containing non-hydrocarbon groups which, in the context of this invention, do not alter the predominantly hydrocarbon substituent (e.g., halo (especially chloro and fluoro), hydroxy, alkoxy, mercapto, alkylmercapto, nitro, nitroso, and sulfoxy); and hetero-atom containing substituents, that is, substituents which, while having a predominantly hydrocarbon character, in the context of this invention, contain other than carbon in a ring or chain otherwise composed of carbon atoms. Heteroatoms include sulfur, oxygen, nitrogen, and encompass substituents as pyridyl, furyl, thienyl and imidazolyl. In general, no more than two, preferably no more than one, non-hydrocarbon substituent will be present for every ten carbon atoms in the hydrocarbyl group; typically, there will be no non-hydrocarbon substituents in the hydrocarbyl group.

The term "hydrocarbyl group," in the context of the present invention, is also intended to encompass cyclic hydrocarbyl or hydrocarbylene groups, where two or more of the alkyl groups in the above structures together form a cyclic structure. The hydrocarbyl or hydrocarbylene groups of the present invention generally are alkyl or cycloalkyl groups which contain at least 3 carbon atoms. Preferably or optimally containing sulfur, nitrogen, or oxygen, they will contain 4 to 24, and alternatively 5 to 18 carbon atoms. In another embodiment they contain about 6, or exactly 6 carbon atoms. The hydrocarbyl groups can be tertiary or preferably primary or secondary groups; in one embodiment the component is a di(hydrocarbyl)hydrogen phosphite and each of the hydrocarbyl groups is a primary alkyl group; in another embodiment the component is a di(hydrocarbyl)hydrogen phosphite and each of the hydrocarbyl groups is a secondary alkyl group. In yet another embodiment the component is a hydrocarbylenehydrogen phosphite.

Examples of straight chain hydrocarbyl groups include methyl, ethyl, n-propyl, n-butyl, n-hexyl, n-octyl, n-decyl, n-dodecyl, stearyl, n-hexadecyl, n-octadecyl, oleyl, and cetyl. Examples of branched-chain hydrocarbon groups include isopropyl, isobutyl, secondary butyl, tertiary butyl, neopentyl, 2-ethylhexyl, and 2,6-dimethylheptyl. Examples of cyclic groups include cyclobutyl, cyclopentyl, methylcyclopentyl, cyclohexyl, methylcyclohexyl, cycloheptyl, and cyclooctyl. A few examples of aromatic hydrocarbyl groups and mixed aromatic-aliphatic hydrocarbyl groups include phenyl, methylphenyl, and naphthyl.

The R groups can also comprise a mixture of hydrocarbyl groups derived from commercial alcohols. Examples of some monohydric alcohols and alcohol mixtures include the commercially available "Alfol™" alcohols marketed by Continental Oil Corporation. Alfol™ 810, for instance, is a mixture containing alcohols consisting essentially of straight chain, primary alcohols having from 8 to 12 carbon atoms. Alfol™ 12 is a mixture of mostly C12 fatty alcohols; Alfol™ 22+ comprises C 18-28 primary alcohols having mostly C 22 alcohols, and so on. Various mixtures of monohydric fatty alcohols derived from naturally occurring triglycerides and ranging in chain length from C 8 to C 18 are available from Procter & Gamble Company. "Neodol™" alcohols are available from Shell Chemical Co., where, for instance, Neodol™ 25 is a mixture of C 12 to C 15 alcohols.

Specific examples of some of the phosphites and thiophosphites within the scope of the invention include phosphorous acid, mono-, di-, or tri-thiophosphorous acid, mono-, di-, or tri-propyl phosphite or mono-, di-, or tri-thiophosphite; mono-, di-, or tri-butyl phosphite or mono-, di-, or tri-thiophosphite; mono-, di-, or tri-amyl phosphite or mono-, di-, or tri-thiophosphite; mono-, di-, or tri-hexyl phosphite or mono-, di-, or tri-thiophosphite; mono-, di-, or tri-phenyl phosphite or mono-, di-, or tri-thiophosphite; mono-, di-, or tri-tolyl phosphite or mono-, di-, or tri-thiophosphite; mono-, di-, or tri-cresyl phosphite or mono-, di-, or tri-thiophosphite; dibutyl phenyl phosphite or mono-, di-, or tri-phosphite, amyl dicresyl phosphite or mono-, di-, or tri-thiophosphite, and any of the above with substituted groups, such as chlorophenyl or chlorobutyl.

Specific examples of the phosphates and thiophosphates within the scope of the invention include phosphoric acid, mono-, di-, or tri-thiophosphoric acid, mono-, di-, or tri-propyl phosphate or mono-, di-, or tri-thiophosphate; mono-, di-, or tri-butyl phosphate or mono-, di-, or tri-thiophosphate; mono-, di-, or tri-amyl phosphate or mono-, di-, or tri-thiophosphate; mono-, di-, or tri-hexyl phosphate or mono-, di-, or tri-thiophosphate; mono-, di-, or tri-phenyl phosphate or mono-, di-, or tri-thiophosphate; mono-, di-, or tritolyl phosphate or mono-, di-, or trithiophosphate; mono-, di-, or tri-cresyl phosphate or mono-, di-, or tri-thiophosphate; dibutyl phenyl phosphate or mono-, di-, or tri-phosphate, amyl dicresyl phosphate or mono-, di-, or tri-thiophosphate, and any of the above with substituted groups, such as chlorophenyl or chlorobutyl.

The phosphorus compounds of the present invention are prepared by well known reactions. One route the reaction of an alcohol or a phenol with phosphorus trichloride or by a transesterification reaction. Alcohols and phenols can be reacted with phosphorus pentoxide to provide a mixture of an alkyl or aryl phosphoric acid and a dialkyl or diaryl phosphoric acid. Alkyl phosphates can also be prepared by the oxidation of the corresponding phosphites. Thiophosphates can be prepared by the reaction of phosphites with elemental sulfur. In any case, the reaction can be conducted with moderate heating. Moreover, various phosphorus esters can be prepared by reaction using other phosphorus esters as starting materials. Thus, medium chain (C9 to C22) phosphorus esters have been prepared by reaction of dimethylphosphite with a mixture of medium-chain alcohols by means of a thermal transesterification or an acid- or base-catalyzed transesterification; see for example U.S. Pat. No. 4,652,416, Most such materials are also commercially available; tier instance, triphenyl phosphite is available from Albright and Wilson as Duraphos TPP™; di-n-butyl hydrogen phosphite from Albright and Wilson as Duraphos DBHP™; and triphenylthiophosphate from Ciba Specialty Chemicals as Irgalube TPPT™.

The other major component of the present composition is a hydrocarbon having ethylenic unsaturation. This would normally be described as an olefin or a diene, triene, polyene, and so on, depending on the number of ethylenic unsaturations present. Preferably the olefin is mono unsaturated, that is, containing only a single ethylenic double bond per molecule. The olefin can be a cyclic or a linear olefin. If a linear olefin, it can be an internal olefin or an alpha-olefin. The olefin can also contain aromatic unsaturation, i.e., one or more aromatic rings, provided that it also contains ethylenic (non-aromatic) unsaturation.

The olefin normally will contain 6 to 30 carbon atoms. Olefins having significantly fewer than 6 carbon atoms tend to be volatile liquids or gases which are not normally suitable for formulation into a composition suitable as an antiwear lubricant. Preferably the olefin will contain 6 to 18 or 6 to 12 carbon atoms, and alternatively 6 or 8 carbon atoms.

Among suitable olefins are alkyl-substituted cyclopentenes, hexenes, cyclohexene, alkyl-substituted cyclohexenes, heptenes, cycloheptenes, alkyl-substituted cycloheptenes, octenes including diisobutylene, cyclooctenes, alkyl-substituted cyclooctenes, nonenes, decenes, undecenes, dodecenes including propylene tetramer, tridecenes, tetradecenes, pentadecenes, hexadecenes, heptadecenes, octadecenes, cyclooctadiene, norbornene, dicyclopentadiene, squalene, diphenylacetylene, and styrene. Highly preferred olefins are cyclohexene and 1-octene.

Examples of esters of the dialkylphosphorodithioic acids include esters obtained by reaction of the dialkyl phosphorodithioic acid with an alpha, beta-unsaturated carboxylic acid (e.g., methyl acrylate) and, optionally an alkylene oxide such as propylene oxide.

Generally, the compositions of the present invention will contain varying amounts of one or more of the above-identified metal dithiophosphates such as from about 0.01 to about 2% by weight, and more generally from about 0.01 to about 1% by weight, based on the weight of the total composition.

The hydrocarbyl in the dithiophosphate may be alkyl, cycloalkyl, aralkyl or alkaryl groups, or a substantially hydrocarbon group of similar structure. Illustrative alkyl groups include isopropyl, isobutyl, n-butyl, sec-butyl, the various amyl groups, n-hexyl, methylisobutyl, heptyl, 2-ethylhexyl, diisobutyl, isooctyl, nonyl, behenyl, decyl, dodecyl, tridecyl, etc. Illustrative lower alkylphenyl groups include butylphenyl, amylphenyl, heptylphenyl, etc. Cycloalkyl groups likewise are useful and these include chiefly cyclohexyl and the lower alkyl-cyclohexyl radicals. Many substituted hydrocarbon groups may also be used, e.g., chloropentyl, dichlorophenyl, and dichlorodecyl.

The phosphorodithioic acids from which the metal salts useful in this invention are prepared are well known. Examples of dihydrocarbylphosphorodithioic acids and metal salts, and processes for preparing such acids and salts are found in, for example U.S. Pat. Nos. 4,263,150; 4,289,635; 4,308,154; and 4,417,990. These patents are hereby incorporated by reference.

The phosphorodithioic acids are prepared by the reaction of a phosphorus sulfide with an alcohol or phenol or mixtures of alcohols. A typical reaction involves four moles of the alcohol or phenol and one mole of phosphorus pentasulfide, and may be carried out within the temperature range from about 50 C. to about 200 C. Thus, the preparation of O,O-di-n-hexyl phosphorodithioic acid involves the reaction of a mole of phosphorus pentasulfide with four moles of n-hexyl alcohol at about 100 C for about two hours. Hydrogen sulfide is liberated and the residue is the desired acid. The preparation of the metal salts of these acids may be effected by reaction with metal compounds as well known in the art.

The metal salts of dihydrocarbyldithiophosphates which are useful in this invention include those salts containing Group I metals, Group II metals, aluminum, lead, tin, molybdenum, manganese, cobalt, and nickel. The Group II metals, aluminum, tin, iron, cobalt, lead, molybdenum, manganese, nickel and copper are among the preferred metals. Zinc and copper are especially useful metals. Examples of metal compounds which may be reacted with the acid include lithium oxide, lithium hydroxide, sodium hydroxide, sodium carbonate, potassium hydroxide, potassium carbonate, silver oxide, magnesium oxide, magnesium hydroxide, calcium oxide, zinc hydroxide, strontium hydroxide, cadmium oxide, cadmium hydroxide, barium oxide, aluminum oxide, iron carbonate, copper hydroxide, lead hydroxide, tin butylate, cobalt hydroxide, nickel hydroxide, nickel carbonate, and the like.

In some instances, the incorporation of certain ingredients such as small amounts of the metal acetate or acetic acid in conjunction with the metal reactant will facilitate the reaction and result in an improved product. For example, the use of up to about 5% of zinc acetate in combination with the required amount of zinc oxide facilitates the formation of a zinc phosphorodithioate with potentially improved performance properties.

Especially useful metal phosphorodithloates can be prepared from phosphorodithloic acids which in turn are prepared by the reaction of phosphorus pentasulfide with mixtures of alcohols. In addition, the use of such mixtures enables the utilization of less expensive alcohols which individually may not yield oil-soluble phosphorodithioic acids. Thus a mixture of isopropyl and hexylalcohols can be used to produce a very effective, oil-soluble metal phosphorodithioate. For the same reason mixtures of phosphorodithioic acids can be reacted with the metal compounds to form less expensive, oil-soluble salts.

The mixtures of alcohols may be mixtures of different primary alcohols, mixtures of different secondary alcohols or mixtures of primary and secondary alcohols. Examples of useful mixtures include: n-butanol and n-octanol; n-pentanol and 2-ethyl-1-hexanol; isobutanol and n-hexanol; isobutanol and isoamyl alcohol; isopropanol and 2-methyl-4-pentanol; isopropanol and sec-butyl alcohol; isopropanol and isooctyl alcohol; and the like.

Organic triesters of phosphorus acids are also employed in lubricants. Typical esters include triarylphosphates, trialkyl phosphates, neutral alkylaryl phosphates, alkoxyalkyl phosphates, triaryl phosphite, trialkylphosphite, neutral alkyl aryl phosphites, neutral phosphonate esters and neutral phosphine oxide esters. In one embodiment, the long chain dialkyl phosphonate esters are used. More preferentially, the dimethyl-, diethyl-, and dipropyl-oleyl phosphonates can be used. Neutral acids of phosphorus acids are the triesters rather than an acid (HO—P) or a salt of an acid.

Any C4 to C8 alkyl or higher phosphate ester may be employed in the invention. For example, tributyl phosphate (TBP) and tri isooctal phosphate (TOF) can be used. The specific triphosphate ester or combination of esters can easily be selected by one skilled in the art to adjust the density, viscosity etc. of the formulated fluid. Mixed esters, such as dibutyl octyl phosphate or the like may be employed rather than a mixture of two or more trialkyl phosphates.

A trialkyl phosphate is often useful to adjust the specific gravity of the formulation, but it is desirable that the specific trialkyl phosphate be a liquid at low temperatures. Consequently, a mixed ester containing at least one partially alkylated with a C3 to C4 alkyl group is very desirable, for example, 4-isopropylphenyl diphenyl phosphate or 3-butylphenyl diphenyl phosphate. Even more desirable is a triaryl phosphate produced by partially alkylating phenol with butylene or propylene to form a mixed phenol which is then reacted with phosphorus oxychloride as taught in U.S. Pat. No. 3,576,923.

Any mixed triaryl phosphate (TAP) esters may be used as cresyl diphenyl phosphate, tricresol phosphate, mixed xylyl cresyl phosphates, lower alkylphenyl/phenyl phosphates, such as mixed isopropylphenyl/phenyl phosphates, t-butylphenyl phenyl phosphates. These esters are used extensively as plasticizers, functional fluids, gasoline additives, flame-retardant additives and the like.

An extreme pressure agent, sulfur-based extreme pressure agents, such as sulfides, sulfoxides, sulfones, thiophosphinates, thiocarbonates, sulfurized fats and oils, sulfurized olefins and the like; phosphorus-based extreme pressure agents, such as phosphoric acid esters (e.g., tricresyl phosphate (TCP) and the like), phosphorous acid esters, phosphoric acid ester amine salts, phosphorous acid ester amine salts, and the like; halogen-based extreme pressure agents, such as chlorinated hydrocarbons and the like; organometallic extreme pressure agents, such as thiophosphoric acid salts (e.g., zinc dithiophosphate (ZnDTP) and the like) and thiocarbamic acid salts; and the like can be used. As the anti-wear agent, organomolybdenum compounds such as molybdenum dithiophosphate (MoDTP), molybdenum dithiocarbamate (MoDTC) and the like; organoboric compounds such as alkylmercaptyl borate and the like; solid lubricant anti-wear agents such as graphite, molybdenum disulfide, antimony sulfide, boron compounds, polytetrafluoroethylene and the like; and the like can be used.

The phosphoric acid ester, thiophosphoric acid ester, and amine salt thereof functions to enhance the lubricating performances, and can be selected from known compounds conventionally employed as extreme pressure agents. Generally employed are phosphoric acid esters, a thiophosphoric acid ester, or an amine salt thereof which has an alkyl group, an alkenyl group, an alkylaryl group, or an aralkyl group, any of which contains approximately 3 to 30 carbon atoms.

Examples of the phosphoric acid esters include aliphatic phosphoric acid esters such as triisopropyl phosphate, tributyl phosphate, ethyl dibutyl phosphate, trihexyl phosphate, tri-2-ethylhexyl phosphate, trilauryl phosphate, tristearyl phosphate, and trioleyl phosphate; and aromatic phosphoric acid esters such as benzyl phenyl phosphate, allyl diphenyl phosphate, triphenyl phosphate, tricresyl phosphate, ethyl diphenyl phosphate, cresyl diphenyl phosphate, dicresyl phenyl phosphate, ethyl phenyl diphenyl phosphate, diethylphenyl phenyl phosphate, propylphenyl diphenyl phosphate, dipropylphenyl phenyl to phosphate, triethylphenyl phosphate, tripropylphenyl phosphate, butylphenyl diphenyl phosphate, dibutylphenyl phenyl phosphate, and tributylphenyl phosphate. Preferably, the phosphoric acid ester is a trialkylphenyl phosphate.

Examples of the thiophosphoric acid esters include aliphatic thiophosphoric acid esters such as triisopropyl thiophosphate, tributyl thiophosphate, ethyl dibutyl thiophosphate, trihexyl thiophosphate, tri-2-ethylhexyl thiophosphate, trilauryl thiophosphate, tristearyl thiophosphate, and trioleyl thiophosphate; and aromatic thiophosphoric acid esters such as benzyl phenyl thiophosphate, allyl diphenyl thiophosphate, triphenyl thiophosphate, tricresyl thiophosphate, ethyl diphenyl thiophosphate, cresyl diphenyl thiophosphate, dicresyl phenyl thiophosphate, ethyl phenyl diphenyl thiophosphate, diethylphenyl phenyl thiophosphate, propylphenyl diphenyl thiophosphate, dipropylphenyl phenyl thiophosphate, triethylphenyl thiophosphate, tripropylphenyl thiophosphate, butylphenyl diphenyl thiophosphate, dibutylphenyl phenyl thiophosphate, and tributylphenyl thiophosphate. Preferably, the thiophosphoric acid ester is a trialkylphenyl thiophosphate.

Also employable are amine salts of the above-mentioned phosphates and thiophosphates. Amine salts of acidic alkyl or aryl esters of the phosphoric acid and thiophosphoric acid are also employable. Preferably, the amine salt is an amine salt of trialkylphenyl phosphate or an amine salt of alkyl phosphate.

One or any combination of the compounds selected from the group consisting of a phosphoric acid ester, a thiophosphoric acid ester, and an amine salt thereof may be used.

The phosphorus acid ester and/or its amine salt function to enhance the lubricating performances, and can be selected from known compounds conventionally employed as extreme pressure agents. Generally employed are a phosphorus acid ester or an amine salt thereof which has an alkyl group, an alkenyl group, an alkylaryl group, or an aralkyl group, any of which contains approximately 3 to 30 carbon atoms.

Examples of the phosphorus acid esters include aliphatic phosphorus acid esters such as triisopropyl phosphite, tributyl phosphite, ethyl dibutyl phosphite, trihexyl phosphite, tri-2-ethylhexylphosphite, trilauryl phosphite, tristearyl phosphite, and trioleyl phosphite; and aromatic phosphorus acid esters such as benzyl phenyl phosphite, allyl diphenylphosphite, triphenyl phosphite, tricresyl phosphite, ethyl diphenyl phosphite, tributyl phosphite, ethyl dibutyl phosphite, cresyl diphenyl phosphite, dicresyl phenyl phosphite, ethylphenyl diphenyl phosphite, diethylphenyl phenyl phosphite, propylphenyl diphenyl phosphite, dipropylphenyl phenyl phosphite, triethylphenyl phosphite, tripropylphenyl phosphite, butylphenyl diphenyl phosphite, dibutylphenyl phenyl phosphite, and tributylphenyl phosphite. Also favorably employed are dilauryl phosphite, dioleyl phosphite, dialkyl phosphites, and diphenyl phosphite. Preferably, the phosphorus acid ester is a dialkyl phosphite or a trialkyl phosphite.

The phosphate salt may be derived from a polyamine. The polyamines include alkoxylated diamines, fatty polyamine diamines, alkylenepolyamines, hydroxy containing polyamines, condensed polyamines arylpolyamines, and heterocyclic polyamines. Commercially available examples of alkoxylated diamines include those amine where y in the above formula is one. Examples of these amines include Ethoduomeen T/13 and T/20 which are ethylene oxide condensation products of N-tallowtrimethylenediamine containing 3 and 10 moles of ethylene oxide per mole of diamine, respectively.

In another embodiment, the polyamine is a fatty diamine. The fatty diamines include mono- or dialkyl, symmetrical or asymmetrical ethylene diamines, propane diamines (1,2, or 1,3), and polyamine analogs of the above. Suitable commercial fatty polyamines are Duomeen C. (N-coco-1,3-diaminopropane), Duomeen S(N-soya-1,3-diaminopropane), Duomeen T (N-tallow-1,3-diaminopropane), and Duomeen O (N-Oleyl-1,3-diaminopropane). "Duomeens" are commercially available from Armak Chemical Co., Chicago, Ill.

Such alkylenepolyamines include methylenepolyamines, ethylenepolyamines, butylenepolyamines, propylenepolyamines, pentylenepolyamines, etc. The higher homologs and related heterocyclic amines such as piperazines and N-amino alkyl-substituted piperazines are also included. Specific examples of such polyamines are ethylenediamine, triethylenetetramine, tris-(2-aminoethyl)amine, propylenediamine, trimethylenediamine, tripropylenetetramine, tetraethylenepentamine, hexaethyleneheptamine, pentaethylenehexamine, etc. Higher homologs obtained by condensing two or more of the above-noted alkyleneamines are similarly useful as are mixtures of two or more of the aforedescribed polyamines.

In one embodiment the polyamine is an ethylenepolyamine. Such polyamines are described in detail under the heading Ethylene Amines in Kirk Othmer's "Encyclopedia of Chemical Technology", 2d Edition, Vol. 7, pages 22-37, Interscience Publishers, New York (1965). Ethylenepolyamines are often a complex mixture of polyalkylenepolyamines including cyclic condensation products.

Other useful types of polyamine mixtures are those resulting from stripping of the above-described polyamine mixtures to leave, as residue, what is often termed "polyamine bottoms". In general, alkylenepolyamine bottoms can be characterized as having less than 2%, usually less than 1% (by weight) material boiling below about 200 C. A typical sample of such ethylene polyamine bottoms obtained from the Dow Chemical Company of Freeport, Tex. designated "E-100". These alkylenepolyamine bottoms include cyclic condensation products such as piperazine and higher analogs of diethylenetriamine, triethylenetetramine and the like. These alkylenepolyamine bottoms can be reacted solely with the acylating agent or they can be used with other amines, polyamines, or mixtures thereof. Another useful polyamine is a condensation reaction between at least one hydroxy compound with at least one polyamine reactant containing at least one primary or secondary amino group. The hydroxy compounds are preferably polyhydric alcohols and amines. The polyhydric alcohols are described below. (See carboxylic ester dispersants.) In one embodiment, the hydroxy compounds are polyhydric amines. Polyhydric amines include any of the above-described monoamines reacted with an alkylene oxide (e.g., ethylene oxide, propylene oxide, butylene oxide, etc.) having from two to about 20 carbon atoms, or from two to about four. Examples of polyhydric amines include tri-(hydroxypropyl)amine, tris-(hydroxymethyl) amino methane, 2-amino-2-methyl-1,3-propanediol, N,N,N', N'-tetrakis(2-hydroxypropyl)ethylenediamine, and N,N,N', N'-tetrakis(2-hydroxyethyl)ethylenediamine, preferably tris (hydroxymethyl)aminomethane (THAM).

Polyamines which react with the polyhydric alcohol or amine to form the condensation products or condensed amines, are described above. Preferred polyamines include triethylenetetramine (TETA), tetraethylenepentamine (TEPA), pentaethylenehexamine (PEHA), and mixtures of polyamines such as the above-described "amine bottoms".

Examples of extreme pressure additives include sulphur-based extreme pressure additives such as dialkyl sulphides, dibenzyl sulphide, dialkyl polysulphides, dibenzyl disulphide, alkyl mercaptans, dibenzothiophene and 2,2'-dithiobis (benzothiazole); phosphorus-based extreme pressure additives such as trialkyl phosphates, triaryl phosphates, trialkyl phosphonates, trialkyl phosphites, triaryl phosphites and dialkylhydrozine phosphites, and phosphorus- and sulphur-based extreme pressure additives such as zinc dialkyldithiophosphates, dialkylthiophosphoric acid, trialkyl thiophosphate esters, acidic thiophosphate esters and trialkyl trithiophosphates. These extreme pressure additives can be used individually or in the form of mixtures, conveniently in an amount within the range from 0.1 to 2 parts by weight, per 100 parts by weight of the base oil.

All the above can be performance enhanced using a variety of cobase stocks, alkylated naphthalene (AN), alkylated benzene (AB), alkylated diphenyloxide (ADPO), alkylated diphenylsulfide (ADPS), alkylated diphenylmethane (ADPM) and/or a variety of mono-basic, di-basic, and tribasic esters in conjunction with low sulfur, low aromatic, low iodine number, low bromine number, high analine point, isoparaffin.

When lubricating oil compositions contain one or more of the additives discussed above, the additive(s) are blended into the composition in an amount sufficient for it to perform its intended function. Typical amounts of such additives useful the present invention are shown in Table 3 below.

Note that many of the additives are shipped from the manufacturer and used with a certain amount of base oil solvent in the formulation. Accordingly, the weight amounts in the table below, as well as other amounts mentioned in this text, unless otherwise indicated are directed to the amount of active ingredient (that is the non-solvent portion of the ingredient). The wt % indicated below are based on the total weight of the lubricating oil composition.

TABLE 3

Typical Amounts of Various Lubricant Oil Components

| Compound | Approximate wt % (useful) | Approximate wt % (preferred) |
|---|---|---|
| EP Additives/Friction Modifiers | 0.01-15 | 0.01-5 |
| Antiwear Additives | 0.01-6 | 0.01-4 |
| Detergents | 0.01-8 | 0.01-4 |
| Dispersants | 0.1-20 | 0.1-8 |
| Antioxidants | 0.01-5 | 0.01-1.5 |
| Anti-foam Agents | 0.001-1 | 0.001-0.1 |
| Corrosion Inhibitors | 0.01-5 | 0.01-1.5 |
| Co-basestocks | 0-50 | 0-40 |
| Base Oils | Balance | Balance |

In an embodiment of the invention, the additive package comprises an S/P extreme pressure load carrying additive and a borated dispersant, and has a sulfur/phosphorous ratio of 13.2 to 19.8, with 16.2 typical. In addition, it has the following properties shown in Table 4:

TABLE 4

| Test | Units | Min | Typical | Max |
|---|---|---|---|---|
| Appearance | none | Amber Liquid | | |
| Specific Gravity 15.6° C./15.6° C. | none | 0.954 | 0.969 | 0.984 |
| Kinematic Viscosity 40° C. | cSt | 12 | 18.5 | 25 |
| Phosphorus | wt % | 1.26 | 1.4 | 1.54 |
| Sulfur | wt % | 20.4 | 22.7 | 25 |
| Boron | wt % | 0.19 | 0.24 | 0.29 |
| Nitrogen | wt % | 0.81 | 0.9 | 0.99 |

Lubricating compositions are prepared by blending together or admixing a first base stock component and a second base stock component. The first base stock component comprises one or more base stocks with a viscosity of over 40 cSt, Kv100° C. Each base stock has a molecular weight distribution less than 10 percent of equation 1. In a preferred embodiment the first base stock component comprises one or more metallocene catalyzed PAOs each with a viscosity of at least 40, cSt, Kv100° C. The second base stock component comprises one or more base stocks each with a viscosity of less than 10 cSt, Kv100° C., and preferably less than 6 cSt, Kv100° C., from the group consisting of Group I, Group II, Group III, Group IV, and Group V base stocks. In an embodiment, the second base stock component comprises at least one Poly-Alpha-Olefin (PAO) base stock and at least one Group III base stock, each having a viscosity less than 10 cSt, Kv100° C. The Group III base stock is highly paraffinic with saturates level greater than 90%, preferably greater than 95%; a viscosity is index greater than 120, preferably greater than 125, greater than 135 or greater than 140; very low aromatics of less than 3%, preferably less than 1%; and analine point of 118 or greater. Optionally, one or more additives are included.

In one embodiment, no VI improvers are needed due to the high inherent VI of the base stocks. This benefit permits the ability to avoid VI improvers that may adversely affect shear stability. In this embodiment, the shear stability of the lubricant should be less than 15 percent viscosity loss, as measured by CEC L-45-A-99/TRB at 20 hours, and even more preferably less than 10 percent and in the most preferred embodiment, there will be essentially no VI improvers.

In the lubricating compositions, the first base stock component can be used in an amount of up to about 80 wt % of the composition, up to about 70 wt % of the composition, up to about 60 wt % of the composition, up to about 50 wt % of the composition, up to about 40 wt % of the composition, up to about 30 wt % of the composition, up to about 20 wt % of the composition, or up to about 10 wt % of the composition. Additionally or alternately, the first base stock component can be used in an amount of from about 5 wt %, from about 10 wt % of the composition, or from about 20 wt % of the composition. Preferably, the first base to stock component is used in amount of from about 10 wt % of the composition to about 65 wt % of the composition.

In the lubricating compositions, the first base stock component can have a kinematic viscosity at 100° C. of from about 40 cSt to about 1000 cSt, from about 40 cSt to about 800 cSt, from about 40 cSt to about 500 cSt, from about 40 cSt to about 400 cSt, from about 40 cSt to about 300 cSt, from about 40 cSt to about 150 cSt, from about 40 cSt to about 135 cSt, or from about 40 cSt to about 80 cSt.

In the lubricating compositions, the second base stock component with a viscosity of less than 10 cSt, Kv100° C., can comprise Group I, Group II, Group III, Group IV, or Group V, or any combination of these base stocks. These base stocks, or combinations of these base stocks can be used in the lubricating compositions in amounts of up to about 90 wt % of the composition, up to about 80 wt % of the composition, up to about 70 wt % of the composition, up to about 60 wt % of the composition, up to about 50 wt % of the composition, or up to about 40 wt % of the composition. Additionally or alternately, these base stocks can be used in the lubricating compositions in amounts of at least about 20 wt % of the composition, at least about 30 wt % of the composition, at least about 40 wt % of the composition, at least about 50 wt % of the composition, at least about 60 wt % of the composition, at least about 70 wt % of the composition, or at least about 80 wt % of the composition. Preferably, these base stocks are used in amount of from about 20 wt % of the composition to about 85 wt % of the composition. In an embodiment, the lubricating compositions contain Group III base stock in an amount of at least 5 wt %, at least 10 wt %, or at least 20 wt % of the composition. Additionally or alternately, the lubricating compositions contain Group II base stock in an amount of no more than 50 wt %, 40 wt %, 30 wt %, 20 wt % or 10 wt % of the composition.

In the lubricating compositions, the Group I, Group II, Group III, Group IV and Group V base stocks of the second base stock component can have a kinematic viscosity at 100° C. of from about 2 cSt to about 10 cSt, from about 2 cSt to about 8 cSt, or from about 2 cSt to about 6 cSt.

The lubricating compositions have improved frictional properties, and thus, improved efficiency. Preferably, the average friction coefficient, as measured by the HFRR described below, of the lubricating compositions is less than about 0.12, less than about 0.11, less than about 0.10, less than about 0.09, less than about 0.08, or less than about 0.07.

The lubricating compositions have improved traction coefficients, as measured by the MTM, described below. Preferably, the traction coefficient of the lubricating compositions is less than about 0.040 at 60° C., less than about 0.035 at 80° C., less than about 0.030 at 100° C., or less than about 0.022 at 120° C.

The lubricating compositions have improved. Brookfield viscosity, as measured by ASTM D2983 at −40° C. Preferably, the Brookfield viscosity is less than about 40,000 mPa·s for lubricating compositions with a kinematic viscosity at 100° C. of between about 13.5 cSt and about 16.0. For lubricating compositions with a kinematic viscosity at 100° C. of less than about 13.5 cSt, preferably the Brookfield viscosity is less than about 23,000 mPa·s.

The lubricating compositions have improved air release time, as measured by ASTM D3427 at 50° C. Preferably, the time to 0.2% air is less than 10 minutes or less than 5 minutes, in this regard, also disclosed is a method of improving the air release of an SAE grade 75W-85 or 75W-90 automotive gear oil composition comprising obtaining a first base stock component comprising one or more base stocks each having a viscosity of at least 40 cSt, Kv100° C. and a molecular weight distribution (MWD) as a function of viscosity at least 10 percent less than algorithm: MWD=0.2223+1.0232*log (Kv at 100° C. in cSt), a second base stock component comprising one or more base stocks each having a viscosity less than 10 cSt, Kv100° C., and one or more additives, and admixing the first base stock component in the amount of 10 to 65 wt % of the gear oil composition, the second base stock component in the amount of 20 to 85 wt % of the gear oil composition, and the one or more additives, to form an SAE grade 75W-85 or 75W-90 automotive gear oil composition; wherein the gear oil composition provides improved air release time as measured by ASTM D3427 at 50° C. when compared to a composition of substantially the same kinematic viscosity at 100° C. and containing the same second base stock component and the same one or more additives, but which contains a conventional PIB viscosity modifier in place of the first base stock, in an amount adjusted along with the second base stock component to achieve substantially the same kinematic viscosity at 100° C. In a preferred embodiment, time first base stock component comprises one or more metallocene catalyzed PAOs.

The lubricating compositions also have improved foam collapse rate, as measured by ASTM D892. Preferably, the foam collapse rate is greater than 50 mL/min, more preferably greater than 350 ml/min. In this regard, also disclosed is a method of is improving the foam collapse of a gear oil composition by using a first base stock component comprising one or more base stocks each having a viscosity of at least 40 cSt and less than 150 cSt, Kv100° C. and a molecular weight distribution (MWD) as a function of viscosity at least 10 percent less than algorithm: MWD=0.2223+1.0232*log (Kv at 100° C. in cSt), as compared to a gear oil of substantially the same kinematic viscosity at 100° C. and containing the same second base stock component and same one or more additives, but which contains a first base stock component comprising one or more base stocks each having a viscosity of greater than 150, Kv100° C. and a molecular weight distribution (MWD) as a function of viscosity at least 10 percent less than algorithm: MWD=0.2223+1.0232*log (Kv at 100° C. in cSt) in an amount adjusted along with the second base stock component to achieve substantially the same kinematic viscosity at 100° C. Preferably, the first base stock component comprises one or more base stocks each having a viscosity of at least 40 cSt and less than 80 cSt, Kv100° C. and a molecular weight distribution (MWD) as a function of viscosity at least 10 percent less than algorithm: MWD=0.2223+1.0232*log (Kv at 100° C. in cSt).

The lubricating compositions have improved shear stability, as measured by CEC L-45-A-99/TRB at 40 hours. Preferably, the percentage viscosity loss is less than about 3.0%, less than about 2.5%, less than about 2.0%, less than about 1.5%. In this regard, also disclosed is a method of improving the shear stability of an SAE grade 75W-85 or 75W-90 automotive gear oil composition comprising obtaining a first base stock component comprising one or more base stocks each having a viscosity of at least 40 cSt and less than 150 cSt, Kv100° C. and a molecular weight distribution (MWD) as a function of viscosity at least 10 percent less than algorithm: MWD=0.2223+1.0232*log (10.7 at 100° C. in cSt), a second base stock component comprising one or more base stocks each having a viscosity less than 10 cSt, Kv100° C., and one or more additives; and admixing the first base stock component in the amount of 10 to 65 wt % of the gear oil composition, the second base stock component in the amount of 20 to 85 wt % of the gear oil composition, and the one or more additives, to form an SAE grade 75W-85 or 75W-90 automotive gear oil composition; wherein the lubricating composition provides improved shear stability as measured by CEC L-45-A-99/TRB at 40 hours, when compared to a composition of the substantially the same kinematic viscosity at 100° C. and containing the same second base stock component and one or more additives, but which contains a conventional PIB viscosity modifier in place of the first base stock component, in an amount adjusted along with the second base stock component to achieve the substantially the same kinematic viscosity at 100° C. Preferably, the first base stock component comprises one or more base stocks each having a viscosity of at least 40 cSt and less than 80 cSt, Kv100° C. and a molecular weight distribution (MWD) as a function of viscosity at least 10 percent less than algorithm: MWD 0.2223+1.0232*log (Kv at 100° C. in cSt). Also disclosed is a method of improving the shear stability of an SAE grade 75W-85 or 75W-90 automotive gear oil composition comprising obtaining a first base stock component comprising one or more base stocks each having a viscosity of at least 100 cSt and less than 250 cSt, 100° C. and a molecular weight distribution (MWD) as a function of viscosity at least 10 percent less than algorithm: MWD=0.2223+11.0232*log (Kv at 100° C. in cSt), a second base stock component comprising at least one Poly-Alpha-Olefin (PAO) base stock and at least one Group III base stock, each having a viscosity less than 10 cSt, Kv100° C., and one or more additives; and admixing the first base stock component in the amount of 10 to 65 wt % of the gear oil composition, the second base stock component in the amount of 20 to 85 wt % of the gear oil composition, and the one or more additives, to form an SAE grade 75W-85 or 75W-90 automotive gear oil composition; wherein the lubricating composition provides improved shear stability as measured by CEC L-45-A-99/TRB at 40 hours, when compared to a composition of the substantially the same kinematic viscosity at 100° C. and containing the same second base stock component and one or more additives, but which contains a conventional PIB viscosity modifier in place of the first base stock component, in an amount adjusted along with the second base stock component to achieve the substantially the same kinematic viscosity at 100° C.

The lubricating compositions have improved wear scar, as measured by ASTM4172, when comprising a first base stock component comprised of one or more base stocks each having a viscosity of at least 40 cSt and less than 150 cSt, Kv100° C. and a molecular weight distribution (MWD) as a function of viscosity at least 10 percent less than is algorithm: MWD=0.2223+1.0232*log (Kv at 100° C. in cSt), a second base stock component comprising one or more base stocks each having a viscosity less than 10 cSt, Kv100° C., and one or more additives, when compared to a composition of substantially the same kinematic viscosity at 100° C. and containing the same second base stock component and the same one or more additives, but which contains a first base stock component comprising one or more base stocks each having a viscosity of 150 cSt or greater, Kv100° C. and a molecular weight distribution (MWD) as a function of viscosity at least 10 percent less than algorithm: MWD=0.2223+1.0232*log (Kv at 100° C. in cSt), in an amount adjusted along with the second base stock component to achieve substantially the same kinematic viscosity at 100° C. Preferably, the first base stock component comprises one or more base stocks each having a viscosity of at least 0.40 cSt and less than 80 cSt, Kv100° C. and a molecular weight distribution (MWD) as a function of viscosity at least 10 percent less than algorithm: MWD=0.2223+1.0232*log (Kv at 100° C. in cSt).

The lubricating compositions have improved load wear index, as measured by ASTM2783, when comprising a first base stock component comprised of one or more base stocks each having a viscosity of at least 40 cSt and less than 150 cSt, Kv100° C. and a molecular weight distribution (MWD) as a function of viscosity at least 10 percent less than algorithm: MWD 0.2223+1.0232*log (Kv at 100° C. in cSt), a second base stock component comprising one or more base stocks each having a viscosity less than 10 cSt, Kv100° C., and one or more additives, when compared to a composition of substantially the same kinematic viscosity at 100° C. and containing the same second base stock component and the same one or more additives, but which contains a first base stock component comprising one or more base stocks each having a viscosity of 150 cSt or greater, Kv100° C. and a molecular weight distribution (MWD) as a function of viscosity at least 110 percent less than algorithm: MWD=0.2223+1.0232*log (Kv at 100° C. in cSt), in an amount adjusted along with the second base stock component to achieve substantially the same kinematic viscosity at 100° C. Preferably, the first base stock component comprises one or more base stocks each having a viscosity of at least 40 cSt and less than 80 cSt, Kv100° C. and a molecular weight distribution (MWD) as a function of viscosity at least 10 percent less than algorithm: MWD=0.2223+1.0232*log (Kv at 100° C. in cSt).

In a preferred embodiment, the lubricating compositions are formulated to be automotive gear oils. Viscosity grades for automotive gear oils are defined by the Society of Automotive Engineers (SAE) specification SAE J306 (January 2005) as follows in Table 5:

TABLE 5

Automotive Lubricant Viscosity Grades
Gear Oils - Except SAE J 306, 1998

| SAE Viscosity Grade | Maximum Temperature for a viscosity of 150,000 cP (° C.) ASTM D 2983 | Minimum Viscosity at (cSt) a 100° C. ASTM D 445 | Maximum Viscosity at (cSt) a 100° C. ASTM D 445 |
|---|---|---|---|
| 70W | −55 | 4.1 | — |
| 75W | −40 | 4.1 | — |
| 80W | −26 | 7 | — |
| 85W | −12 | 11 | — |
| 80 | — | 7 | <11.0 |
| 85 | — | 11 | <13.5 |
| 90 | — | 13.5 | <18.5 |
| 110 | — | 18.5 | <24.0 |
| 140 | — | 24 | <32.5 |
| 190 | — | 32.5 | <41.0 |
| 250 | — | 41 | — |

In a preferred embodiment, the lubricating compositions are formulated to be 70W-80, 75W-80, 75W-85, 75W-90 or 75W-110 viscosity grades, in accordance with the SAE viscosity grades in Table 5. More preferably, the lubricating compositions are formulated to be 75W-85 or 75W-90 SAE viscosity grades.

The kinematic viscosities at 1100° C. of the lubricating compositions were measured according to the ASTM D445 standard. Preferably, the lubricating compositions have a kinematic viscosity at 100° C. of from about 6 cSt to about 25 cSt, from about 7 cSt to about 24 cSt, from about 7 cSt to about 19 cSt, from about 7 cSt to about 14 cSt, from about 11 cSt to about 19 cSt, or from about 11 cSt to about 24 cSt.

The invention will now be more particularly described with reference to the following non-limiting Examples.

EXAMPLES

Studies were conducted to demonstrate the improved properties of the inventive lubricating oils. More specifically, a number of automotive gear oil formulations were prepared and tested for viscometric properties, including kinematic viscosity, viscosity index (VI), shear stability and Brookfield viscosity. In addition, the formulations were tested for friction, traction, wear, load carrying, air release, and foam properties. Where applicable, the ASTM or CEC methods indicated in the data tables below were used.

The traction coefficients were measured employing the MTM Traction Rig which is a fully automated Mini Traction Machine traction measurement instrument. The rig to is manufactured by PCS Instruments and identified as Model MTM. The test specimens and apparatus configuration are such that realistic pressures, temperatures and speeds can be attained without requiring very large loads, motors or structures. A small sample of fluid (50 ml) is placed in the test cell and the machine automatically runs through a range of speeds, slide-to-roll ratios, temperatures and loads to produce a comprehensive traction map for the test fluid without operational intervention. The standard test specimens are a polished 19.05 mm ball and a 50.0 mm diameter disc manufactured from AISI 52100 bearing steel. The specimens are designed to be single use, throw away items. The ball is loaded against the face of the disc and the ball and disc are driven independently by DC servo motors and drives to allow high precision speed control, particularly at low slide/roil ratios. Each specimen is end mounted on shafts in a small stainless steel test fluid bath. The vertical shaft and drive system which supports the disk test specimen is fixed. However, the shaft and drive system which supports the ball test specimen is supported by a gimbal arrangement such that it can rotate around two orthogonal axes. One axis is normal to the load application direction, the other to the traction force direction. The ball and disk are driven in the same direction. Application of the load and restraint of the traction force is made through high stiffness force transducers appropriately mounted in the gimbal arrangement to minimize the overall support system deflections. The output from these force transducers is monitored directly by a personal computer. The traction coefficient is the ratio of the traction force to the applied load. As shown in the Tables below, the traction coefficient was measured over a range of temperatures.

Average friction coefficients and average wear scars can be measured by a High Frequency Reciprocating Rig (HFRR) test. The HFRR is manufactured by PCS Instruments and identified as model HFR2 (AutoHFRR). The test equipment and procedure are similar to the ASTM D6079 method except the test oil temperature is raised from 32° C. to 195° C. at 2° C./minute, 400 g load, 60 Hz frequency, and 0.5 mm stroke length.

Metallocene Catalyzed PAOs (mPAOs)

In the following Examples, metallocene catalyzed PAO (mPAO) basestocks with the properties shown in Table 6 were used:

TABLE 6

| | mPAO65 | mPAO150 | mPAO300 | mPAO450 | mPAO700 |
|---|---|---|---|---|---|
| Feed LAO | C6, 10, 14 (25/60/15%) | C6, 10, 14 (25/60/15%) | C6, 10, 14 (25/60/15%) | C6, 10, 14 (25/60/15%) | C6, 10, 14 (25/60/15%) |
| KV100° C. (ASTM D445, cSt) | 66.1 | 149 | 326 | 439 | 692 |
| KV40° C. (ASTM D445, cSt) | 637.9 | 1618 | 3873 | 5348 | 8731 |
| VI | 177 | 204 | 238 | 253 | 298 |
| Pour Point, (° C.) | −45 | −36 | −33 | −30 | −27 |
| MWD | 1.47 | 1.69 | 1.89 | 1.91 | 2.10 |

Example 1

A study was conducted to demonstrate the advantages of the inventive bi-modal blends over commercial gear oils with conventional viscosity modifiers.

For comparison, two automotive gear oil compositions were formulated with the compositions shown in Table 7. Both blends contained the same commercial automotive gear oil additive package and defoamant.

Oil 1 (comparative) is a commercial 75W-90 synthetic automotive gear oil comprising PAO6 (PAO with a kinematic viscosity of 6 cSt at 100° C.), a conventional polyisobutylene (PIB) modifier, an automotive gear oil additive package, and a defoamant.

Oil 2 (of the invention) comprises PAO4 (PAO with a kinematic viscosity of 4 cSt at 100° C.), metallocene catalyzed PAO base stock with a viscosity of 150 cSt, Kv100° C., and the same additive package and defoamant as Oil 1.

Table 7 shows the viscometric, load, wear, friction, traction, air release and foaming properties of the two blends.

As shown in Table 7, Oil 2 (which contains the metallocene catalyzed base stock), demonstrates a number of superior properties over the conventional Oil 1 (which to includes a conventional PIB viscosity modifier), including: shear stability, Brookfield viscosity, last non-seizure load, load wear index, friction coefficient and traction coefficient. In addition, Oil 2 demonstrates superior air release and no foaming tendency.

TABLE 7

| | Oil 1 Commercial Synthetic Gear Oil (75W-90) | Oil 2 (75W-90) |
|---|---|---|
| **Component** | | |
| PAO6 (wt %) | 67.3 | |
| PAO4 (wt %) | | 53.76 |
| Viscosity Modifier (wt %) | 22.6 | |
| mPAO150 (wt %) | | 36.14 |
| Additive Package (wt %) | 10 | 10 |
| Defoamant (wt %) | 0.1 | 0.1 |
| Total (wt %) | 100 | 100 |
| **Properties** | | |
| Kinematic Viscosity, 100° C. (ASTM D445, mm2/s) | 14.0 | 14.0 |
| Kinematic Viscosity, 40° C. (ASTM D445, mm2/s) | 97.18 | 82.58 |
| Viscosity Index | 147 | 176 |
| Apparent Viscosity (ASTM D4683, Cp) | 4.33 | 4.50 |
| Shear Stability (CEC L-45-A-99/Taper Roller Bearing 40 hr, viscosity loss %) | 3.8 | 1.3 |
| Brookfield Viscosity (ASTM D2983, −40° C., mPA · s) | 65100 | 26200 |
| Last Non-Seizure Load (4-Ball EP) (ASTM D2783, kg) | 63 | 80 |
| Weld Load (4-Ball EP) (ASTM D2783, kg) | 315 | 315 |
| Load Wear Index (4-Ball EP) (ASTM D2783, kg) | 16.6 | 23.7 |
| Wear Scar Diameter (4-Ball EP) (ASTM D4172, mm) | 0.845 | 0.820 |
| HFRR Average Wear Scar (microns) | 193 | 209 |
| HFRR Average Friction Coefficient | 0.117 | 0.104 |
| MTM Traction Coefficient (1.25 GPa, SRR at 30%, 60° C., speed = 2.00 m/s) | 0.04589 | 0.03682 |
| MTM Traction Coefficient (1.25 GPa, SRR at 30%, 80° C., speed = 2.00 m/s) | 0.03948 | 0.03039 |
| MTM Traction Coefficient (1.25 GPa, SRR at 30%, 100° C., speed = 2.00 m/s) | 0.03275 | 0.02426 |
| MTM Traction Coefficient (1.25 GPa, SRR at 30%, 120° C., speed = 2.00 m/s) | 0.02659 | 0.01889 |
| Air Release Time to 0.2% air (ASTM D3427, 50° C., minutes) | 23.1 | 3.82 |
| Foaming Tendency, SEQ 2 (ASTM D892, mL) | 50 | 0 |
| Foaming Collapse Time, SEQ2 (ASTM D892, minutes) | 0.5 | 0 |
| Foaming Collapse Rate, SEQ2 (ASTM D892, mL/minute) | 100 | 0 |
| Foam Stability, SEQ 2 (ASTM D892, mL) | 0 | 0 |

Example 2

Another study was conducted to further demonstrate the advantages of the inventive bi-modal blends over commercial gear oils using conventional viscosity modifiers.

For comparison, nine automotive gear oil compositions were formulated with the compositions shown in Table 8, All blends contained the same commercial automotive gear oil additive package and defoamant.

Oils 3, 4 and 5 (comparatives) comprised PAO4 in amounts of 72.9 wt %, 69.9 wt % and 64.9 wt %, a conventional polyisobutylene (PIB) viscosity modifier in amounts of 17 wt %, 20 wt % and 25 wt %, an automotive gear oil additive package, and a defoamant.

Oils 6, 7 and 8 (of the invention) comprised PAO4 in amounts of 57.9 wt %, 48.9 wt % and 41.4 wt %, metallocene catalyzed PAO base stock with a viscosity of 65 cSt, Kv100°

C. in amounts of 32 wt %, 41 wt % and 48.5 wt %, and the same additive package and defoamant as Oils 3, 4 and 5.

Oils 9, 10 and 11 (of the invention) comprised PAC 4 in amounts of 64.9 wt %, 59.9 wt % and 53.76 wt %, metallocene catalyzed PAO base stock with a viscosity of 150 cSt, Kv100° C. in amounts of 25 wt %, 30 wt % and 36.14 wt %, and the same additive package and defoamant as Oils 3, 4, 5, 6, 7 and 8.

Table 8 shows the viscometric, load, wear, friction, traction and lube film protection properties of the various blends.

As shown in Table 8, Oils 6-11 (which contain the metallocene catalyzed base stock), demonstrate superior properties over the conventional Oils 3-5 (which include conventional PIB viscosity modifiers) with comparable kinematic viscosities at 100° C., including: Brookfield viscosity, friction coefficient and traction coefficient. In addition, Oils 6-8 (which contain 65 cSt mPAO) demonstrate lower wear scars over Oils 3-5 and Oils 9-11, at comparable kinematic viscosities at 100° C.

Example 3

A study was conducted to demonstrate the further advantages of the inventive bi-modal blends containing 65 cSt mPAO as the high-viscosity basestock component over inventive blends containing 300, 450 and 700 cSt mPAO as the high-viscosity basestock component.

For comparison, 14 automotive gear oil compositions were formulated with the compositions shown in Table 9. All blends contained the same commercial automotive gear oil additive package and defoamant.

Oils 12, 13, 14 and 15 comprised PAO4 in amounts of 59.9 wt %, 49.9 wt %, 39.9 wt % and 29.9 wt %, metallocene catalyzed PAO base stock with a viscosity of 65 cSt, Kv100° C. in amounts of 30 wt %, 40 wt %, 50 wt % and 60 wt %, an automotive gear oil additive package, and a defoamant.

Oils 16, 17 and 18 comprised PAO4 in amounts of 69.9 wt %, 64.9 wt % and 59.9 wt %, metallocene catalyzed PAO base stock with a viscosity of 300 cSt, Kv100° C. in amounts of 20

TABLE 8

| | Oil 3 | Oil 4 | Oil 5 | Oil 6 | Oil 7 | Oil 8 | Oil 9 | Oil 10 | Oil 11 |
|---|---|---|---|---|---|---|---|---|---|
| | | | | Component | | | | | |
| PAO4 | 72.9 | 69.9 | 64.9 | 57.9 | 48.9 | 41.4 | 64.9 | 59.9 | 53.76 |
| Viscosity Modifier | 17 | 20 | 25 | | | | | | |
| mPAO65 | | | | 32 | 41 | 48.5 | | | |
| mPAO150 | | | | | | | 25 | 30 | 36.14 |
| Additive Package | 10 | 10 | 10 | 10 | 10 | 10 | 10 | 10 | 10 |
| Defoamant | 0.1 | 0.1 | 0.1 | 0.1 | 0.1 | 0.1 | 0.1 | 0.1 | 0.1 |
| Total | 100 | 100 | 100 | 100 | 100 | 100 | 100 | 100 | 100 |
| | | | | Properties | | | | | |
| SAE Grade | 75W-80 | 75W-80 | 75W-90 | 75W-80 | 75W-85 | 75W-90 | 75W-80 | 75W-85 | 75W-90 |
| Kinematic Viscosity, 100° C. (ASTM D445, mm2/s) | 9.66 | | 13.9 | 9.08 | 11.54 | 14.13 | 9.492 | 11.23 | 13.89 |
| Kinematic Viscosity, 40° C. (ASTM D445 mm2/s) | 47.62 | 56.9 | 76.19 | 49.89 | 67.65 | 87.8 | 51.17 | 63.02 | 82.08 |
| Viscosity Index | 193 | | 189 | 165 | 166 | 166 | 172 | 173 | 175 |
| Kinematic Viscosity, 100° C. (ASTM D7279, mm2/s) | | 9.764 | | | | | | | |
| Kinematic Viscosity. 40° C. (ASTM D7279, mm2/s) | | 57.17 | | | | | | | |
| Brookfield Viscosity (ASTM D2983, −40° C., mPA · s) | 16600 | 23150 | 43350 | 13360 | 21500 | 32650 | 12860 | 17180 | 26300 |
| Last Non-Seizure Load (4-Ball EP) (ASTM D2783, kg) | 100 | 126 | 126 | 100 | 126 | 100 | 100 | 126 | 100 |
| Weld Load (4-Ball EP) (ASTM D2783, kg) | 800 | 800 | 800 | 800 | 800 | 800 | 800 | 800 | 800 |
| Load Wear Index (4-Ball EP) (ASTM D2783, kg) | 102.3 | 104 | 115.2 | 105.8 | 101.7 | 101.9 | 99.1 | 109.1 | 106.5 |
| Wear Scar Diameter (4-Ball EP) (ASTM D4172, mm) | 0.819 | 0.825 | 0.826 | 0.783 | 0.751 | 0.695 | 0.858 | 0.88 | 0.853 |
| HFRR Average Wear Scar (microns) | 196 | 200 | 191 | 212 | 201 | 185 | 214 | 225 | 214 |
| HFRR Average Friction Coefficient | 0.096 | 0.094 | 0.086 | 0.093 | 0.085 | 0.08 | 0.052 | 0.057 | 0.044 |
| HFRR Average Wear Scar (microns) (repeat) | | | | | 204 | | | | |
| HFRR Average Friction Coefficient (repeat) | | | | | 0.084 | | | | |
| MTM Traction Coefficient (1.25 GPa, SRR at 30%, 60° C., speed = 2.0 m/s) | | | 0.04454 | | | 0.03752 | | | 0.03519 |
| MTM Traction Coefficient (1.25 GPa, SRR at 30%, 80° C., speed = 2.0 m/s) | | | 0.03773 | | | 0.03106 | | | 0.02867 |
| MTM Traction Coefficient (1.25 GPa, SRR at 30%, 100° C., speed = 2.0 m/s) | | | 0.03097 | | | 0.02507 | | | 0.02271 |
| MTM Traction Coefficient (1.25 GPa, SRR at 30%, 120° C., speed = 2.0 m/s) | | | 0.02452 | | | 0.01922 | | | 0.01757 |

wt %, 25 wt % and 30 wt %, and the same additive package and defoamant as Oils 12, 13, 14 and 15.

Oils 19, 20, 21 and 22 comprised PAO4 in amounts of 74.9 wt %, 69.9 wt %, 64.9 wt % and 59.9 wt %, metallocene catalyzed PAO base stock with a viscosity of 450 cSt, Kv100° C. in amounts of 15 wt %, 20 wt %, 25 wt % and 30 wt %, and the same additive package and defoamant as Oils 12-18.

Oils 23, 24 and 25 comprised PAO4 in amounts of 79.9 wt %, 74.9 wt % and 69.9 wt %, metallocene catalyzed PAO base stock with a viscosity of 700 cSt, Kv100° C. in amounts of 10 wt %, 15 wt % and 20 wt %, and the same additive package and defoamant as Oils 12-22.

Table 9 shows the viscometric, load, wear, friction, traction and lube film protection properties of the various blends.

As shown in Table 9, Oils 12-15 (which contain the 65 cSt mPAO), demonstrate superior properties over Oils 16-25 (which include mPAOs of 300 cSt, 450 cSt and 700 cSt) at comparable kinematic viscosities at 100° C., including: shear stability, load wear index, wear scar, friction coefficient, air release and foam collapse rate.

Figure 3:
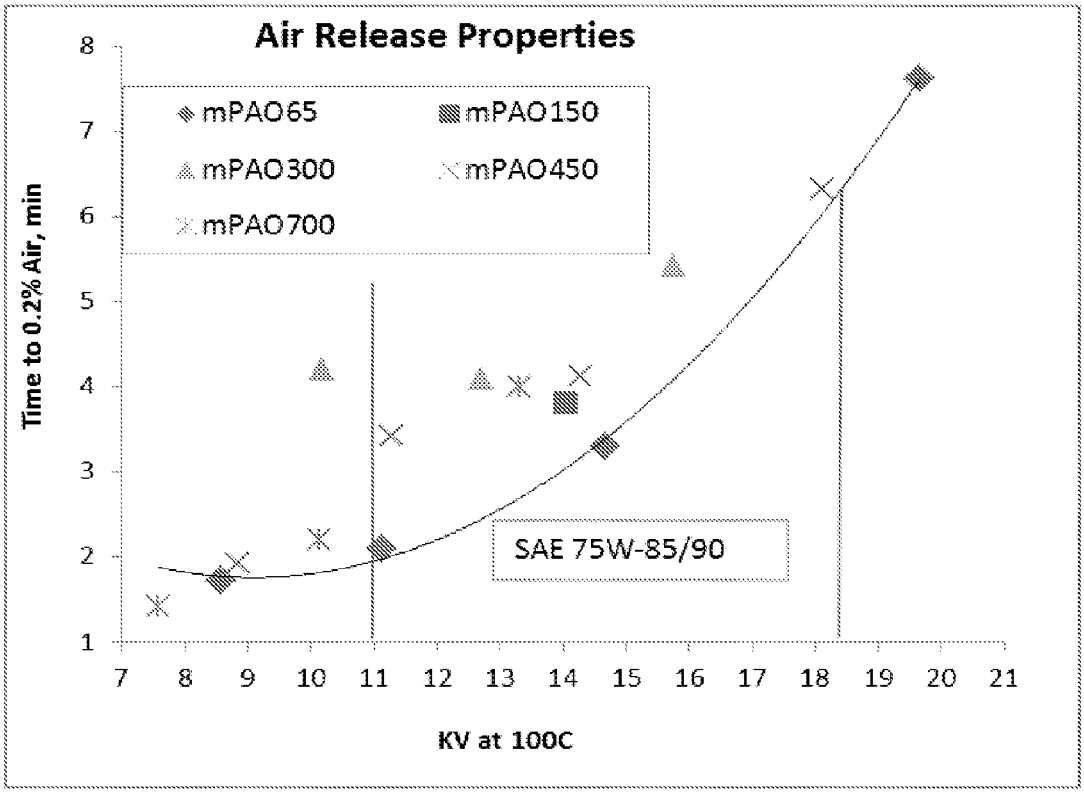
FIG. 3 is a graph illustrating the improved air release of lubricating compositions containing metallocene catalyzed PAO base stocks.

FIG. 3 illustrates the improved air release of lubricating compositions containing 65 cSt metallocene catalyzed PAO, as compared to lubricating compositions containing mPAO 150-mPAO 700. This is demonstrated in particular with respect to SAE grade 75W-85 and 75W-90 automotive gear oils.

Figure 4:
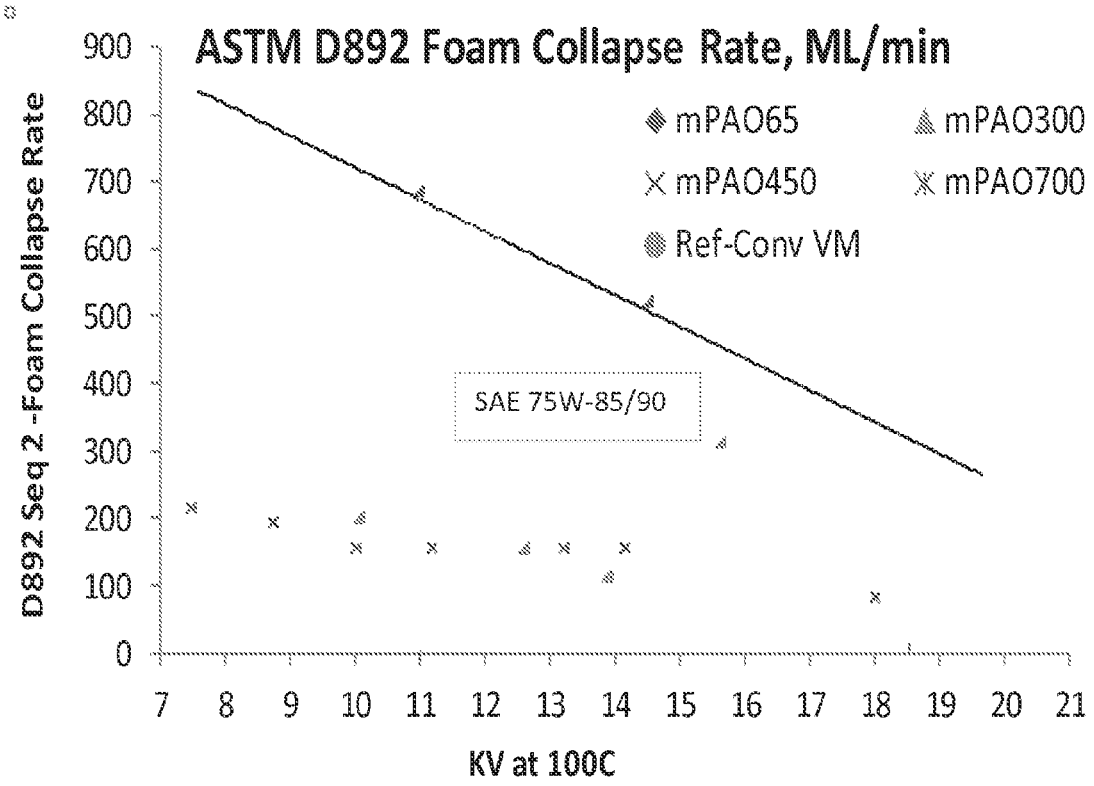
FIG. 4 is a graph illustrating the improved foam collapse rate of lubricating compositions containing 65 cSt, Kv100, metallocene catalyzed PAO.

FIG. 4 illustrates the improved foam collapse rate of lubricating to compositions containing 65 cSt metallocene catalyzed PAO, as compared to lubricating compositions containing mPAO 300-mPAO 700. This is demonstrated in particular with respect to SAE grade 75W-85 and 75W-90 automotive gear oils.

Figure 5:
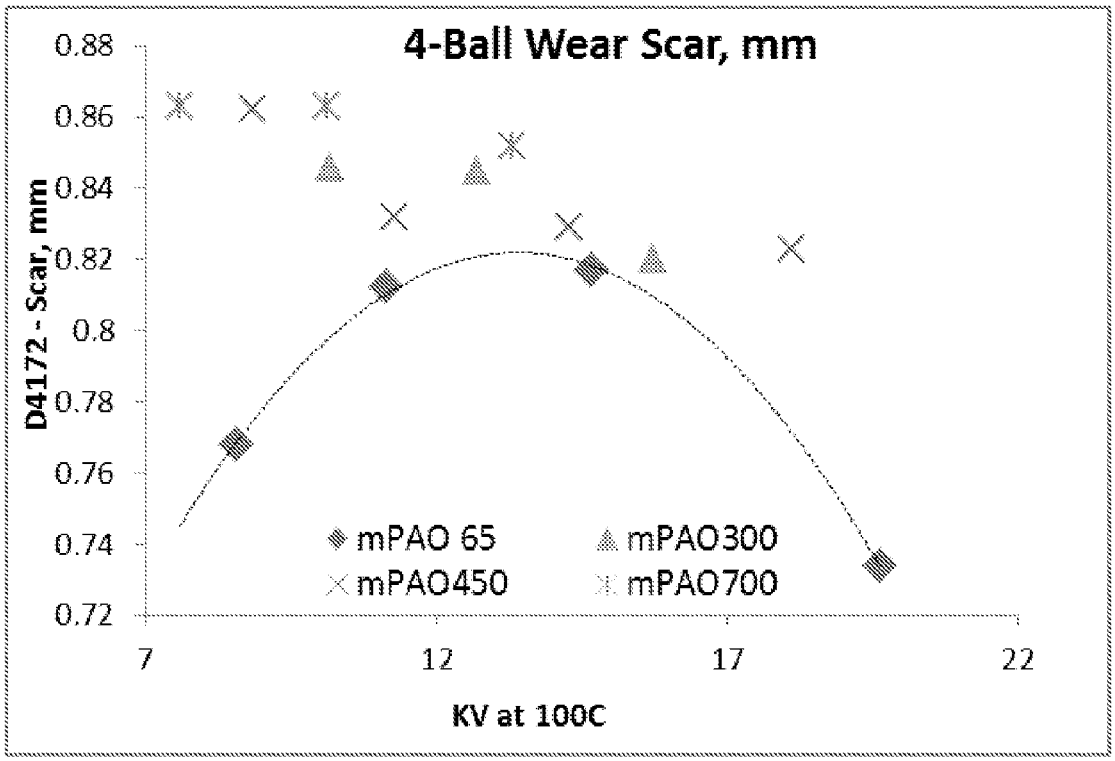
FIG. 5 is a graph illustrating the improved 4-Ball wear scar of lubricating compositions containing 65 cSt, Kv100, metallocene catalyzed PAO.

FIG. 5 illustrates the improved 4-Ball wear scar of lubricating compositions containing 65 cSt metallocene catalyzed PAO, as compared to lubricating compositions containing mPAO 300-mPAO 700.

Figure 6:
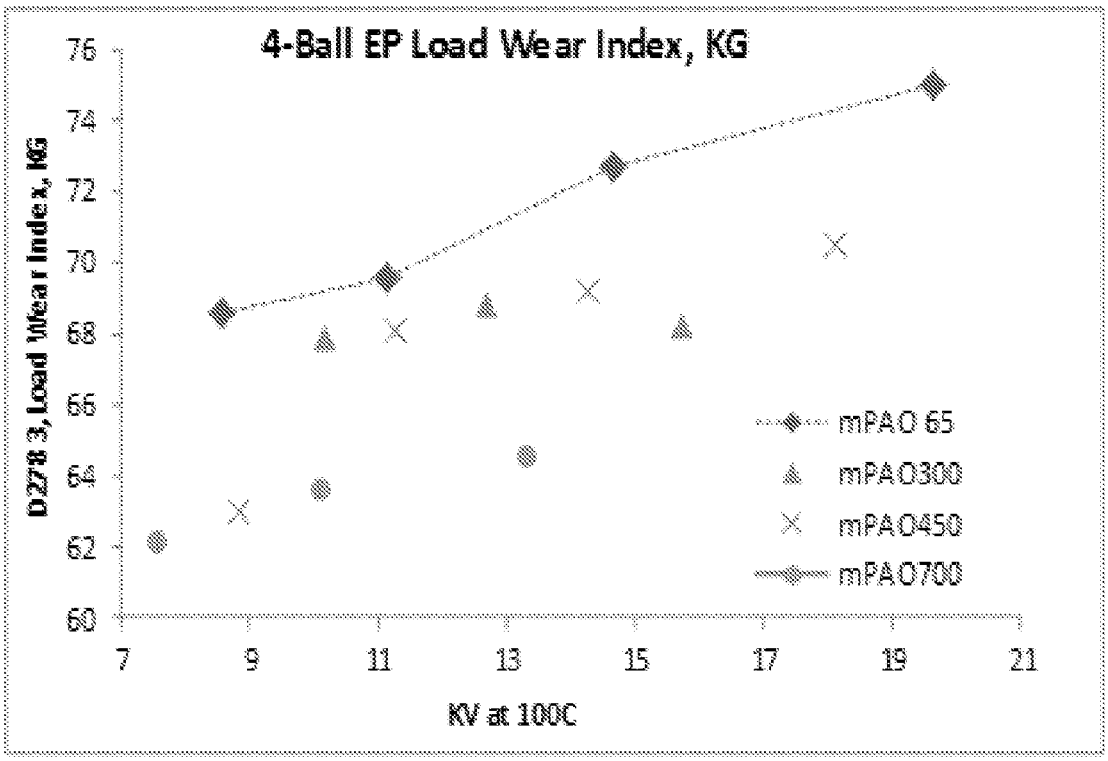
FIG. 6 is a graph illustrating the improved 4-Ball EP load wear index of lubricating compositions containing 65 cSt, Kv100, metallocene catalyzed PAO.

FIG. 6 illustrates the improved 4-Ball EP load wear index of lubricating compositions containing 65 cSt metallocene catalyzed. PAO, as compared to lubricating compositions containing mPAO 300-mPAO 700.

TABLE 9

| | Oil 12 | Oil 13 | Oil 14 | Oil 15 | Oil 16 | Oil 17 | Oil 18 |
|---|---|---|---|---|---|---|---|
| | | | Component | | | | |
| PAO4 (wt %) | 59.9 | 49.9 | 39.9 | 29.9 | 69.9 | 64.9 | 59.9 |
| mPAO 65 (wt %) | 30 | 40 | 50 | 60 | | | |
| mPAO 300 (wt %) | | | | | 20 | 25 | 30 |
| mPAO 450 (wt %) | | | | | | | |
| mPAO 700 (wt %) | | | | | | | |
| Additive Package (wt %) | 10 | 10 | 10 | 10 | 10 | 10 | 10 |
| Defoamant (wt %) | 0.1 | 0.1 | 0.1 | 0.1 | 0.1 | 0.1 | 0.1 |
| Total (wt %) | 100 | 100 | 100 | 100 | 100 | 100 | 100 |
| | | | Properties | | | | |
| SAE Grade | 70W-80 | 75W-85 | 75W-90 | 75W-110 | 75W-80 | 75W-85 | 75W-90 |
| Kinematic Viscosity, 100° C. (ASTM D445, mm2/s) | 8.565 | 11.13 | 14.66 | 19.64 | 10.18 | 12.69 | 15.74 |
| Kinematic Viscosity, 40° C. (ASTM D445, mm2/s) | 46.53 | 64.66 | 92.06 | 133.4 | 53.43 | 69.97 | 90.72 |
| Apparent Viscosity (TRB, HTHS150 C, cP) | 2.94 | 3.68 | 4.646 | 5.987 | 3.411 | 4.159 | 5.076 |
| Shear Stability (CEC L-45-A-99/Taper Roller Bearing 40 hr, viscosity loss %) | | 0.4 | −0.7 | | | 6.6 | |
| Brookfield Viscosity (ASTM D2983, −40° C., mPA · s) | 11140 | 19080 | 34050 | 65000 | 12020 | 17920 | 25200 |
| Last Non-Seizure Load (4-Ball EP) (ASTM D2783, kg) | 100 | 126 | 126 | 126 | 126 | 126 | 126 |
| Weld Load (4-Ball EP) (ASTM D2783, kg) | 400 | 400 | 400 | 400 | 400 | 400 | 400 |
| Load Wear Index (4-Ball EP) (ASTM D2783, kg) | 68.6 | 69.6 | 72.7 | 75 | 67.9 | 68.8 | 68.2 |
| Wear Scar Diameter (4-Ball EP) (ASTM D4172, mm) | 0.768 | 0.812 | 0.817 | 0.734 | 0.846 | 0.845 | 0.82 |
| HFRR Average Wear Scar (microns) | 201 | 199 | 184 | 169 | 217 | 213 | 191 |
| HFRR Average Friction Coefficient | 0.111 | 0.091 | 0.087 | 0.081 | 0.095 | 0.093 | 0.095 |
| Air Release Time to 0.2% air (ASTM D3427, 50° C., minutes) | 1.72 | 2.1 | 3.3 | 7.6 | 4.2 | 4.1 | 5.42 |
| Foaming Tendency, SEQ 2 (ASTM D892, mL) | | 20 | 20 | | 30 | 10 | 15 |
| Foam Collapse Time, SEQ 2 (ASTM D892, minutes) | | 0.03 | 0.04 | | 0.16 | 0.07 | 0.05 |

TABLE 9-continued

| | | | | | | | |
|---|---|---|---|---|---|---|---|
| Foam Collapse Rate, SEQ2 (ASTM D892, mL/min) | | 667 | 500 | | 188 | 143 | 300 |
| Foam Stability, SEQ 2 (ASTM D892, mL) | | 0 | 0 | | 0 | 0 | 0 |

| | Oil 19 | Oil 20 | Oil 21 | Oil 22 | Oil 23 | Oil 24 | Oil 25 |
|---|---|---|---|---|---|---|---|
| Component | | | | | | | |
| PAO4 (wt %) | 74.9 | 69.9 | 64.9 | 59.9 | 79.9 | 74.9 | 69.9 |
| mPAO 65 (wt %) | | | | | | | |
| mPAO 300 (wt %) | | | | | | | |
| mPAO 450 (wt %) | 15 | 20 | 25 | 30 | | | |
| mPAO 700 (wt %) | | | | | 10 | 15 | 20 |
| Additive Package (wt %) | 10 | 10 | 10 | 10 | 10 | 10 | 10 |
| Defoamant (wt %) | 0.1 | 0.1 | 0.1 | 0.1 | 0.1 | 0.1 | 0.1 |
| Total (wt %) | 100 | 100 | 100 | 100 | 100 | 100 | 100 |
| Properties | | | | | | | |
| SAE Grade | 70W-80 | 75W-85 | 75W-90 | 75W-90 | 70W-80 | 70W-80 | 75W-85 |
| Kinematic Viscosity, 100° C. (ASTM D445, mm2/s) | 8.831 | 11.28 | 14.27 | 18.12 | 7.584 | 10.12 | 13.32 |
| Kinematic Viscosity, 40° C. (ASTM D445, mm2/s) | 44.95 | 60.03 | 79.4 | 105.2 | 37.21 | 51.84 | 71.54 |
| Apparent Viscosity (TRB, HTHS150 C, cP) | 3.026 | 3.787 | 4.668 | 5.784 | 2.638 | 3.406 | 4.378 |
| Shear Stability (CEC L-45-A-99/Taper Roller Bearing 40 hr, viscosity loss %) | | | | | | | 10.4 |
| Brookfield Viscosity (ASTM D2983, −40° C., mPA · s) | 9010 | 13720 | 20500 | 32450 | 6750 | 10900 | 17320 |
| Last Non-Seizure Load (4-Ball EP) (ASTM D2783, kg) | 100 | 126 | 126 | 126 | 100 | 100 | 100 |
| Weld Load (4-Ball EP) (ASTM D2783, kg) | 400 | 400 | 400 | 400 | 400 | 400 | 400 |
| Load Wear Index (4-Ball EP) (ASTM D2783, kg) | 63 | 68.1 | 69.2 | 70.5 | 62.1 | 63.6 | 64.5 |
| Wear Scar Diameter (4-Ball EP) (ASTM D4172, mm) | 0.862 | 0.832 | 0.829 | 0.823 | 0.863 | 0.863 | 0.852 |
| HFRR Average Wear Scar (microns) | 210 | 209 | 208 | 198 | 217 | 221 | 197 |
| HFRR Average Friction Coefficient | 0.097 | 0.09 | 0.095 | 0.095 | 0.104 | 0.099 | 0.099 |
| Air Release Time to 0.2% air (ASTM D3427, 50° C., minutes) | 1.92 | 3.42 | 4.12 | 6.32 | 1.42 | 2.2 | 4 |
| Foaming Tendency, SEQ 2 (ASTM D892, mL) | 25 | 30 | 20 | 10 | 20 | 30 | 20 |
| Foam Collapse Time, SEQ 2 (ASTM D892, minutes) | 0.14 | 0.21 | 0.14 | 0.15 | 0.1 | 0.21 | 0.14 |
| Foam Collapse Rate, SEQ2 (ASTM D892, mL/min) | 179 | 143 | 143 | 67 | 200 | 143 | 143 |
| Foam Stability, SEQ 2 (ASTM D892, mL) | 0 | 0 | 0 | 0 | 0 | 0 | 0 |

Example 4

A study was conducted to demonstate the advantages of the inventive bi-modal blends containing 150 cSt mPAO as the high-viscosity basestock component and a combination of PAO and Group III base stocks as the low viscosity second basestock component over gear oils using conventional PIB viscosity modifiers.

For comparison, six automotive gear oil compositions were formulated with the compositions shown in Table 10. Oils 26 and 27 each contained the same commercial automotive gear oil additive package in the amount of 10 wt %. Oils 28, 29, 30 and 31 each contained the same commercial automotive gear oil additive package in the amount of 14.65 wt %. Oils 26-31 each contained the same antifoam additive in the amount of 0.2 wt %. These blends were compared to two commercially available automotive gear oil compositions that use conventional PIB-type viscosity modifiers (Comparative Oils 32 and 33).

Inventive Oils 26, 27, 28 and 29 were formulated to be SAE grade 75W-85 and comprised Group III base stock (VISOM 6 and/or VISOM 4) in amounts of 20 wt %, 18.8 wt %, 7 wt % and 27 wt %, respectively; PAO4 in amounts of 44.8 wt %, 42.5 wt %, 53.65 wt %, and 33.65 wt %, respectively; metallocene catalyzed PAO base stock with a viscosity 150 cSt, Kv100° C. in amounts of 23.5 wt %, 24.5 wt % and 24.5 wt %, respectively; an antifoam additive; and an automotive gear oil additive package. Oil 27 also included 5 wt % ester.

Inventive Oils 30 and 31 were formulated to be SAE grade 75W-90 and comprised Group III base stock (VISOM 6) in the amount of 7 wt %, PAO4 in amounts of 48.15 wt % and 43.15 wt %, metallocene catalyzed PAO base stock with a viscosity of 150 cSt, Kv100° C. in amounts of 30 wt % and 35 wt %, and the same antifoam additive and additive package as Oils 28 and 29.

Comparative Oils 32 and 33 were commercially available automotive gear oils containing PIB-type viscosity modifiers.

Table 10 shows the viscometric and traction properties of the various blends.

As shown in Table 10, Oils 26-31 (which contain the 150 cSt mPAO), demonstrate superior properties over Oils 32 and 33 (which contain PIB-type viscosity modifiers) at comparable kinematic viscosities at 100° C., including: viscosity index, Brookfield viscosity, shear stability, traction coefficient and Noack volatility.

TABLE 10

| | Inventive Oil 26 | Inventive Oil 27 | Inventive Oil 28 | Inventive Oil 29 | Inventive Oil 30 | Inventive Oil 31 | Comp. Oil 32 | Comp. Oil 33 |
|---|---|---|---|---|---|---|---|---|
| Component | | | | | | | | |
| VISOM 6 (wt %) | 20 | 18.8 | 7 | 7 | 7 | 7 | | |
| VISOM 4 (wt %) | | | | 20 | | | | |
| PAO 2 (wt %) | | | | | | | | |
| PAO 4 (wt %) | 44.8 | 42.5 | 53.65 | 33.65 | 48.15 | 43.15 | | |
| PAO 6 (wt %) | | | | | | | 47.4 | |
| PAO 8 (wt %) | | | | | | | | 79.6 |
| mPAO 150 (wt %) | 25 | 23.5 | 24.5 | 24.5 | 30 | 35 | | |
| Ester (wt %) | | 5 | | | | | 11.2 | 4.0 |
| PIB viscosity modifier | | | | | | | 30 | 7.5 |
| Antifoam additive (wt %) | 0.2 | 0.2 | 0.2 | 0.2 | 0.2 | 0.2 | | |
| Additives (wt %) | 10 | 10 | 14.65 | 14.65 | 14.65 | 14.65 | 11.4 | 8.9 |
| Total | 100 | 100 | 100 | 100 | 100 | 100 | 100 | 100 |
| Properties | | | | | | | | |
| SAE Grade | 75W-85 | 75W-85 | 75W-85 | 75W-85 | 75W-90 | 75W-90 | 75W-90 | 75W-90 |
| Kinematic Viscosity, 100° C. (ASTM D445, mm2/s) | 11.79 | 11.15 | 11.47 | 11.41 | 14.02 | 16.66 | 14.87 | 14.96 |
| Kinematic Viscosity, 40° C. (ASTM D445, mm2/s) | 68.49 | 63.62 | 66.56 | 65.44 | 85.36 | 105.8 | 100.5 | 109.7 |
| Viscosity Index | 169 | 169 | 168 | 170 | 170 | 171 | 154 | 142 |
| Brookfield Viscosity (ASTM D2983, −20° C., mPA · s) | 2800 | 2460 | | | | | 6250 | 8360 |
| Brookfield Viscosity (ASTM D2983, −26° C., mPA · s) | | | 5080 | | | | | |
| Brookfield Viscosity (ASTM D2983, −30° C., mPA · s) | 9260 | 7260 | | | | | 20800 | 25450 |
| Brookfield Viscosity (ASTM D2983, −40° C., mPA · s) | 41100 | 34600 | 34600, 34700 | 61000 | 55300 | 77400 | 91500 | 124200 |
| Shear Stability (CEC L-45-A-99/Taper Roller Bearing 40 hr, viscosity loss %) | | 1.7 | 0 | 1.4 | 1.7 | 1.3 | 7.5 | 6.3 |
| MTM Traction Coefficient (1.25 GPa, SRR at 30%, 40° C., speed = 2.00 m/s) | 0.04337 | 0.04330 | 0.04331 | 0.04337 | 0.03969 | 0.03828 | 0.05985 | 0.05663 |
| MTM Traction Coefficient (1.25 GPa., SRR at 30%, 60° C., speed = 2.00 m/s) | 0.03719 | 0.03754 | 0.03754 | 0.03506 | 0.03443 | 0.03391 | 0.05298 | 0.05118 |
| MTM Traction Coefficient (1.25 GPa, SRR at 30%, 80° C., speed = 2.00 m/s) | 0.03046 | 0.03093 | 0.03100 | 0.02863 | 0.02817 | 0.02785 | 0.04530 | 0.04426 |
| MTM Traction Coefficient (1.25 GPa, SRR at 30%, 100° C., speed = 2.00 m/s) | 0.02413 | 0.02470 | 0.02467 | 0.02258 | 0.02277 | 0.02209 | 0.03696 | 0.03684 |
| MTM Traction Coefficient (1.25 GPa, SRR at 30%, 120° C., speed = 2.00 m/s) | 0.01879 | 0.01962 | 0.01940 | 0.01687 | 0.01771 | 0.01697 | 0.02947 | 0.02972 |
| Noack volatility (% loss, 150° C., 1 hour) | | 1.1 | | | | | 2.7 | 1.4 |
| Noack volatility (% loss, 200° C., 1 hour) | | 5.1 | | | 5.1 | 5 | 6.4 | |

While the above examples have been to automotive gear oils, these examples are not intended to be limiting.

What is claimed is:

1. A lubricating composition, comprising in admixture:

a) a first base stock component comprising one or more base stocks each having a viscosity of at least 40 cSt, Kv100° C. and a molecular weight distribution (MWD) as a function of viscosity at least 10 percent less than algorithm $$MWD=0.2223+1.0232*\log(Kv \text{ at } 100° C. \text{ in cSt}); \text{ and}$$

b) a second base stock component comprising at least one Poly-Alpha-Olefin (PAO) base stock and at least one Group III base stock, each having a viscosity less than 10 cSt, Kv100° C.

2. The lubricating composition of claim 1 wherein the viscosity difference between the first base stock component and the second base stock component is greater than 30 cSt, Kv100° C.

3. The lubricating composition of claim 1 wherein the first base stock component comprises one or more metallocene catalyzed PAO base stocks.

4. The lubricating composition of claim 1 further comprising at least one additive, the additive chosen from the group consisting of extreme pressure (EP) additives, antiwear additives, dispersants, detergents, antioxidants, corrosion inhibitors, friction reducers, defoamants and demulsifiers, and any combination thereof

5. The lubricating composition of claim 1 wherein the first base stock component has a viscosity of greater than 100 cSt, Kv100° C.

6. The lubricating composition of claim 1 wherein the second base stock component has a viscosity greater than 1.5 cSt, Kv100° C. and less than or equal to 7 cSt, Kv100° C.

7. The lubricating composition of claim 1 wherein the first base stock component has a molecular weight distribution less than algorithm:

$$MWD=0.41667+0.725*\log(Kv \text{ at } 100° C. \text{ in cSt}).$$

8. The lubricating composition of claim 1, wherein the lubricating composition has a viscosity of at least 7 cSt, Kv100° C., and less than 24 cSt, Kv100° C.

9. The lubricating composition of claim 1, wherein the lubricating composition is formulated to be an SAE viscosity grade of 70W-80, 75W-80, 75W-85, 75W-90 or 75W-110.

10. The lubricating composition of claim 1, wherein the first base stock component is present in the amount of 10 to 65 wt % of the lubricating composition, and the second base stock component is present in the amount of 20 to 85 wt % of the lubricating composition.

11. The lubricating composition of claim 10, wherein the lubricating composition contains Group III base stock in an amount of at least 5 wt %.

12. A lubricating composition, comprising in admixture:

a) a first base stock component comprising one or more metallocene catalyzed PAOs each having a viscosity greater than 40 cSt, Kv100° C.; and b) a second base stock component comprising at least one Poly-Alpha-Olefin (PAO) base stock and at least one Group III base stock, each having a viscosity less than 10 cSt, Kv100° C.

13. The lubricating composition of claim 12 wherein the viscosity difference between the first base stock component and the second base stock component is greater than 30 cSt, Kv100° C.

14. The lubricating composition of claim 12 further comprising an additive, the additive chosen from the group consisting of extreme pressure (EP) additives, antiwear additives, dispersants, detergents, antioxidants, corrosion inhibitors, friction reducers, defoamants and demulsifiers, and any combination thereof

15. The lubricating composition of claim 12 wherein the first base stock component has a viscosity of greater than 100 cSt, Kv100° C.

16. The lubricating composition of claim 12 wherein the second base stock component has a viscosity greater than 1.5 cSt, Kv100° C. and less than or equal to 7 cSt, Kv100° C.

17. The lubricating composition of claim 12 wherein the first base stock component has a molecular weight distribution (MWD) as a function of viscosity at least 10percent less than algorithm $$MWD=0.2223+1.0232*\log(Kv \text{ at } 100° C. \text{ in cSt}).$$

18. The lubricating composition of claim 12 wherein the first base stock component has a molecular weight distribution less than algorithm:

$$MWD=0.41667+0.725*\log(Kv \text{ at } 100° C. \text{ in cSt}).$$

19. The lubricating composition of claim 12, wherein the lubricating composition has a viscosity of at least 7 cSt, Kv100° C., and less than 24 cSt, Kv100° C.

20. The lubricating composition of claim 12, wherein the lubricating composition is formulated to be an SAE viscosity grade of 70W-80, 75W-80, 75W-85, 75W-90 or 75W-110.

21. The lubricating composition of claim 12, wherein the first base stock component is present in the amount of 10 to 65 wt % of the lubricating composition, and the second base stock component is present in the amount of 20 to 85 wt % of the lubricating composition.

22. The lubricating composition of claim 21, wherein the lubricating composition contains Group III base stock in an amount of at least 5 wt %.

23. A method of improving the shear stability of an SAE grade 75W-85 or 75W-90 automotive gear oil composition comprising:

a) obtaining a first base stock component comprising one or more base stocks each having a viscosity of at least 40 cSt, Kv100° C. and a molecular weight distribution (MWD) as a function of viscosity at least 10 percent less than algorithm: MWD=0.2223+1.0232*log (Kv at 100° C. in cSt), a second base stock component comprising at least one Poly-Alpha-Olefin (PAO) base stock and at least one Group III base stock, each having a viscosity less than 10 cSt, Kv100° C., and one or more additives; and b) admixing the first base stock component in the amount of 10 to 65 wt % of the gear oil composition, the second base stock component in the amount of 20 to 85 wt % of the gear oil composition, and the one or more additives, to form an SAE grade 75W-85 or 75W-90 automotive gear oil composition;

wherein the lubricating composition provides improved shear stability as measured by CEC L-45-A-99/TRB at 40 hours, when compared to a composition of the substantially the same kinematic viscosity at 100° C. and containing the same second base stock component and one or more additives, but which contains a conventional PIB viscosity modifier in place of the first base stock component, in an amount adjusted along with the second base stock component to achieve the substantially the same kinematic viscosity at 100° C.

24. The method of claim 23, wherein the shear stability is less than 3% viscosity loss, as measured by CEC L-45-A-99/TRB at 40 hours.

25. The method of claim 23, wherein the first base stock component comprises one or more metallocene catalyzed PAOs.

* * * * *